US005717767A

United States Patent [19]

Inanaga et al.

[11] Patent Number: 5,717,767

[45] Date of Patent: *Feb. 10, 1998

[54] ANGLE DETECTION APPARATUS AND AUDIO REPRODUCTION APPARATUS USING IT

[75] Inventors: Kiyofumi Inanaga, Kanagawa; Yuji Yamada, Tokyo, both of Japan

[73] Assignee: Sony Corporation, Tokyo, Japan

[ * ] Notice: The term of this patent shall not extend beyond the expiration date of Pat. No. 5,526,429.

[21] Appl. No.: 448,334

[22] PCT Filed: Nov. 8, 1994

[86] PCT No.: PCT/JP94/01877

§ 371 Date: Jul. 31, 1995

§ 102(e) Date: Jul. 31, 1995

[87] PCT Pub. No.: WO95/13690

PCT Pub. Date: May 18, 1995

[30] Foreign Application Priority Data

| | | | |
|---|---|---|---|
| Nov. 8, 1993 | [JP] | Japan | 5-278572 |
| Nov. 9, 1993 | [JP] | Japan | 5-279772 |
| Nov. 17, 1993 | [JP] | Japan | 5-288435 |
| Jan. 31, 1994 | [JP] | Japan | 6-010031 |

[51] Int. Cl.[6] ..... H04R 5/00

[52] U.S. Cl. ..... 381/25; 381/74; 381/17

[58] Field of Search ..... 381/25, 74, 17, 381/18; 75/504.12, 504.13

[56] References Cited

U.S. PATENT DOCUMENTS

| | | | |
|---|---|---|---|
| 3,962,543 | 6/1976 | Blauert et al. | 381/25 |
| 4,283,679 | 8/1981 | Ito et al. | 324/165 |
| 4,555,761 | 11/1985 | Matsumoto et al. | 364/424 |
| 4,699,006 | 10/1987 | Boxenhorn | 73/517 X |
| 5,197,331 | 3/1993 | Oikawa | 73/504.12 |
| 5,349,857 | 9/1994 | Kasanami et al. | 73/504.14 X |
| 5,412,204 | 5/1995 | Nakamura | 250/231.12 |
| 5,438,623 | 8/1995 | Begault | 381/25 X |
| 5,452,359 | 9/1995 | Inanaga et al. | 381/25 |
| 5,459,790 | 10/1995 | Scofield et al. | 381/25 |
| 5,495,534 | 2/1996 | Inanaga et al. | 381/25 |
| 5,526,429 | 6/1996 | Inanaga et al. | 381/25 |

*Primary Examiner*—Dwayne Bost
*Assistant Examiner*—Scott Richardson
*Attorney, Agent, or Firm*—Jay H. Maioli

[57] ABSTRACT

According to the present invention, when an audio signal is reproduced through headphones, the same localization, sound field and so on as those obtained when the sound is reproduced by loudspeakers located in a predetermined relationship upon reproduction of the sound by the loudspeakers can be obtained. Particularly, gyration of a head of a listener is detected by using a vibratory gyroscope suitable for detection of the gyration of the head. Even when a vibratory gyroscope (175A), (175B) or (175C) is attached to an attachment position which is a head band (177) of a headphones (170) or a left arm (17L) or a right arm (17R) thereof, it is possible to detect the gyration of the head of the listener.

25 Claims, 33 Drawing Sheets

FIG. 4

| $\theta$ | Table Address | Impulse Response $h_{m,n}(t,\theta)$ | | | |
|---|---|---|---|---|---|
| | | $h_{LL}(t,\theta)$ | $h_{LR}(t,\theta)$ | $h_{RL}(t,\theta)$ | $h_{RR}(t,\theta)$ |
| 0° | 0 | $h_{LL}(t,0)$ | $h_{LR}(t,0)$ | $h_{RL}(t,0)$ | $h_{RR}(t,0)$ |
| 2° | 1 | $h_{LL}(t,1)$ | $h_{LR}(t,1)$ | $h_{RL}(t,1)$ | $h_{RR}(t,1)$ |
| 4° | 2 | $h_{LL}(t,2)$ | $h_{LR}(t,2)$ | $h_{RL}(t,2)$ | $h_{RR}(t,2)$ |
| 6° | 3 | $h_{LL}(t,3)$ | $h_{LR}(t,3)$ | $h_{RL}(t,3)$ | $h_{RR}(t,3)$ |
| ⋮ | 4 | ⋮ | ⋮ | ⋮ | ⋮ |
| 358° | 179 | $h_{LL}(t,358)$ | $h_{LR}(t,358)$ | $h_{RL}(t,358)$ | $h_{RR}(t,358)$ |

FIG. 6

| θ | Table Address | Control Data $\Delta T_{IJ}(\theta), \Delta L_{IJ}(\theta)$ | | | |
|---|---|---|---|---|---|
| | | $\Delta T_{LL}(\theta), \Delta L_{LL}(\theta)$ | $\Delta T_{LR}(\theta), \Delta L_{LR}(\theta)$ | $\Delta T_{RL}(\theta), \Delta L_{RL}(\theta)$ | $\Delta T_{RR}(\theta), \Delta L_{RR}(\theta)$ |
| 0° | 0 | $\Delta T_{LL}(0), \Delta L_{LL}(0)$ | $\Delta T_{LR}(0), \Delta L_{LR}(0)$ | $\Delta T_{RL}(0), \Delta L_{RL}(0)$ | $\Delta T_{RR}(0), \Delta L_{RR}(0)$ |
| 2° | 1 | $\Delta T_{LL}(1), \Delta L_{LL}(1)$ | $\Delta T_{LR}(1), \Delta L_{LR}(1)$ | $\Delta T_{RL}(1), \Delta L_{RL}(1)$ | $\Delta T_{RR}(1), \Delta L_{RR}(1)$ |
| 4° | 2 | $\Delta T_{LL}(2), \Delta L_{LL}(2)$ | $\Delta T_{LR}(2), \Delta L_{LR}(2)$ | $\Delta T_{RL}(2), \Delta L_{RL}(2)$ | $\Delta T_{RR}(2), \Delta L_{RR}(2)$ |
| 6° | 3 | $\Delta T_{LL}(3), \Delta L_{LL}(3)$ | $\Delta T_{LR}(3), \Delta L_{LR}(3)$ | $\Delta T_{RL}(3), \Delta L_{RL}(3)$ | $\Delta T_{RR}(3), \Delta L_{RR}(3)$ |
| ⋮ | 4 ⋮ | ⋮ | ⋮ | ⋮ | ⋮ |
| 358° | 179 | $\Delta T_{LL}(179), \Delta L_{LL}(179)$ | $\Delta T_{LR}(179), \Delta L_{LR}(179)$ | $\Delta T_{RL}(179), \Delta L_{RL}(179)$ | $\Delta T_{RR}(179), \Delta L_{RR}(179)$ |

ANGLE DETECTION APPARATUS AND AUDIO REPRODUCTION APPARATUS USING IT

TECHNICAL FIELD

The present invention relates to an angle detection apparatus suitable for use in reproduction of an audio signal through headphones, and an audio reproduction apparatus using it.

Also, the present invention relates to an angle detection apparatus formed of an electronic equipment having a rotation angle detection function with which a rotary movement of a rotary body is detected from its angular velocity, for example.

BACKGROUND ART

There has conventionally been a method of reproducing an audio signal with using headphones which a listener puts on the head with his both ears covered therewith to listen to the audio signal from the both ears. When the method of reproducing the audio signal through the headphones is employed, there occurs a phenomenon referred to as a so-called lateralization in which a reproduced sound image is perceived inside a head of the listener even if the audio signal from a signal source is a stereophonic signal.

On the other hand, the system of reproducing the audio signal through the headphones includes a binaural sound-wave pickup and reproduction system. The binaural sound-wave pickup and reproduction system is the following system. Microphones, so-called dummy-head microphones, are located in left and right auricles of a dummy head which is made to imitate the listener's head. An audio signal from a signal source is picked up by the dummy-head microphones. When the audio signal thus picked up is reproduced and the listener actually listens to the reproduced audio signal with the headphones, the listener can obtain presence with which the listener feels as if he listened to the sounds directly from the signal source. According to the binaural sound-wave pickup and reproduction system, it is possible to improve the picked-up and reproduced sound image in directivity, localization, presence and so on. However, when the above-mentioned binaural reproduction is carried out, it is necessary to provide a signal source as a special source which is picked up by the dummy-head microphones as a sound source signal and different from that use for reproduction with loudspeakers.

It has been supposed to achieve, by applying the above-mentioned binaural sound-wave pickup and reproduction system, a reproduction effect in which a general stereophonic signal is reproduced through the headphones and a reproduced sound image is localized outside the head (at a loudspeaker position) similarly to the reproduction by the loudspeakers. With this arrangement, when the headphones are used for reproduction, the same effect as the reproduction with the loudspeakers is achieved and an effect in which the reproduced sound is prevented from leaking is further achieved because the headphones are used. However, when stereophonic reproduction is carried out by using the loudspeakers, even if the listener changes the direction of his head (face), absolute direction and position of a sound image are not changed and only relative direction and position of the sound image the listener perceives are changed. On the other hand, in the case of the binaural reproduction using the headphones, even if the listener changes his head (face), the relative direction and position of the sound image which the listener perceives are not changed. Therefore, even if the binaural reproduction is carried out by using the headphones, then when the listener changes the direction of the head (face), the sound image is formed inside the listener's head. It is difficult to effect a so-called forward localization, i.e., to localize the sound image in front of the listener. Moreover, in this case, the sound image tends to be elevated above the head and hence becomes unnatural.

According to a reproduction method using headphones disclosed in Japanese patent publication No. 42-227, the following binaural reproduction system using headphones is supposed. Specifically, directivity and localization of a sound image are determined by difference in volume, time, phase and so on between sounds perceived by left and right ears of the listener. The system disclosed in the above publication has a level control circuit and a variable delay circuit in an audio signal line of each of left and right channels and also has a gyroscope for detecting the direction of the listener's head. The level control circuit and the variable delay circuit for the audio signal in each of the channels are controlled based on a signal representing the detected direction of the listener's head.

In the above-mentioned reproduction method using the headphones disclosed in Japanese patent publication No. 42-227, however, a motor is driven by directly using the detection signal representing the direction of the listener's head and a variable resistor and a variable capacitor in the level control circuit and the variable delay circuit are mechanically controlled based on an analog signal by using the motor. Therefore, after the listener has turned the head, a time delay is caused before the differences in volume and time between the audio signals of the respective channels supplied to the headphones are changed. It is impossible for the disclosed reproduction system to sufficiently respond to the movement of the listener's head.

According to the reproduction method using headphones disclosed in Japanese patent publication No. 42-227, characteristics obtained when the differences in volume and time are changed must be determined based on relative positional relationship between a sound source and the listener, a shape of the listener's head, shapes of listener's auricles and so on. Specifically, if a certain characteristic is determined, then the relative positional relationship between the sound source and the listener is fixed so that it is impossible to change a sense of distance and a distance between the sound sources. Further, since listeners have different shapes of heads and auricles, an effect of the method differs depending upon the listeners. Moreover, in the above publication, there is not disclosed means for correcting characteristics inherent in sound sources used when transfer functions from a virtual sound source to the listener's ears is measured and characteristics inherent in the headphones used by the listener. Especially, since the characteristics are changed largely depending on the headphones used, the reproduction state is changed. Also, the kind of the gyroscope is not specified therein.

According to a stereophonic reproduction system disclosed in Japanese patent publication No. 54-19242, a relationship between the listener's direction detected by a gyroscope and change amounts of differences in volume and time between audio signals in both channels which are supplied to the headphones is continuously calculated.

However, the stereophonic reproduction system in the above Japanese patent publication No. 54-19242 requires a memory of a huge capacity for continuously calculating and storing the relationship of the change amounts of the differences in volume and time between the audio signals so that it is very difficult to realize the stereophonic reproduction system. Moreover, in the above publication, there is not disclosed the means for correcting the characteristics inherent in sound sources used when transfer functions from the virtual sound source to the listener's ears is measured and the characteristics inherent in the headphones used by the listener. A kind of a gyroscope is not specified therein.

According to an audio reproduction apparatus disclosed in Japanese laid-open patent publication No. 01-112900 filed by the same applicant as the applicant of the present invention, there is provided an apparatus for discretely, not continuously, calculating data of the relationship between the change amounts of the differences in volume and time between audio signals and processing the audio signals.

However, the Japanese laid-open patent publication No. 01-112900 in which the audio reproduction apparatus is disclosed presents only an abstract concept of a principle that can be applied to both analog and digital signal processings and lacks a specific description required when the audio reproduction apparatus effects the analog or digital signal processing and is applied to actual products. Moreover, in the above publication, there is not disclosed the means for correcting the characteristics inherent in sound sources used when transfer functions from a virtual sound source to the listener's ears is measured and the characteristics inherent in the headphones used by the listener.

According to an audio-signal reproduction apparatus disclosed in Japanese laid-open patent publication No. 03-214897 filed by the same applicant as the applicant of the present invention, transfer functions from respective virtual sound source positions to listener's ears are fixed and subjected to signal processing and then levels and delay times of signals supplied to the ears are controlled in response to an angle of a head gyration. Therefore, it is possible to simplify an arrangement and save a large memory capacity.

In each of the above-mentioned reproduction method using headphones, the stereophonic reproduction system, the audio reproduction apparatus and the audio-signal reproduction apparatus, a gyroscope is used as one of the means for detecting a movement of the listener's head. However, there are many kinds of gyroscopes which are different from one another in operation, characteristics and usage. Although all kinds of gyroscopes are not suitable for use therein, each of the above publications does not disclose specific kind and usage of the gyroscope and specific means and method for realizing the gyroscope. Therefore, there is then the disadvantage that it is difficult to put each of the systems and apparatus into a practical use.

A gyroscope used therein is called a top gyroscope to which characteristics of a top is applied. There is then the disadvantage that since the gyroscope has a high speed rotator provided therein, its life time is short, e.g., several thousand hours or less and that since an electromagnetic pickup for driving and detecting a motor is used in the gyroscope, the gyroscope consumes a large amount of electricity. Moreover, there is then the disadvantage that the gyroscope requires a special AC power supply and hence requires a special circuit when it is used.

There is then the disadvantage that since the gyroscope has a heavyweight and a large volume, costs a lot and has the high-speed rotator, the gyroscope must be handled with considerable care and therefore is not suitable when it is provided on the listener's head to detect the gyration of the head. There is then the disadvantage that when gyrations of heads of a plurality of listeners are detected, a plurality of expensive gyroscopes are required.

Many electric equipments using angle sensors have conventionally been proposed. In a field of a small video camera, for example, it is sometimes observed when the electronic equipment is used, the angle sensor detects a shake of the equipment held by the user's hands to correct a shaken picked-up image.

Such movement of the electronic equipment includes components from a DC component to a frequency component of 100 Hz or larger. Accordingly, when the angle sensor is used to detect such movement of the electronic equipment, an output from the angle sensor requires a wide dynamic range. When the output is digitized and used, a high-accuracy A/D convertor is required.

FIG. 36 shows a block diagram showing a conventional electronic equipment using an angle sensor. In FIG. 36, an angular velocity sensor 301 outputs a detection voltage proportional to an angular velocity with respect to a rotary movement of the equipment. A band pass filter 302 removes unnecessary frequency bands from the detection voltage detected by the angular velocity sensor 301. An amplifier 303 amplifies the detection voltage with a predetermined gain determined based on resistances of resistors $R_1$ and $R_3$.

An A/D convertor 304 encodes and converts the analog detection voltage into a digital detection voltage. A microprocessor 305 calculates a rotation angle from the digital detection voltage coded by the A/D convertor 304 and supplies a control signal to a controlled unit, not shown, for controlling the equipment.

However, the conventional electronic equipment using such angular velocity sensor is encountered by the disadvantage that when the above-mentioned rotary movement of the equipment is detected by using the angle sensor, it is impossible to have a wide dynamic range of the detection output from the angle sensor and there is no high-accuracy A/D convertor required when the detection output is digitized and used.

DISCLOSURE OF THE INVENTION

In view of such aspects, it is a first object of the present invention to provide an angle detection apparatus in which a vibratory gyroscope for detecting a gyration of a head of a listener is provided at an optimum attachment position, and an audio reproduction apparatus using it.

In view of such aspects, it is a second object of the present invention to provide an angle detection apparatus as an electronic equipment having a rotation-angle detection function with which a rotation angle is detected with high accuracy by using an A/D convertor having a comparatively small bit number.

An angle detection apparatus and an audio reproduction apparatus using it of a first invention include a signal source for supplying audio signals in a plurality of channels, storing means for measuring an impulse response from a virtual sound source position with respect to a reference direction of a listener to both ears of the listener that are fixed and recording the impulse response or for measuring differences in time and level between audio signals from the virtual sound source position with respect to the reference direction of the listener to the both ears of the listener at every angle which can be recognized by the listener and storing a control signal representing the difference in time and level between the audio signals, vibratory gyroscope means for detecting a movement of a head of the listener with respect to the reference direction at every predetermined angle and outputting a digitized angle detection signal, address signal conversion means for converting an angle detected by the vibratory gyroscope means into an address signal, control means for correcting the audio signals in respective channels from the signal source based on the impulse response or control signal stored in the storing means, and audio reproduction means for reproducing the audio signals corrected by the control means, wherein an address of the storing means is designated by the address signal from the address signal conversion means on the basis of the angle detection signal from the vibratory gyroscope means which is proportional to an angular velocity, the impulse response or control signal stored in the storing means is read out therefrom, the audio signals are corrected by the control means based on the impulse response or control signal, and the audio signals are corrected in response to the movement of the head of the listener in a real-time fashion. Therefore, since the vibratory gyroscope suitable for detection of the gyration of the head is used, it is possible to correct the audio signals in response to the movement of the head of the listener in a real-time fashion based on the signal proportional to the angular velocity from the vibratory gyroscope which has small size, light weight, low consumed power and long lifetime and is easy to handle and inexpensive.

According to an angle detection apparatus and an audio reproduction apparatus using it of a second invention, the vibratory gyroscope means includes a detection unit for detecting the movement of the head of the listener with respect to the reference direction at every predetermined angle and outputting an analog angle detection signal and an analog/ digital converting unit for converting the analog angle detection signal from the detection unit into a digital signal. Therefore, since an analog vibratory gyroscope suitable for detection of the gyration of the head is used, it is possible to correct the audio signals in response to the movement of the head of the listener in a real-time fashion by converting into the digital signal the signal proportional to the angular velocity from the analog vibratory gyroscope which has small size, light weight, low consumed power and long lifetime and is easy to handle and inexpensive.

According to an angle detection apparatus and an audio reproduction apparatus using it of a third invention, the vibratory gyroscope means is formed of a bidirectional digital output vibratory gyroscope which detects the movement of the head of the listener with respect to the reference direction at every predetermined angle, outputs the digital signal, and carries out a predetermined signal processing in accordance with an external command signal. Therefore, it is possible to correct the audio signals in response to the movement of the head of the listener in a real-time fashion based on the digital signal proportional to the angular velocity from the bidirectional digital output vibratory gyroscope which has small size, light weight, low consumed power and long lifetime, is easy to handle and inexpensive, and carries out a predetermined signal processing in accordance with the external command signal.

According to an angle detection apparatus and an audio reproduction apparatus using it of a fourth invention, the vibratory gyroscope means is formed of a vibratory gyroscope which has a vibration drive unit and a vibration detection unit, at least either of the vibration drive unit and the vibration detection unit being formed of a piezoelectric body, and detects the movement of the head of the listener with respect to the reference direction at every predetermined angle to output an angle detection signal. Therefore, it is possible to correct the audio signals in response to the movement of the head of the listener in a real-time fashion based on the digital signal proportional to the angular velocity from the digital output vibratory gyroscope which has small size, light weight, low consumed power and long lifetime and is easy to handle and inexpensive.

According to an angle detection apparatus and an audio reproduction apparatus using it of a fifth invention, the vibratory gyroscope means includes a regular triangular prism vibrator having first and second piezoelectric ceramics provided at its two side surfaces and a feedback piezoelectric ceramic at its other side surface, a differential amplifier circuit for calculating a difference between an output signal from the first piezoelectric ceramic and an output signal from the second piezoelectric ceramic, an oscillator circuit supplied with an output signal from the feedback piezoelectric ceramic, a phase correction circuit supplied with an output signal from the oscillator circuit and correcting phases of the output signal from the first piezoelectric ceramic and the output signal from the second piezoelectric ceramic, and a synchronous detector circuit supplied with an output signal from the phase correction circuit and an output signal from the differential amplifier circuit and subjecting the output signal from the differential amplifier circuit to synchronous detection. According to this arrangement, the regular triangular prism vibrator is disposed to face the vertical direction and when an external rotation force is applied thereto, it is possible to output a detection output proportional to the angular velocity through the piezoelectric ceramics by using a Coriolis force affecting the vibrator which vibrates.

According to an angle detection apparatus and an audio reproduction apparatus using it of a sixth invention, the vibratory gyroscope means is formed of one or a plurality of angle detection means utilizing a galvanomagnetic effect for detecting movements of heads of one or a plurality of listeners with respect to the reference direction at every predetermined angle and outputting signals. Therefore, it is possible to correct the audio signals in response to the movements of the heads of one or a plurality of listeners in a real-time fashion based on the signal proportional to the angular velocity from the vibratory gyroscope which has small size, light weight, low consumed power and long lifetime and is easy to handle and inexpensive.

An angle detection apparatus and an audio reproduction apparatus using it of a seventh invention include the signal source for supplying audio signals in a plurality of channels, the storing means for measuring the impulse response from the virtual sound source position with respect to the reference direction of the listener to the ears of the listener that are fixed and recording the impulse response or for measuring the differences in time and level between the audio signals from the virtual sound source position with respect to the reference direction of the listener to the ears of the listener at every angle which can be recognized by the listener and storing the control signal representing the differences in time and level between the audio signals, the vibratory gyroscope means which has the vibration drive unit and the vibration detection unit, at least either of the vibration drive unit and the vibration detection unit being formed of the piezoelectric body, and detects the movement of the head of the listener with respect to the reference direction at every predetermined angle to output the angle detection signal, the address signal conversion means for converting the angle detected by the vibratory gyroscope means into the address signal, the control means for correcting the audio signals in respective channels from the signal source based on the impulse response or control signal stored in the storing means, and the audio reproduction means for reproducing the audio signals corrected by the control means, wherein the address of the storing means is designated by the address signal from the address signal conversion means on the basis of the angle detection signal from the vibratory gyroscope means which is proportional to the angular velocity, the impulse response or control signal stored in the storing means is read out therefrom, the audio signals are corrected by the control means based on the impulse response or control signal, and the audio signals are corrected in response to the movement of the head of the listener in a real-time fashion. According to this arrangement, since the vibratory gyroscope suitable for detection of the gyration of the head is used and utilizes not an acceleration but the Coriolis force when detecting the rotary movement, it is unnecessary to attach the vibratory gyroscope to a center of the rotation of the head and hence it is possible to attach the vibratory gyroscope to a head attachment body of the audio reproduction means. Moreover, it is possible to correct the audio signals in response to the movement of the head of the listener in a real-time fashion based on the analog signal proportional to the angular velocity from the vibratory gyroscope which has small size, light weight, low consumed power and long lifetime and is easy to handle and inexpensive.

According to an angle detection apparatus and an audio reproduction apparatus using it of an eighth invention, the vibratory gyroscope means includes the regular triangular prism vibrator having the first and second piezoelectric ceramics provided at its two side surfaces and the feedback piezoelectric ceramic at its other side surface, the differential amplifier circuit for calculating the difference between the output signal from the first piezoelectric ceramic and the output signal from the second piezoelectric ceramic, the oscillator circuit supplied with the output signal from the feedback piezoelectric ceramic, the phase correction circuit supplied with the output signal from the oscillator circuit and correcting phases of the output signal from the first piezoelectric ceramic and the output signal from the second piezoelectric ceramic, and the synchronous detector circuit supplied with the output signal from the phase correction circuit and the output signal from the differential amplifier circuit and subjecting the output signal from the differential amplifier circuit to synchronous detection. According to this arrangement, the regular triangular prism vibrator is disposed to face the vertical direction and when the external rotation force is applied thereto, it is possible to output the detection output proportional to the angular velocity through the piezoelectric ceramics by using the Coriolis force affecting the vibrator which vibrates.

An angle detection apparatus and an audio reproduction apparatus using it of a ninth invention include the signal source for supplying audio signals in a plurality of channels, the storing means for measuring the impulse response from the virtual sound source position with respect to the reference direction of the head of the listener to the both ears of the listener that are fixed and storing the impulse response or for measuring the difference in time and level between the audio signals from the virtual sound source position with respect to the reference direction of the listener to the both ears of the listener at every angle which can be recognized by the listener and storing a control signal representing the difference in time and level between the audio signals, at least one vibratory gyroscope for detecting the movements of the heads of one or a plurality of listeners with respect to the reference direction to output the angle detection signal, the address signal conversion means for converting the angle detection signal output by the vibratory gyroscope into the address signal, the control means for correcting the audio signals in respective channels from the signal source based on the impulse response or control signal stored in the storing means, and the audio reproduction means which has the head attachment body capable of being attached to each of the heads of the one or plurality of listeners, is provided with at least the one vibratory gyroscope and reproduces the audio signals corrected by the control means. In this case, the address of the storing means is designated by the address signal from the address signal conversion means on the basis of the angle detection signal proportional to the angular velocity and supplied from the vibratory gyroscope provided on the audio reproduction means, the correction is carried out based on the impulse response or control signal stored in the storing means, and the audio signals are corrected in response to the movements of the heads of one or a plurality of listeners in a real-time fashion. According to this arrangement, since the vibratory gyroscope suitable for detection of the gyration of the head is used and utilizes not the acceleration but the Coriolis force when detecting the rotary movement, it is unnecessary to attach the vibratory gyroscope to the center of the rotation of the head and hence it is possible to attach the vibratory gyroscope to the head attachment body of the audio reproduction means. Moreover, it is possible to correct the audio signals in response to the movement of the head of the listener in a real-time fashion based on the analog signal proportional to the angular velocity from the vibratory gyroscope which has small size, light weight, low consumed power and long lifetime and is easy to handle and inexpensive.

According to an angle detection apparatus and an audio reproduction apparatus using it of a tenth invention, the vibratory gyroscope is attached to the head attachment body. Therefore, since the vibratory gyroscope utilizes not the acceleration but the Coriolis force when detecting the rotary movement, it is unnecessary to attach the vibratory gyroscope to the center of the rotation of the head and hence it is possible to attach the vibratory gyroscope to the head attachment body of the audio reproduction means. Moreover, it is possible to correct the audio signals in response to the movement of the head of the listener in a real-time fashion based on the analog signal proportional to the angular velocity from the vibratory gyroscope which has small size, light weight, low consumed power and long lifetime and is easy to handle and inexpensive.

According to an angle detection apparatus and an audio reproduction apparatus using it of an eleventh invention, the audio reproduction means further includes a sound generating body and the vibratory gyroscope is provided at a position near the sound generating body. Therefore, since the vibratory gyroscope suitable for detection of the gyration of the head is used and utilizes not the acceleration but the Coriolis force when detecting the rotary movement, it is unnecessary to attach the vibratory gyroscope to the center of the rotation of the head and hence it is possible to attach the vibratory gyroscope to the position near the sound generating body of the audio reproduction means. Moreover, it is possible to correct the audio signal in response to the movement of the head of the listener in a real-time fashion based on the signal proportional to the angular velocity from the vibratory gyroscope which has small size, light weight, low consumed power and long lifetime and is easy to handle and inexpensive.

According to an angle detection apparatus and an audio reproduction apparatus using it of a twelfth invention, the vibratory gyroscope is provided at a connection cable of the audio reproduction means. Therefore, since the vibratory gyroscope suitable for detection of the gyration of the head is used and utilizes not the acceleration but the Coriolis force when detecting the rotary movement, it is unnecessary to attach the vibratory gyroscope to the center of the rotation of the head and hence it is possible to attach the vibratory gyroscope to the cable of the audio reproduction means. Moreover, it is possible to correct the audio signals in response to the movement of the head of the listener in a real-time fashion based on the signal proportional to the angular velocity from the vibratory gyroscope which has small size, light weight, low consumed power and long lifetime and is easy to handle and inexpensive.

According to an angle detection apparatus and an audio reproduction apparatus using it of a thirteenth invention, the vibratory gyroscope is provided at a portion projected from a main body portion of the audio reproduction means. Therefore, since the vibratory gyroscope suitable for detection of the gyration of the head is used and utilizes not the acceleration but the Coriolis force when detecting the rotary movement, it is unnecessary to attach the vibratory gyroscope to the center of the rotation of the head and hence it is possible to attach the vibratory gyroscope to the portion projected from the main body portion of the audio reproduction means. Moreover, it is possible to correct the audio signals in response to the movement of the head of the listener in a real-time fashion based on the signal proportional to the angular velocity from the vibratory gyroscope which has small size, light weight, low consumed power and long lifetime and is easy to handle and inexpensive.

According to an angle detection apparatus and an audio reproduction apparatus using it of a fourteenth invention, the audio reproduction means includes a further head attachment portion independent of a main body portion of the audio reproduction means and the vibratory gyroscope is provided in the further head attachment portion. Therefore, since the vibratory gyroscope suitable for detection of the gyration of the head is used and utilizes not the acceleration but the Coriolis force when detecting the rotary movement, it is unnecessary to attach the vibratory gyroscope to the center of the rotation of the head and hence it is possible to attach the vibratory gyroscope to other portion than the head attachment body of the audio reproduction means. Moreover, it is possible to correct the audio signals in response to the movement of the head of the listener in a real-time fashion based on the signal proportional to the angular velocity from the vibratory gyroscope which has small size, light weight, low consumed power and long lifetime and is easy to handle and inexpensive.

According to an angle detection apparatus and an audio reproduction apparatus using it of a fifteenth invention, the vibratory gyroscope is formed of a vibratory gyroscope which has the vibration drive unit and the vibration detection unit, at least either of the vibration drive unit and the vibration detection unit being formed of the piezoelectric body, and detects the movement of the head of the listener with respect to the reference direction at every predetermined angle to output the angle detection signal. According to this arrangement, since the vibratory gyroscope which is suitable for detection of the gyration of the head and has the vibration drive unit and/or the vibration detection unit formed of the piezoelectric bodies is used and utilizes not the acceleration but the Coriolis force when detecting the rotary movement, it is unnecessary to attach the vibratory gyroscope to the center of the rotation of the head and hence it is possible to attach the vibratory gyroscope to the audio reproduction means. Moreover, it is possible to correct the audio signals in response to the movement of the head of the listener in a real-time fashion based on the signal proportional to the angular velocity from the vibratory gyroscope which has small size, light weight, low consumed power and long lifetime and is easy to handle and inexpensive.

According to an angle detection apparatus and an audio reproduction apparatus using it of a sixteenth invention, the vibratory gyroscope means is formed of one or a plurality of angle detection means utilizing a galvanomagnetic effect for detecting the movements of the heads of one or a plurality of listeners with respect to the reference direction and outputting the signals at every predetermined angle. Therefore, it is unnecessary to attach the vibratory gyroscope to the center of the rotation of the head and hence it is possible to attach the vibratory gyroscope to the head attachment body of the audio reproduction means. Moreover, it is possible to correct the audio signals in response to the movements of the heads of one or a plurality of listeners in a real-time fashion based on the signal proportional to the angular velocity from the vibratory gyroscope which has small size, light weight, low consumed power and long lifetime and is easy to handle and inexpensive.

An angle detection apparatus and an audio reproduction apparatus using it of a seventeenth invention include the signal source for supplying audio signals in a plurality of channels, the storing means for measuring the impulse response from the virtual sound source position with respect to the reference direction of the head of the listener to the both ears of the listener positioned in accordance with the movement of the listener's head and storing the impulse response or for measuring the differences in time and level between the audio signals from the virtual sound source position with respect to the reference direction of the listener to the both ears of the listener at every angle which can be recognized by the listener and storing the control signal representing the differences in time and level between the audio signals, one or a plurality of angle detection means utilizing galvanomagnetic effect for detecting the movements of the heads of one or a plurality of listeners with respect to the reference direction to output the signals, the address signal conversion means for converting the angle detected by the angle detection means utilizing the galvanomagnetic effect into the address signal, the control means for correcting the audio signals in respective channels from the signal source based on the impulse response or control signal stored in the storing means, and the audio reproduction means which has the head attachment body capable of being attached to each of heads of the one or plurality of listeners, the head attachment body being provided with the angle detection means, and reproduces the audio signals corrected by the control means. In this case, on the basis of the signal in response to the angle supplied from the angel detection means that utilizes galvanomagnetic effect and is provided on the head attachment body of the audio reproduction means, the impulse response or control signal stored in the storing means is read out based on the address signal of the address signal conversion means, the audio signals are corrected by the control means based on the impulse response or control signal, and the audio signals are corrected in response to the movements of the heads of one or a plurality of listeners in a real-time fashion. According to this arrangement, since the vibratory gyroscope which utilizes the galvanomagnetic effect and is suitable for detection of the gyration of the head is used and utilizes not the acceleration but geomagnetism when detecting the rotary movement, it is unnecessary to attach the vibratory gyroscope to the center of the rotation of the head and hence it is possible to attach the vibratory gyroscope to the head attachment body of the audio reproduction means.

Moreover, it is possible to correct the audio signals in response to the movement of the head of the listener in a real-time fashion based on the signal proportional to the angle supplied from the angle detection means utilizing the galvanomagnetic effect which has small size, light weight, low consumed power and long lifetime and is easy to handle and inexpensive.

According to an angle detection apparatus and an audio reproduction apparatus using it of an eighteenth invention, the angle detection means utilizing the galvanomagnetic effect is a galvanomagnetic effect sensor utilizing the geomagnetism in which detection coils are perpendicular to each other. Therefore, it is possible to prevent a magnetic variation with respect to the earth from differing depending upon the places at different latitudes and to detect the horizontal component of the geomagnetism without error even when the galvanomagnetic effect sensor is inclined. It is unnecessary to attach the angle detection means to the center of the rotation of the head and hence it is possible to attach the angle detection means to the head attachment body of the audio reproduction means. Moreover, it is possible to correct the audio signals in response to the movement of the head of the listener in a real-time fashion based on the signal proportional to the angle supplied from the angle detection means utilizing the galvanomagnetic effect which has small size, light weight, low consumed power and long lifetime and is easy to handle and inexpensive.

According to an angle detection apparatus and an audio reproduction apparatus using it of a nineteenth invention, the angle detection means utilizing the galvanomagnetic effect is a galvanomagnetic effect sensor utilizing Hall effect. Therefore, it is possible to detect the angle by detecting Hall voltage produced by the geomagnetism. Therefore, it is unnecessary to attach the angle detection means to the center of the rotation of the head and hence it is possible to attach the angle detection means to the head attachment body of the audio reproduction means. Moreover, it is possible to correct the audio signals in response to the movement of the head of the listener in a real-time fashion based on the signal proportional to the angle supplied from the angle detection means utilizing Hall effect of the galvanomagnetic effect which has small size, light weight, low consumed power and long lifetime and is easy to handle and inexpensive.

According to an angle detection apparatus and an audio reproduction apparatus using it of a twentieth invention, the angle detection means utilizing galvanomagnetic effect is a galvanomagnetic effect sensor utilizing magnetoresistance effect. It is possible to detect the angle by detecting a resistance value relative to the geomagnetism. Therefore, it is unnecessary to attach the angle detection means to the center of the rotation of the head and hence it is possible to attach the angle detection means to the head attachment body of the audio reproduction means. Moreover, it is possible to correct the audio signals in response to the movement of the head of the listener in a real-time fashion based on the signal proportional to the angle supplied from the angle detection means utilizing magnetoresistance effect of the galvanomagnetic effect which has small size, light weight, low consumed power and long lifetime and is easy to handle and inexpensive.

According to an angle detection apparatus and an audio reproduction apparatus using it of a twenty-first invention, the angle detection means utilizing galvanomagnetic effect is a galvanomagnetic effect sensor utilizing Planer Hall effect. It is possible to detect the angle by detecting a resistance value relative to the geomagnetism. Therefore, it is unnecessary to attach the angle detection means to the center of the rotation of the head and hence it is possible to attach the angle detection means to the head attachment body of the audio reproduction means. Moreover, it is possible to correct the audio signals in response to the movement of the head of the listener in a real-time fashion based on the signal proportional to the angle supplied from the angle detection means utilizing Planer Hall effect of the galvanomagnetic effect which has small size, light weight, low consumed power and long lifetime and is easy to handle and inexpensive.

According to an angle detection apparatus and an audio reproduction apparatus using it of a twenty-second invention, the angle detection means utilizing the galvanomagnetic effect is a galvanomagnetic effect sensor utilizing Suhl effect. It is possible to detect the angle by detecting conductivity in response to a sum of forces produced by an electric field and the geomagnetism. Therefore, it is unnecessary to attach the angle detection means to the center of the rotation of the head and hence it is possible to attach the angle detection means to the head attachment body of the audio reproduction means. Moreover, it is possible to correct the audio signals in response to the movement of the head of the listener in a real-time fashion based on the signal proportional to the angle supplied from the angle detection means utilizing Suhl effect of the galvanomagnetic effect which has small size, light weight, low consumed power and long lifetime and is easy to handle and inexpensive.

According to an angle detection apparatus and an audio reproduction apparatus using it of a twenty-third invention, the angle detection means utilizing galvanomagnetic effect is a galvanomagnetic effect sensor utilizing Ettingshausen effect. It is possible to detect the angle by detecting a temperature gradient relative to the geomagnetism. Therefore, it is unnecessary to attach the angle detection means to the center of the rotation of the head and hence it is possible to attach the angle detection means to the head attachment body of the audio reproduction means. Moreover, it is possible to correct the audio signals in response to the movement of the head of the listener in a real-time fashion based on the signal proportional to the angle supplied from the angle detection means utilizing Ettingshausen effect of the galvanomagnetic effect which has small size, light weight, low consumed power and long lifetime and is easy to handle and inexpensive.

According to an angle detection apparatus and an audio reproduction apparatus using it of a twenty-fourth invention, the one or plurality of angle detection means utilizing galvanomagnetic effect output signals representing a predetermined angle when a predetermined external magnetic field is applied. Therefore, since the one or plurality of angle detection means utilizing the galvanomagnetic effect output the signal of the predetermined angle when the predetermined external magnetic field is applied thereto, it is possible to forcibly set the angle detection signals of the one or plurality of angle detection means utilizing the galvanomagnetic effect to a predetermined value.

An angle detection apparatus of a twenty-fifth invention includes an angular velocity sensor for detecting an angular velocity of a rotary movement of a rotator, an amplifier having a gain switching circuit and amplifying a detection signal from the angular velocity sensor, an analog/digital convertor for converting an output signal from the amplifier into a digital signal, and arithmetic means for calculating a rotation angle by taking in the digital signal converted by the analog/digital converter and integrating the same. In this case, a gain of the amplifier is switched by the gain switching circuit in response to the digital signal taken in by the arithmetic means. According to this arrangement, since the amplifier is provided with the gain switching circuit and the gain of the gain switching circuit is switched in response to the digital signal taken in by the arithmetic means, when an output level of the angular velocity sensor exceeds a predetermined reference level, the gain of the amplifier provided between the angular velocity sensor and the analog/digital converter is lowered, thereby preventing the output signal from the amplifier from exceeding a dynamic range of the analog/digital converter. Conversely, when the output level of the angular velocity sensor is smaller than the reference level, the gain of the amplifier is increased to set the output signal of the amplifier within the range of the dynamic range of the analog/digital converter. Thus, it is possible to have a wide dynamic range even when the analog/digital converter having the small bit number is used.

According to an angle detection apparatus of a twenty-sixth invention, the arithmetic means includes a sampling processing unit for sampling an output signal from the analog/digital converter at a predetermined frequency, an angle calculating unit for generating angle data by integrating an output signal from the sampling processing unit, and a comparing unit for comparing the output signal from the sampling processing unit and a reference signal in which an output signal from the comparing unit is supplied to the gain switching circuit. According to this arrangement, since the amplifier is provided with the gain switching circuit and the gain of the gain switching circuit is switched in response to the digital signal taken in by the arithmetic means , when the output level of the angular velocity sensor exceeds the predetermined reference level, the gain of the amplifier provided between the angular velocity sensor and the analog/digital converter is lowered, thereby preventing the output signal from the amplifier from exceeding the dynamic range of the analog/digital converter. Conversely, when the output level of the angular velocity sensor is smaller than the reference level, then the gain of the amplifier is increased to set the output signal of the amplifier within the range of the dynamic range of the analog/digital converter. Thus, it is possible to have the wide dynamic range even when the analog/digital converter having the small bit number is used.

According to an angle detection apparatus of a twenty-seventh invention, the amplifier is formed of a logarithmic compression amplifier. Therefore, since the output level of the angular velocity sensor is subjected to logarithmic compression and then subjected to analog/digital conversion and the compression ratio is properly selected, it is possible to code the output signal from the angular velocity sensor having a wide dynamic range by the analog/digital converter having the small bit number. Since the inverse logarithmic calculation is carried out in the processing in the arithmetic means, it is possible to enlarge the dynamic range by calculating the angle from the linear signal. Moreover, it is possible to have the wide dynamic rage even when the analog/digital converter having the small bit number is used.

According to an angle detection apparatus of a twenty-eighth invention, the angular velocity sensor is formed of a piezoelectric vibratory gyroscope. Therefore, it is possible to provide the equipment of smaller size and lighter weight and to reduce the power consumed by the angular velocity sensor.

According to an angle detection apparatus of a twenty-ninth invention, at least the angular velocity sensor, the amplifier and the analog/digital converter are formed integrally. Therefore, it is possible that the above angular velocity sensor, the amplifier and the analog/digital converter as a single unit detect the angular velocity and convert the same into digital data which is used to control the equipments at the succeeding stage and the above angular velocity sensor, the amplifier and the analog/digital converter as a single unit are treated as a digital output angular velocity sensor element. It is possible to reduce positional displacement of parts upon mounting and to stably detect the angle with satisfactory immunity against noise.

An angle detection apparatus of a thirtieth invention includes the angular velocity sensor for detecting an angular velocity of a rotary movement of the rotator, a first amplifier for amplifying a detection signal from the angular velocity sensor, a first analog/digital convertor for converting an output signal from the first amplifier into a digital signal, a second amplifier having a gain different from that of the first amplifier and amplifying the detection signal from the angular velocity sensor, a second analog/digital convertor for converting an output signal from the second amplifier into a digital signal, and arithmetic means for calculating a rotation angle by taking in the digital signal converted by the first or second analog/digital converter and integrating the same. The arithmetic means calculates the rotation angle by selectively using a digital signal from the first analog/digital converter and a digital signal from the second analog/digital convertor depending upon signal levels of the digital signal from the first analog/digital converter and the digital signal from the second analog/digital convertor. According to this arrangement, the first and second amplifiers are at least more than two first and second amplifiers having different gains, the detection signal from the angular velocity sensor is supplied to at least more than first and second amplifiers having different gains, the output signals from at least more than two first and second amplifiers having different gains are coded by the first and second analog/digital converters and then taken in the arithmetic means, and the calculated result of the arithmetic means is used to select the first and second analog/digital converters which are used to calculate the rotation angle. Therefore, when the output level of the angular velocity sensor exceeds the predetermined reference level, the output signal from the amplifier having a smaller gain of the first and second amplifiers is converted into the digital output data which are supplied to the arithmetic means. Conversely, when the output level of the angular velocity sensor is smaller than the predetermined reference level, the output signal from the amplifier having a larger gain of the first and second amplifiers is converted by the analog/digital converter into the digital data which are supplied to the arithmetic means. The arithmetic means carries out the processing for converting the angular velocity into the angle. Thus, it is possible to enlarge the dynamic range. It is possible to have the wide dynamic range even when the analog/digital converter having the small bit number is used.

According to an angle detection apparatus of a thirty-first invention, the arithmetic means includes a first sapling processing unit for sampling the output signal from the first analog/digital converter at a predetermined frequency, a second sampling processing unit for sampling the output signal from the second analog/digital converter at a predetermined frequency, an angle calculating unit for generating angle data by integrating the output signal from the first or second sampling processing unit, a comparing unit for comparing the output signal from the first or second sampling processing unit and a reference signal, and a switching unit for selectively supplying the output signal from the first Sampling processing unit or the output signal from the second sampling processing unit to the angle calculating unit based on an output signal from the comparing unit. According to this arrangement, when the output level of the angular velocity sensor exceeds the predetermined reference level, the output signal from the amplifier having a smaller gain of a plurality of the first and second amplifiers is converted into the digital output data which are supplied to the arithmetic means. Conversely, when the output level of the angular velocity sensor is smaller than the predetermined reference level, the output signal from the amplifier having a larger gain is converted by the analog/digital converter into the digital data which are supplied to the arithmetic means. The arithmetic means carries out the processing for converting the angular velocity into the angle. Thus, it is possible to enlarge the dynamic range. It is possible to have the wide dynamic range even when the analog/digital converter having the small bit number is used.

According to an angle detection apparatus of a thirty-second invention, the first and second amplifiers are formed of logarithmic compression amplifiers. Therefore, since the output level of the angular velocity sensor is subjected to logarithmic compression and subjected to analog/digital conversion and the compression ratio is properly selected, it is possible to code the output signal from the angular velocity sensor having a wide dynamic range by the analog/digital converter having the small bit number. Since the inverse logarithmic calculation is carried out in the processing in the arithmetic means, it is possible to enlarge the dynamic range by calculating the angle from the linear signal. Moreover, it is possible to have the wide dynamic rage even when the analog/digital converter having the small bit number is used.

According to an angle detection apparatus of a thirty-third invention, the angular velocity sensor is formed of the piezoelectric vibratory gyroscope. Therefore, it is possible to provide the equipment of smaller size and lighter weight and to reduce the power consumed by the angular velocity sensor.

According to an angle detection apparatus of a thirty-fourth invention, at least the angular velocity sensor, the amplifier and the analog/digital converter are formed integrally. Therefore, it is possible that the above angular velocity sensor, the amplifier and the analog/digital converter as a single unit detect the angular velocity and convert the same into digital data which are used to control the equipments at the succeeding stage and the above angular velocity sensor, the amplifier and the analog/digital converter as a single unit are treated as the digital output angular velocity sensor element. It is possible to reduce positional displacement of parts upon mounting and to stably detect the angle with satisfactory resistance against noise.

An angle detection apparatus and an audio reproduction apparatus using it of a thirty-fifth invention include the signal source for supplying audio signals in at least one channel or more, storing means or calculating means for measuring or calculating transfer characteristics from the virtual sound source position with respect to the reference direction of the head of the listener to the both ears of the listener at every angle which at least the listener can recognize and storing the transfer characteristics or outputting the same in a real-the fashion and/or for storing or calculating an arrival time and a sound pressure level of an audio Signal from the virtual sound source position with respect to the reference direction of the listener to the both ears of the listener at every angle which can be recognized by the listener or the control signal representing the arrival time and the sound pressure level of the audio signal, at least one vibratory gyroscope for detecting the movements of the heads of one or a plurality of listeners with respect to the reference direction at every angle which at least the listener can recognize to output the signal, the control means for correcting the audio signals in respective channels from the signal source based on the transfer characteristics or control signal from the storing means or calculating means, and audio reproduction means which has the head attachment body capable of being attached to each of the heads of the one or plurality of listeners, is provided with at least the one vibratory gyroscope and reproduces the audio signal corrected by the control means. In this case, on the basis of the signal in response to the angle supplied from the vibratory gyroscope provided on the audio reproduction means, the correction is carried out in response to the impulse response or control signal from the storing means or calculating means, and the audio signals are corrected in response to the movements of the heads of one or a plurality of listeners in a real-time fashion. According to this arrangement, since the reproduced audio signal including the monophonic audio signals are stored in the memory or directly calculated based on a discrete position and angle of the listener and corrected based on the transfer characteristics or the control signals, it is possible to correct the fine gyration of the head of the listener at an optional position.

BRIEF DESCRIPTION OF DRAWINGS

FIG. 4 is a diagram showing a table of data of impulse responses of the angle detection apparatus and the audio reproduction apparatus using it according to the embodiment of the present invention;

FIG. 6 is a diagram showing a table of data of control signals of the angle detection apparatus and the audio reproduction apparatus using it according to the embodiment of the present invention;

Figure 23:
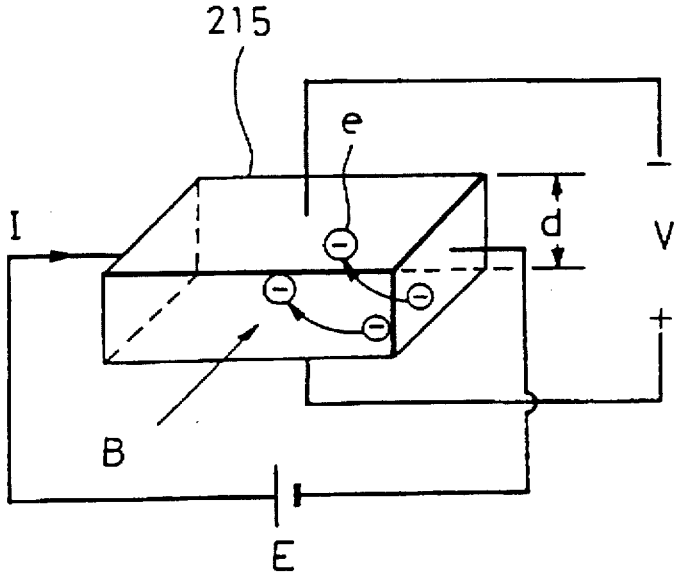
Figure 24:
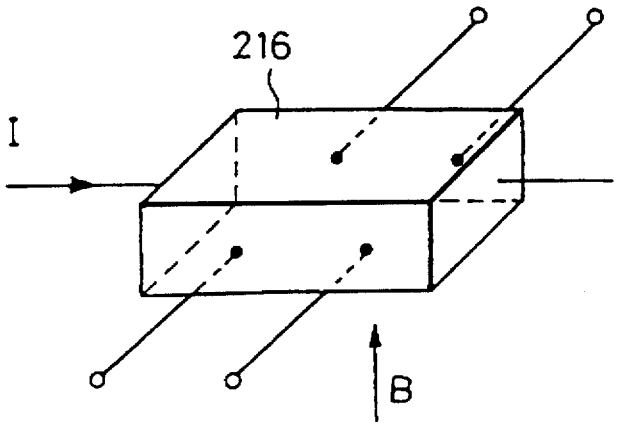
Figure 25:
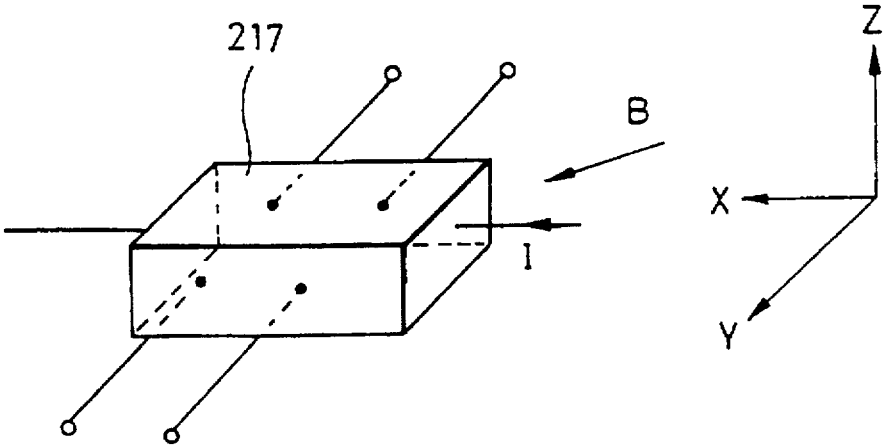
Figure 26:
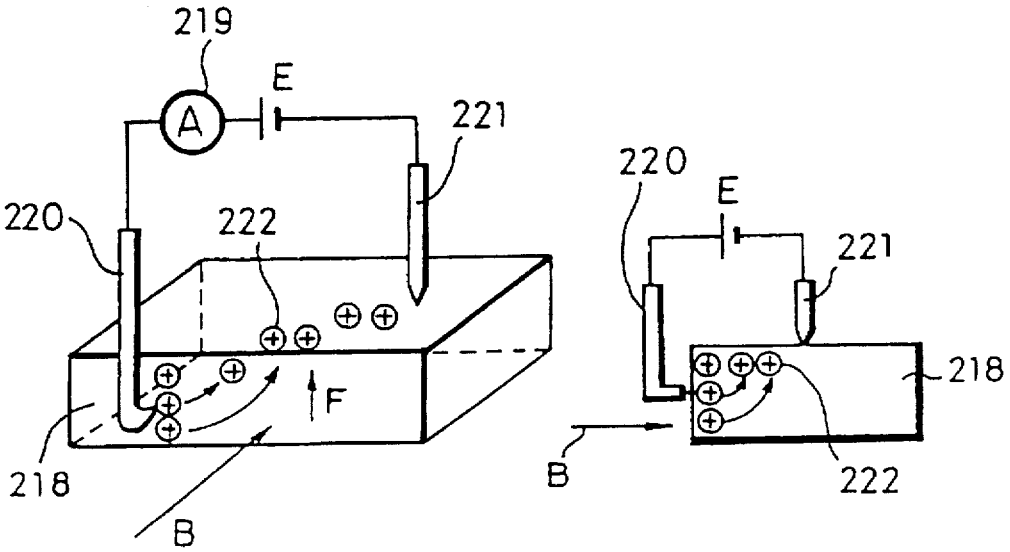
Figure 27:
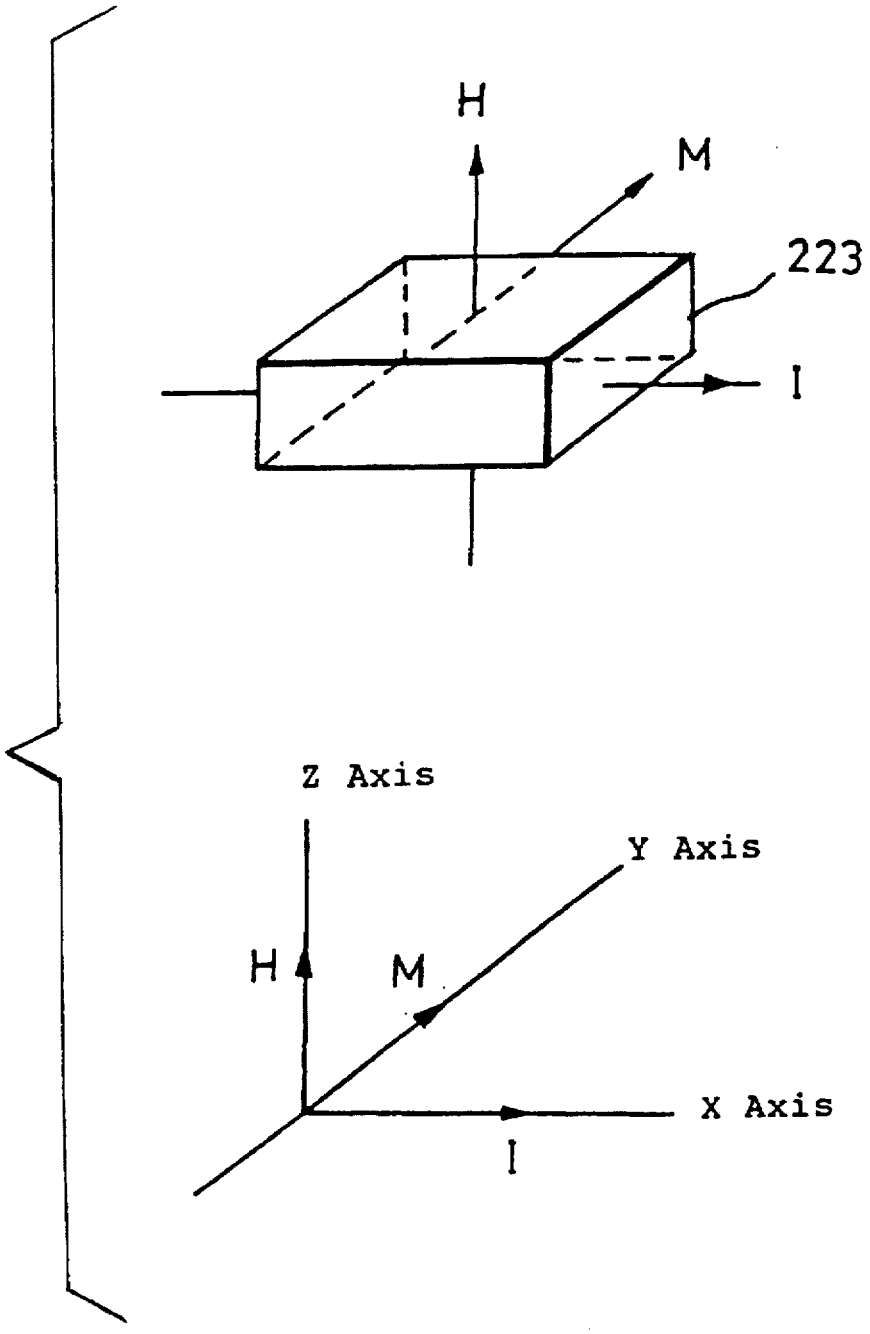
Figure 28:
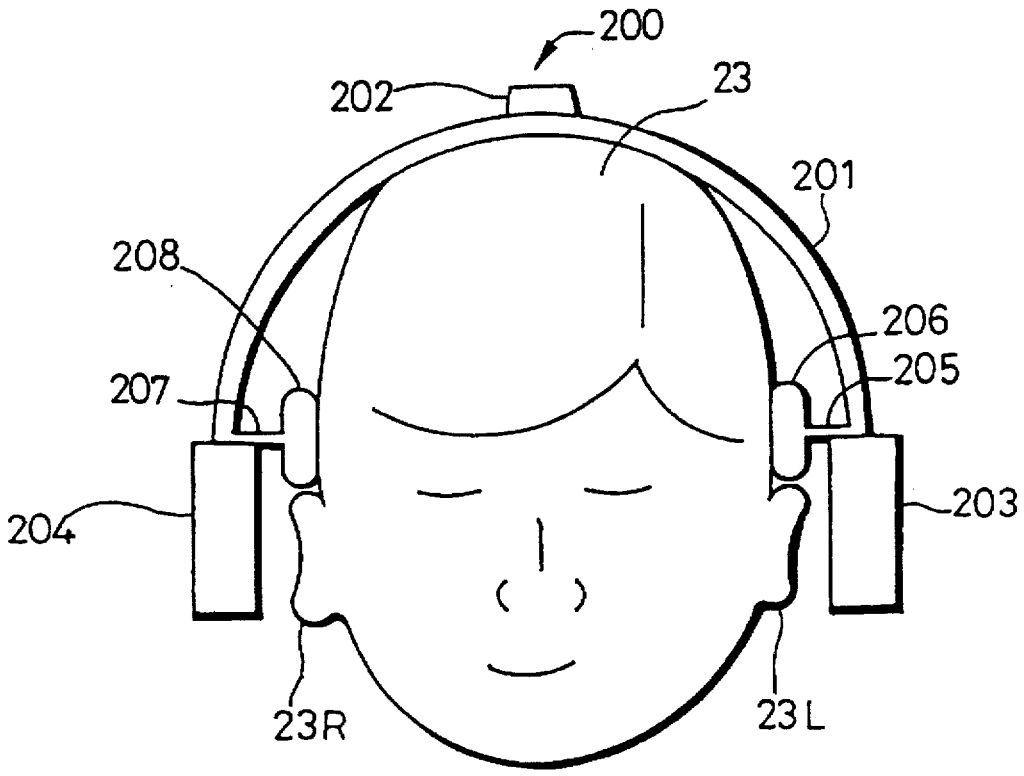
Figure 29:
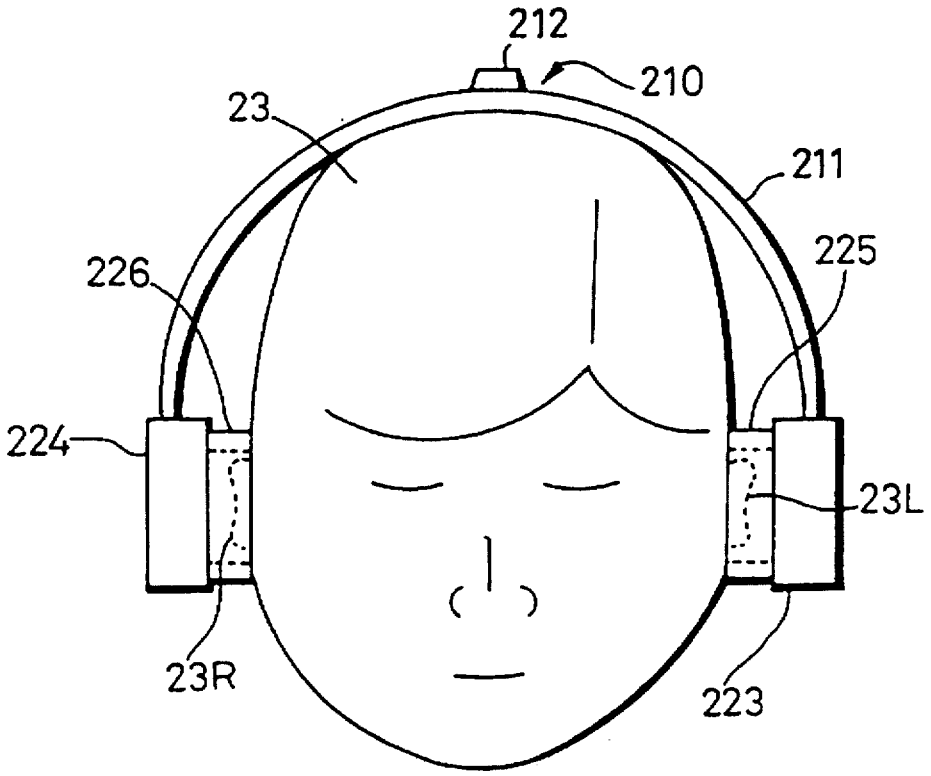
Figure 30:
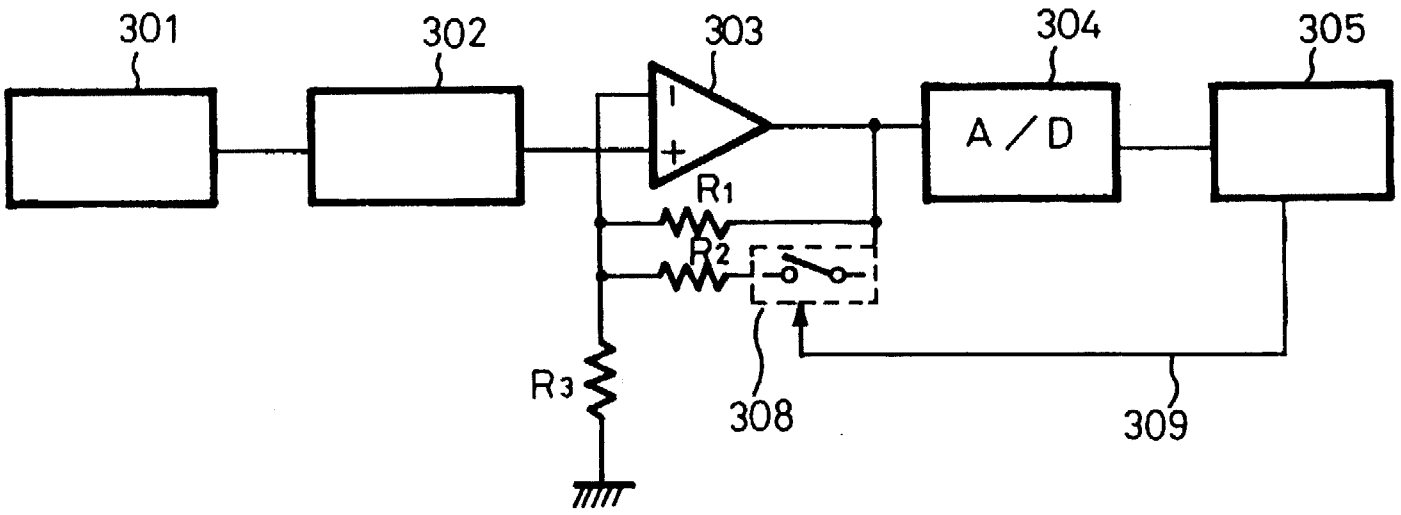
Figure 31:
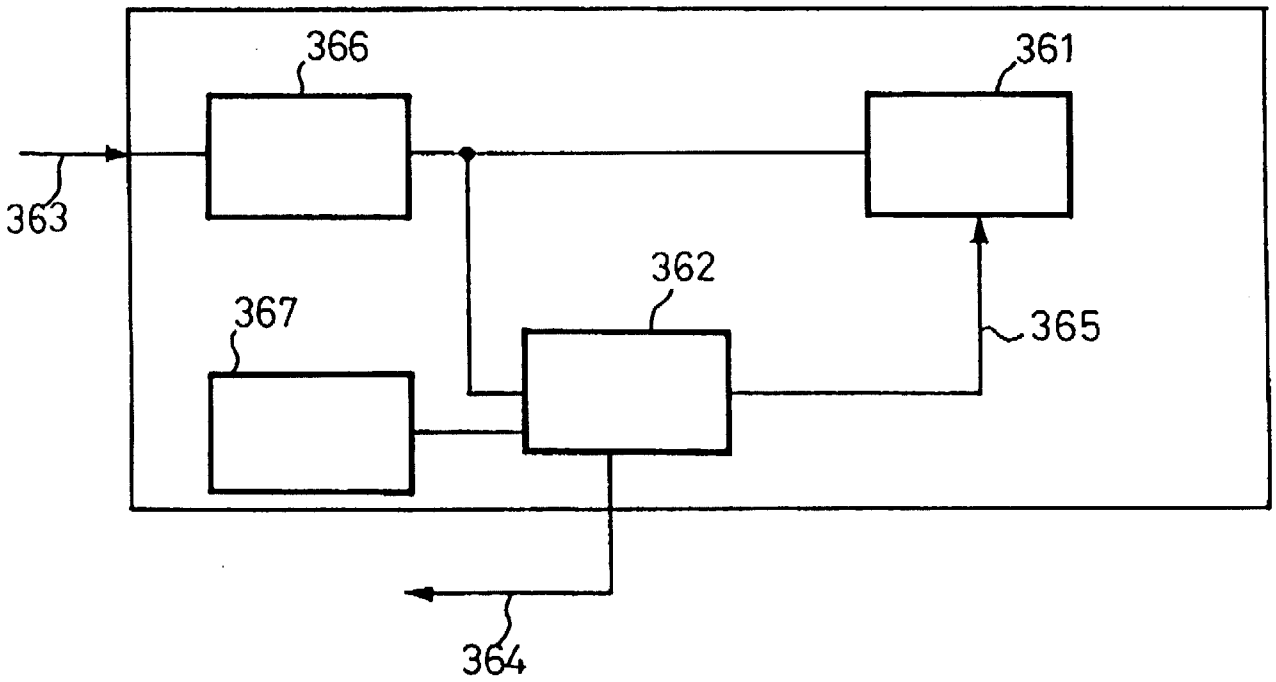
Figure 32:
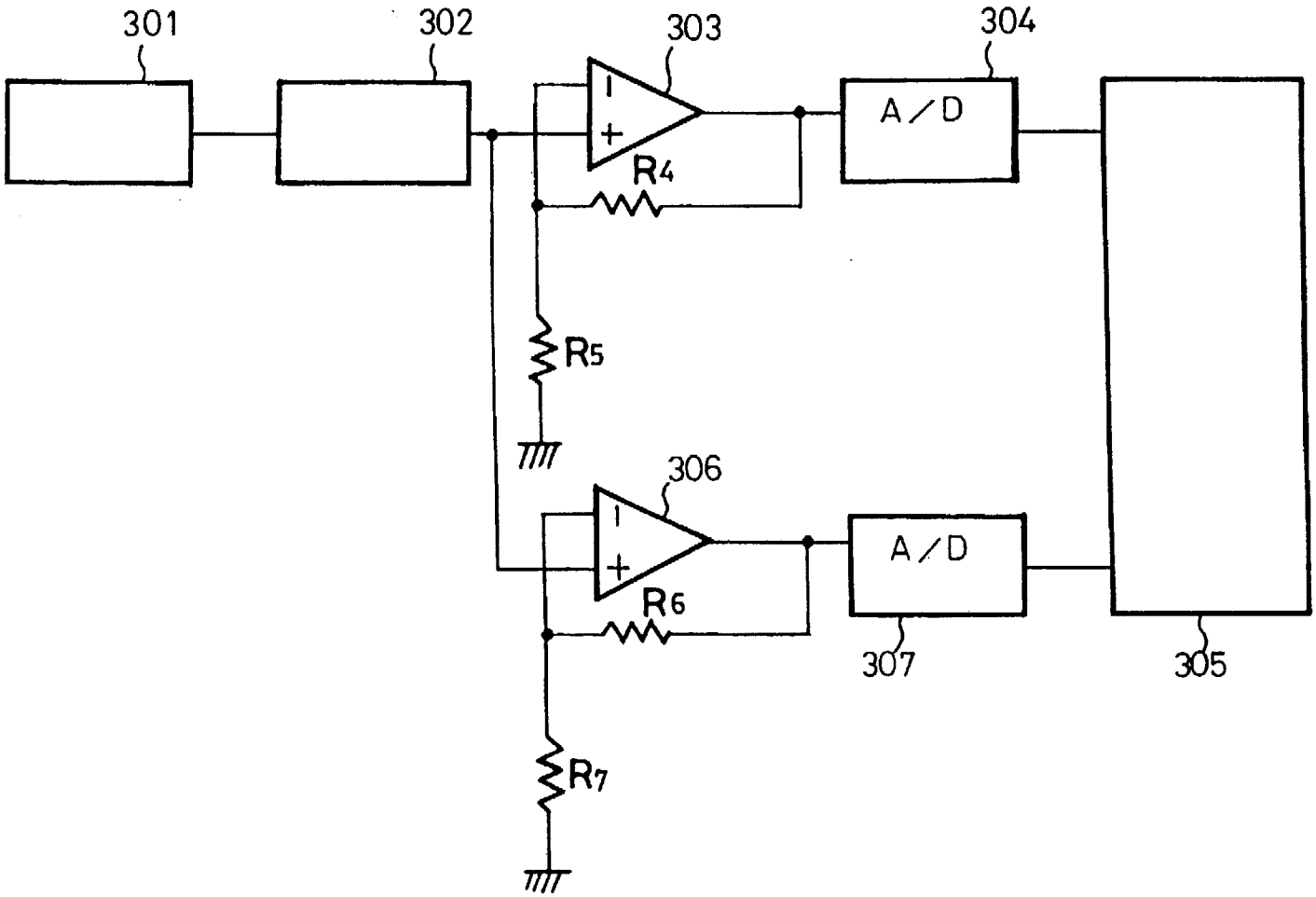
Figure 33:
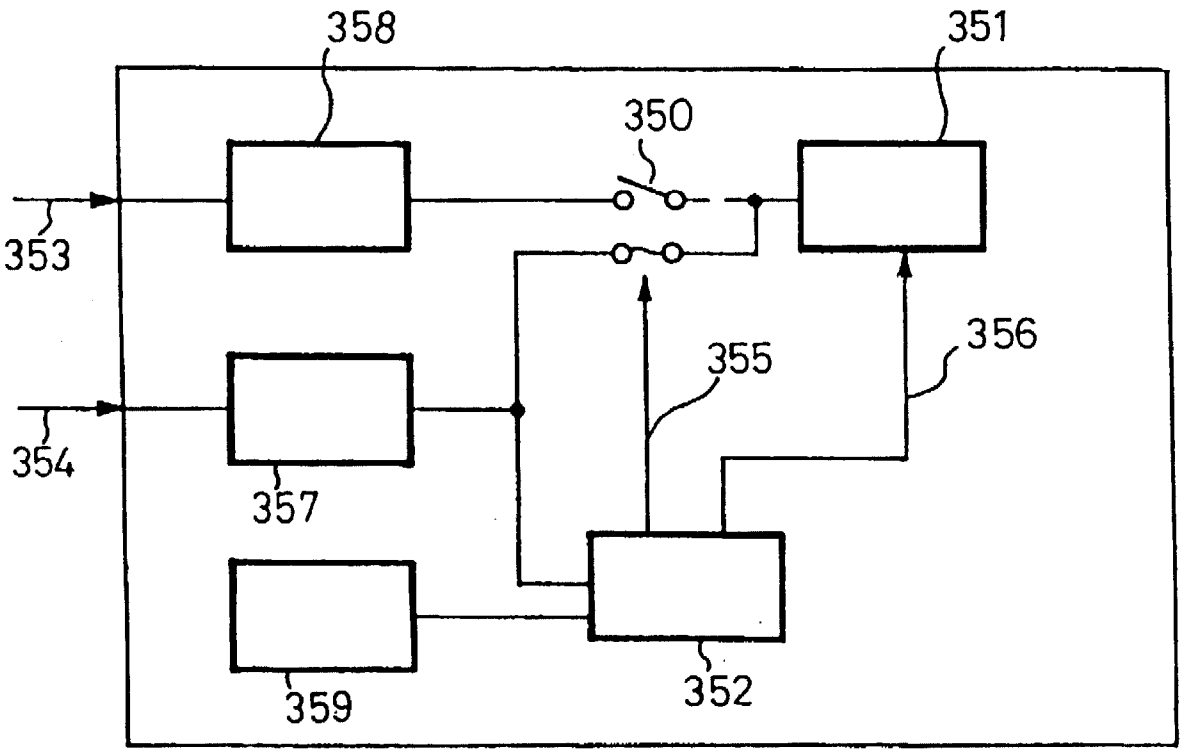
Figure 34:
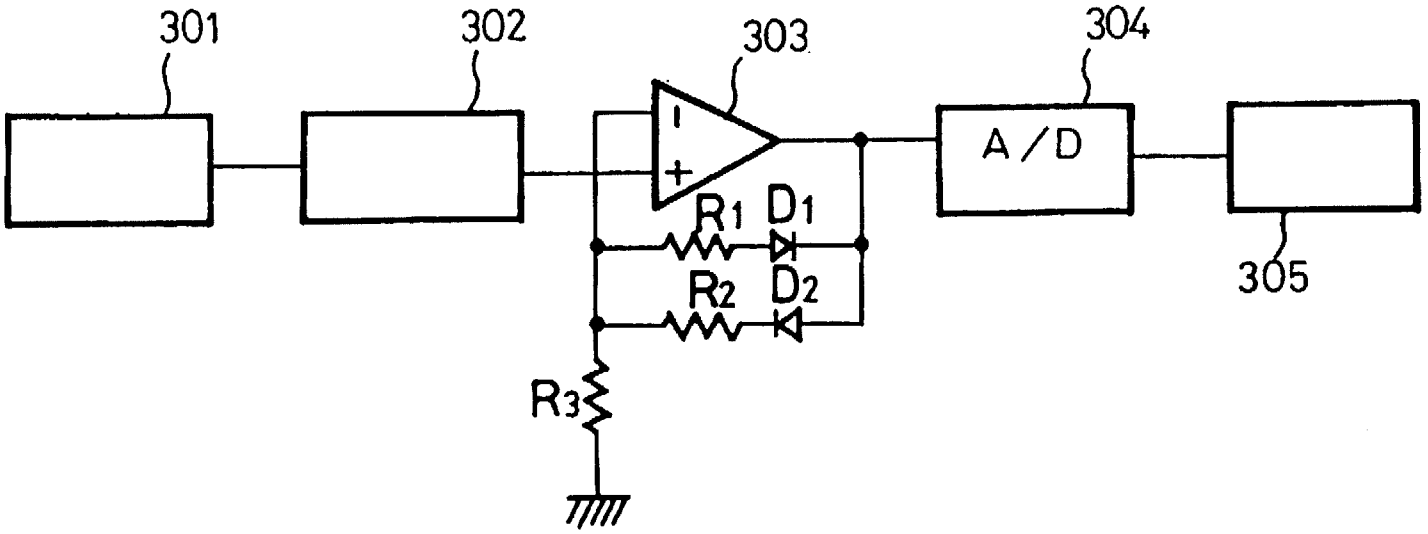
Figure 35:
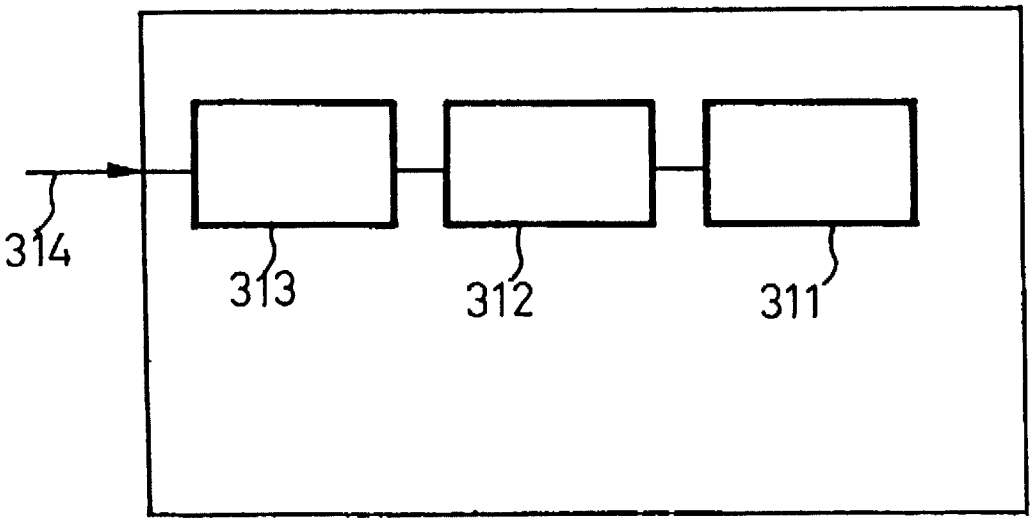
Figure 36:
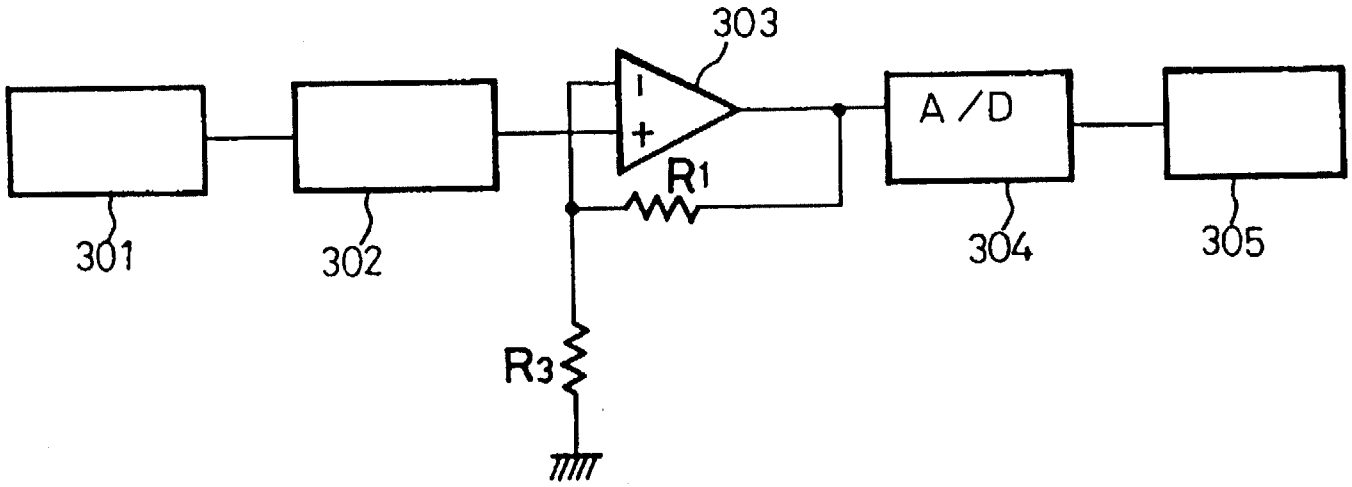

PIG. 22 is a graph showing a locus of a vector representing geomagnetism affected by an external magnetic field in the galvanomagnetic effect sensor as the angle detection apparatus of the angle detection apparatus and the audio reproduction apparatus using it according to another embodiment of the present invention;

FIG. 23 is a diagram showing an arrangement of the galvanomagnetic effect sensor utilizing Hall effect as the angle detection apparatus of the angle detection apparatus and the audio reproduction apparatus using it according to another embodiment of the present invention;

FIG. 24 is a diagram showing an arrangement of the galvanomagnetic effect sensor utilizing magnetoresistance effect as the angle detection apparatus of the angle detection apparatus and the audio reproduction apparatus using it according to another embodiment of the present invention;

FIG. 25 is a diagram showing an arrangement of the galvanomagnetic effect sensor utilizing Planer Hall effect as the angle detection apparatus of the angle detection apparatus and the audio reproduction apparatus using it according to another embodiment of the present invention;

FIG. 26 is a diagram showing an arrangement of the galvanomagnetic effect sensor utilizing Suhl effect as the angle detection apparatus Of the angle detection apparatus and the audio reproduction apparatus using it according to another embodiment of the present invention;

FIG. 27 is a diagram showing an arrangement of the galvanomagnetic effect sensor utilizing Ettingshausen effect as the angle detection apparatus of the angle detection apparatus and the audio reproduction apparatus using it according to another embodiment of the present invention;

FIG. 28 is a diagram showing headphones of the angle detection apparatus and the audio reproduction apparatus using it according to another embodiment of the present invention;

FIG. 29 is a diagram showing headphones of the angle detection apparatus and the audio reproduction apparatus using it according to another embodiment of the present invention;

FIG. 30 is a block diagram showing an electronic equipment having a rotation angle detection function as the angle detection apparatus of the angle detection apparatus and the audio reproduction apparatus using it according to another embodiment of the present invention;

FIG. 31 is a block diagram showing a processing in a microprocessor of the electronic equipment having the rotation angle detection function as the angle detection apparatus of the angle detection apparatus and the audio reproduction apparatus using it according to another embodiment of the present invention;

FIG. 32 is a block diagram showing an electronic equipment having a rotation angle detection function as the angle detection apparatus of the angle detection apparatus and the audio reproduction apparatus using it according to another embodiment of the present invention;

FIG. 33 is a block diagram showing a processing in a microprocessor of the electronic equipment having the rotation angle detection function as the angle detection apparatus of the angle detection apparatus and the audio reproduction apparatus using it according to another embodiment of the present;

FIG. 34 is a block diagram showing an electronic equipment having a rotation angle detection function as the angle detection apparatus of the angle detection apparatus and the audio reproduction apparatus using it according to another embodiment of the present invention;

FIG. 35 is a block diagram showing a processing in a microprocessor of the electronic equipment having the rotation angle detection function as the angle detection apparatus of the angle detection apparatus and the audio reproduction apparatus using it according to another embodiment of the present; and FIG. 36 is a block diagram showing a conventional electronic equipment having an angle sensor.

BEST MODE CARRYING OUT THE INVENTION

An angle detection apparatus and an audio reproduction apparatus using it according to an embodiment of the present invention will hereinafter be described in detail with reference to FIGS. 1 through 14.

According to the angle detection apparatus and the audio reproduction apparatus using it of the embodiment of the present invention, when an audio signal is reproduced through headphones, the listener can perceive the equivalent localization, sound field and so on to those perceived when the audio signals are reproduced by loudspeakers located in a predetermined positional relationship in which the loudspeakers should be located when the audio signals are reproduced by the loudspeakers. Particularly, a gyration of a listener's head is detected by a vibratory gyroscope suitable for detection of a gyration of the listener's head.

Figure 1:
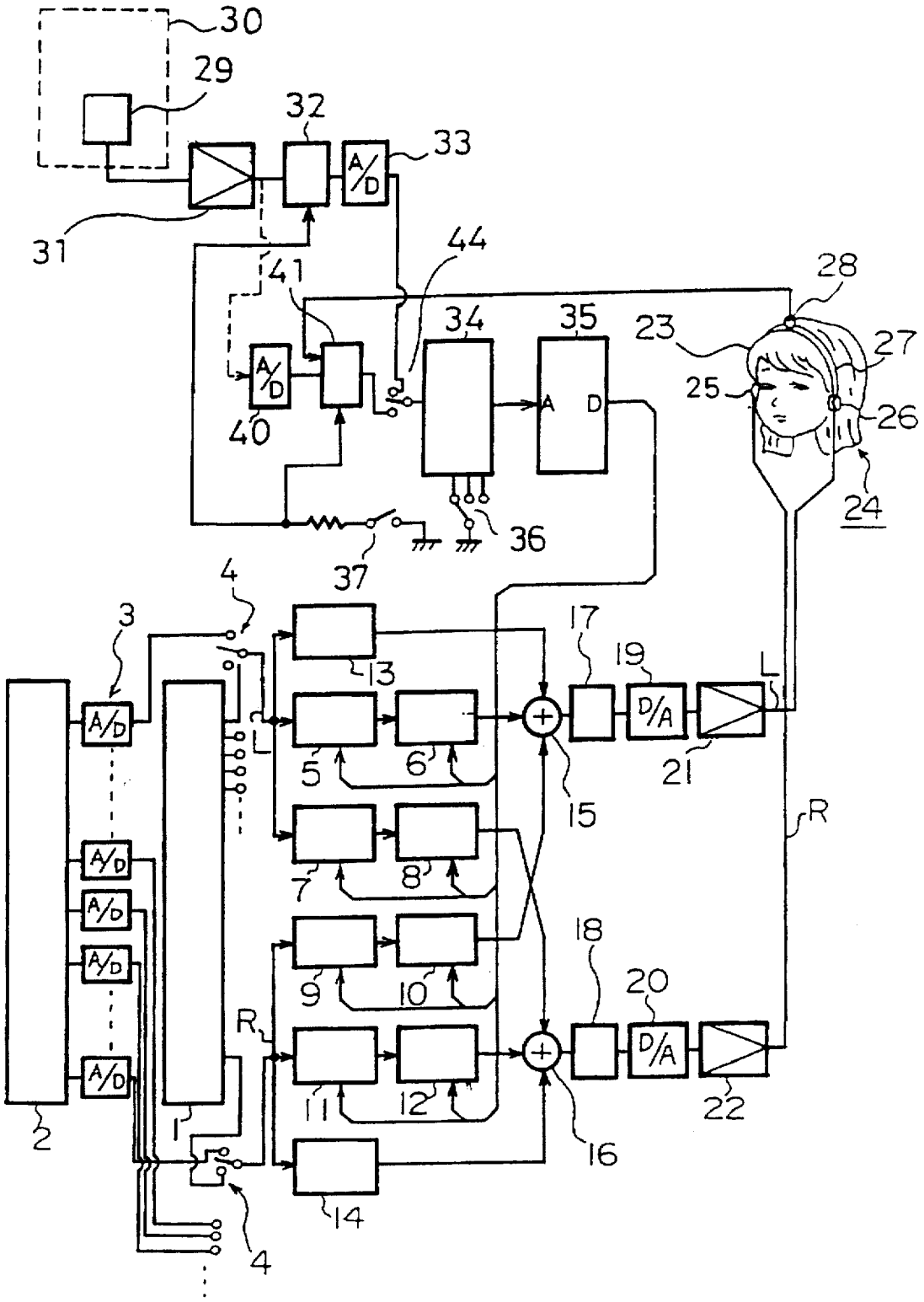
FIG. 1 is a block diagram showing an angle detection apparatus and an audio reproduction apparatus using it according to an embodiment of the present invention.

Specifically, the angle detection apparatus and the audio reproduction apparatus using it of the embodiment of the present invention are used in a system of reproducing, through headphones, multichannel audio signals obtained by picking up sound waves in a stereophonic mode or the like. Particularly, when digitized audio signals recorded in or transmitted to respective channels for localizing respective sound images in a predetermined positional relationship (e.g., at right, left and center positions in front of the listener and other positions) are produced by headphones or the like, it is possible to detect the gyration of the listener's head by the vibratory gyroscope provided at an, optimum attachment position in the headphones while the listener comfortably uses the headphones FIG. 1 shows an example of the angle detection apparatus and the audio reproduction apparatus using it according to the present invention. Reference numeral 1 depicts a multichannel digital stereophonic signal source, such as a digital audio disc (e.g., a compact disc), a digital satellite broadcasting or the like. Reference numeral 2 depicts an analog stereophonic signal source, such as an analog record, an analog broadcasting or the like. Reference numeral 3 depicts A/D converters which convert analog signals from the analog stereophonic source 2 into digital signals.

If the analog signals are multichannel analog signals, then the A/D converters 3 which are as much as the number of the channels of the analog signals are provided. Reference numeral 4 depicts switchers in which both signals inputted as digital signals and signals inputted as analog signals are processed as digital signals represented by a constant sampling frequency and a constant number of quantizing bits. While the switchers 4 for two channels are shown in FIG. 1, if the signals are multichannel signals, then the switchers 4 which are as much as the number of channels are provided.

A left digital signal L of the digital signal series is supplied to a convolution integrator 5. At this time, a set of digitally recorded impulse responses are read out to a memory 6 associated with the convolution integrator 5, the digitally recorded impulse responses being impulse responses from a virtual sound source position in the direction in which a listener 23 turns the head at present with respect to a reference direction of the head to the both ears of the listener and being represented by a constant sampling frequency and a constant number of quantizing bits. The digital signal series are subjected to convolution integral together with the impulse response read out from the memory 6 by the convolution integrator 5 in a real time fashion. A convolution integrator 7 and a memory 8 supply a crosstalk component of a right digital signal R.

Similarly to the left digital signal, the right digital signal R is supplied to a convolution integrator 11. At this time, a set of digitally recorded impulse responses are read out to a memory 12 associated with the convolution integrator 11, the digitally recorded impulse responses being impulse responses from the virtual sound source position in the direction in which the listener 23 turns the head at present with respect to the reference direction of the head to both the ears of the listener and being represented by the constant sampling frequency and the constant number of quantizing bits. The digital signal series are subjected to convolution integral together with the impulse response read out from the memory 12 by the convolution integrator 11 in a real time fashion. A convolution integrator 9 and a memory 10 supply a crosstalk component of a right digital signal L.

Similarly, the convolution integrator 7 and the memory 8 and the convolution integrator 11 and the memory 12 carry out the convolution integral with the impulse responses. As described above, the data signal series subjected by the convolution integrators 5, 7, 9 and 11 and the memories 6, 8, 10 and 12 to the convolution integral with the impulse responses are supplied to adders 15, 16, respectively. Two channel digital signals added by the adders 15, 16 are corrected by correcting circuits 17, 18 to remove therefrom characteristics inherent in sound sources and headphones which are used, and then converted by D/A converters 19, 20 into two-channel analog signals. The two-channel analog signals are amplified by power amplifiers 21, 22 and then supplied to headphones 24.

Figure 7:
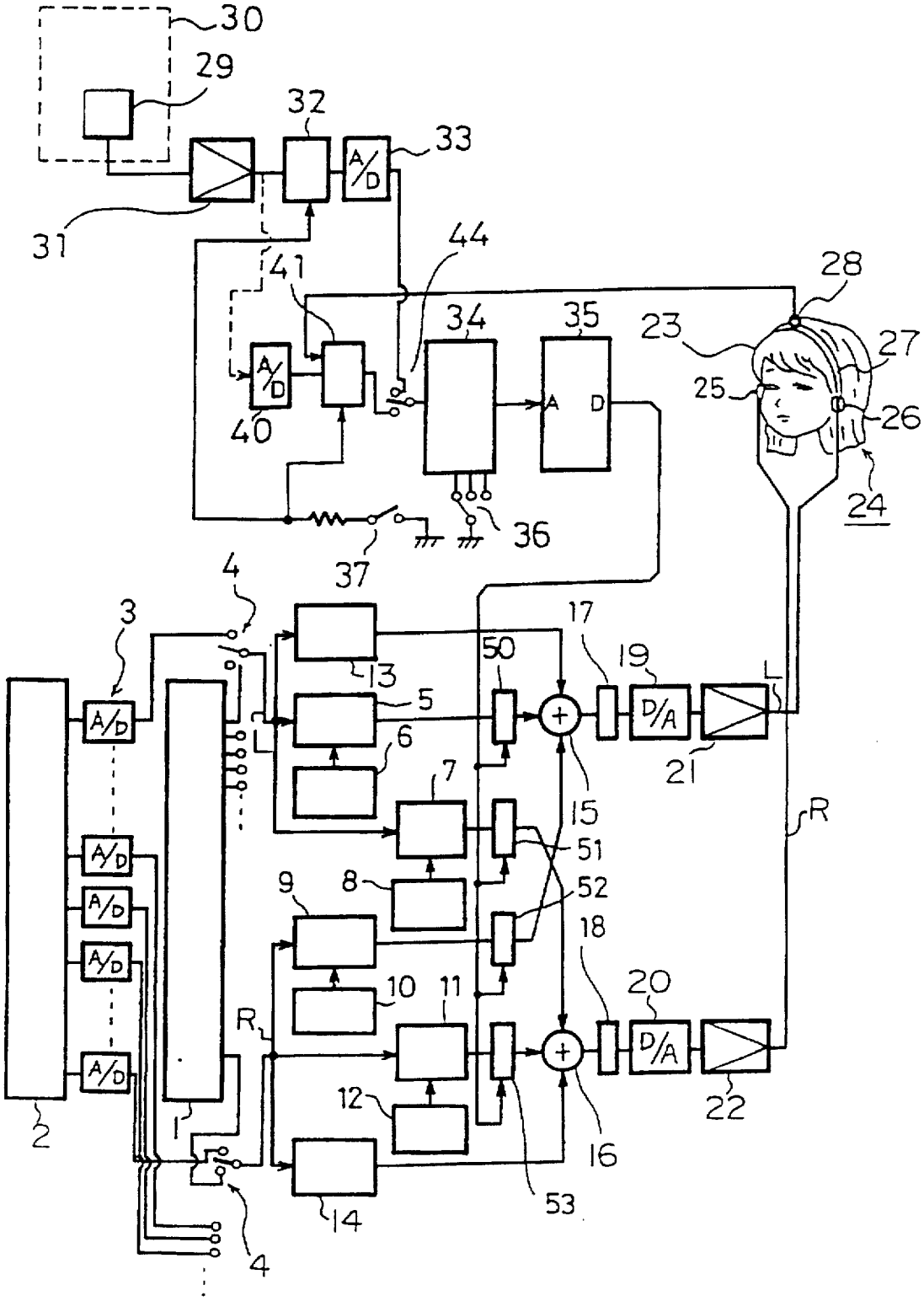
FIG. 7 is a block diagram showing an angle detection apparatus and an audio reproduction apparatus using it according to another embodiment of the present invention.

While the impulse responses are stored in a memory 35 in the above embodiment, an arrangement shown in FIG. 7 may be employed. Specifically, a pair of digitally recorded impulse responses from the virtual sound source positions with respect to a fixed head direction with respect to reference direction to the listener's both ears are stored in the memories 6, 8, 10 and 12 associated with the convolution integrators 5, 7, 9 and 11. The digital signal series are subjected to the convolution integral together with the impulse responses in a real-time fashion. The memory 35 stores a control signal representing a difference in time and level between sounds obtained at the both ears from the virtual sound source positions to the both ears with respect to the reference direction of the head.

A newly detected head movement with respect to the reference direction is converted into a digital address signal representing a magnitude including a direction at every constant unit angle or every predetermined angle. The control signal previously stored in the memory 35 is read out by using the digital address signal. The digital signals in the respective channels subjected to the convolution integral are corrected and changed in a real-time fashion in control apparatus 50, 51, 52 and 53 and results thereof are supplied to the adders 15, 16.

Figure 8:
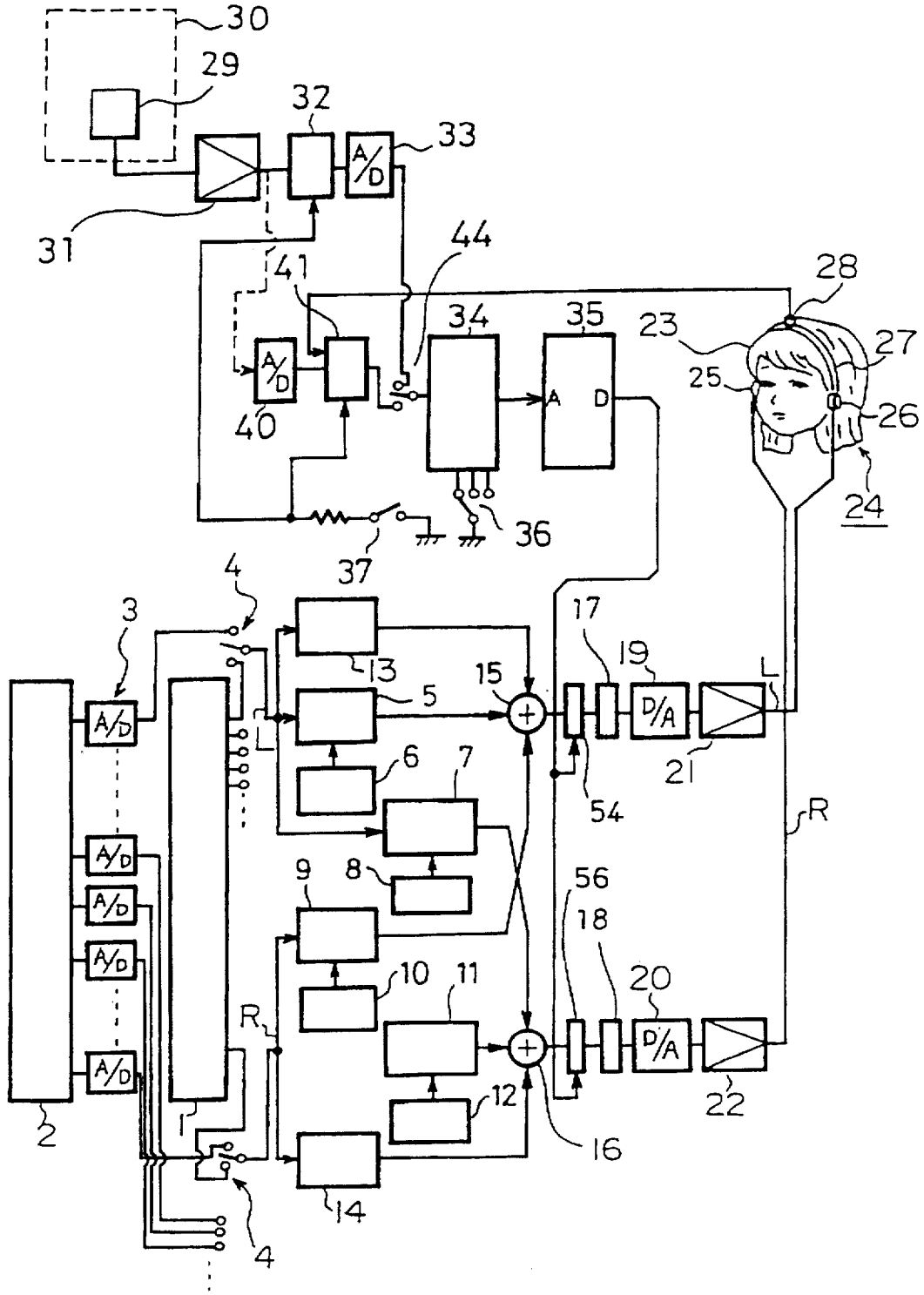
FIG. 8 is a block diagram showing an angle detection apparatus and an audio reproduction apparatus using it according to another embodiment of the present invention.

An arrangement shown in FIG. 8 may be employed. Specifically, the digital signal series subjected to the convolution integral together with the impulse responses in a real-time fashion are supplied to the address 15, 16. A newly detected head movement with respect to the reference direction is converted into a digital address signal representing a magnitude of the head movement including its direction at every constant unit angle or every predetermined angle. The control signal previously stored in the memory 35 is read out by using the digital address signal. The two-channel digital signals are corrected and changed by the control apparatus 54, 56 in a real-time fashion.

Each of the control apparatus 50, 51, 52, 53, 54 and 56 may be formed by combining a variable delay apparatus and a variable level controller or a level controller for controlling a level in every frequency band, such as a graphic equalizer having a number of divided bands or the like. Information stored in the memory 35 may be impulse response representing difference in time, level and so on between sounds obtained at the both ears from the virtual sound source positions to the both ears in the direction in which the listener 23 turns the head with respect to the reference direction of the head. In this case, each of the above-mentioned control apparatus may be formed of an IIR or FIR variable digital filter.

As described above, the digital signals are given spatial information by the control apparatus, corrected by the correcting circuits 17, 18 with respect to characteristics inherent in the sound sources and headphones which are used, changed in response to the head movement, and then converted by the D/A converters 19, 20 into the analog signals. The analog signals are amplified by the amplifiers 21, 22 and then supplied to the headphones 24.

In this case, the correcting circuits 17, 18 for correcting the characteristics inherent in the sound sources and headphones to be used may process signals in an analog or digital fashion. If the headphones is of wireless type, then the correcting circuits may be provided in a main body of the headphones. The correcting circuits may not necessarily be housed in the main body of the headphones, but may be provided in cords of the headphones, for example, or may be provided in connector units for connecting the apparatus main body and the headphones or a subsequent stage. Moreover, the correcting circuits may be provided in the control apparatus of the apparatus main body or a subsequent stage.

Figure 2:
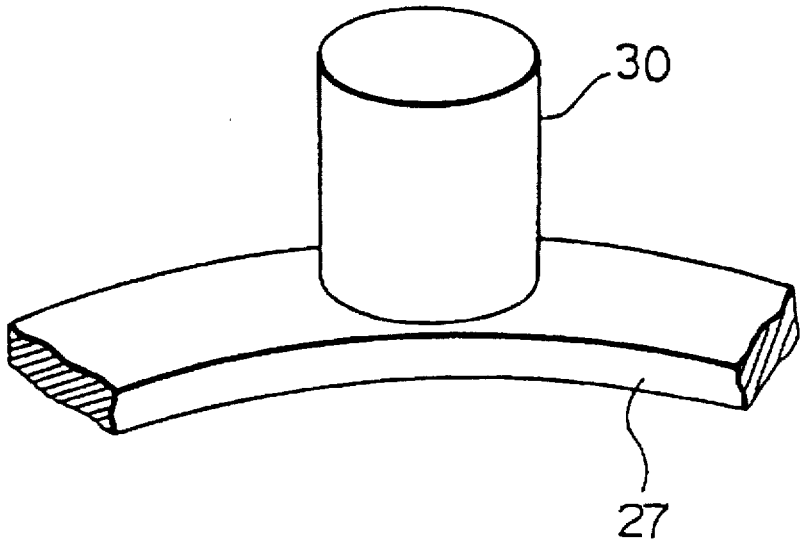
FIG. 2 is a diagram showing an arrangement of an analog output vibratory gyroscope of the angle detection apparatus and the audio reproduction apparatus using it according to the embodiment of the present invention.

An analog output vibratory gyroscope 30 detects a movement of the head of the listener 23. FIG. 2 shows an arrangement employing the analog output vibratory gyroscope 30 for outputting an analog signal proportional to an angular velocity of a rotary movement of the head. The analog output vibratory gyroscope 30 is attached to a head band 27 of the headphones 24. As shown in FIG. 2, in order to detect an angle at which the head is horizontally rotated around an axis which is the vertical direction, the analog output vibratory gyroscope 30 has therein vibrating pieces having various kinds of shapes disposed in the vertical direction. When an external rotation force is applied to the analog output vibratory gyroscope, the analog output vibratory gyroscope outputs a detection output proportional to the angular velocity as an analog signal by using a Coriolis force affecting the vibrating pieces which vibrate.

Figure 3:
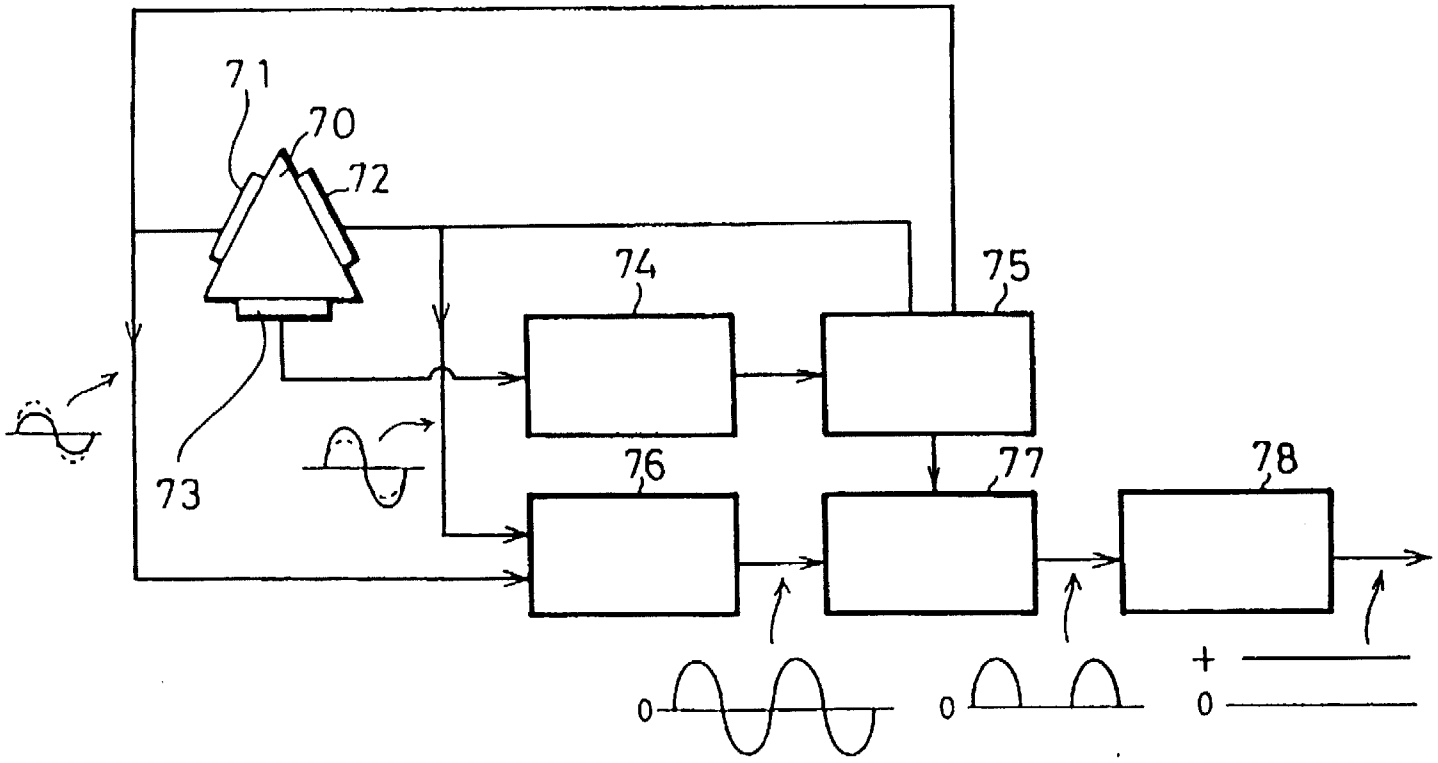
FIG. 3 is a block diagram showing the analog output vibratory gyroscope of the angle detection apparatus and the audio reproduction apparatus using it according to the embodiment of the present invention.

FIG. 3 is a block diagram showing an arrangement in which a piezoelectric body is used in a vibration drive unit and a vibration detection unit of the analog output vibratory gyroscope 30 to output an analog signal. A regular triangular prism vibrator 70 has a left piezoelectric ceramic piece 71, a right piezoelectric ceramic piece 72 and a feedback piezoelectric ceramic piece 73 provided at its respective side surfaces. The regular triangular prism vibrator 70 is positionally displaced by vibration. The left piezoelectric ceramic piece 71, the right piezoelectric ceramic piece 72 and the feedback piezoelectric ceramic piece 73 convert positional displacement into change of voltage. Outputs from the left piezoelectric ceramic piece 71 and the right piezoelectric ceramic piece 72 are subjected to differential amplification in a differential amplifier 76, subjected to synchronous detection in a synchronous detector circuit 77 and converted by a direct-current amplifier 78 into a DC output which is output therefrom. The outputs from the left piezoelectric ceramic piece 71 and the right piezoelectric ceramic piece 72 are phase corrected by a phase correcting circuit 75 and then supplied therefrom to the synchronous detector circuit 77. An output from the feedback piezoelectric ceramic piece 73 is supplied through an oscillator circuit 74 to the phase correcting circuit 75. In this case, the piezoelectric ceramic piece is used for excitation and detection.

In this case, by providing a change processing unit which can carry out signal processings, such as change of amplification degree, control on a band of a filter, linear correction or the like in accordance with an external command signal, the analog output vibratory gyroscope may be used as a bidirectional vibratory gyroscope to carry out an optimum operation in response to a use condition by changing conditions in the change processing unit.

As shown in FIGS. 1, 7 and 8, an analog output from the analog output vibratory gyroscope 30 which is proportional to the angular velocity of the head is amplified by an amplifier 31 and integrated by an analog integrator 32. The integrated analog signal is supplied to an A/D converter 33 which outputs the same as a digital signal. This digital signal is supplied to an address control circuit 34 and supplied to the memory 35 as the digital address signal representing the magnitude of the head movement including its direction at every constant unit angle or every predetermined angle with respect to the reference direction. In this case, the analog output from the analog output vibratory gyroscope 30 may be amplified by the amplifier 31 and then converted by an A/D converter 40 into a digital signal which is integrated by a digital integrator 41.

On the other hand, a digital output vibratory gyroscope 28 is formed by incorporating an A/D converter in such analog output vibratory gyroscope main body. In this case, a digital signal from the digital output vibratory gyroscope 28 is supplied to the digital integrator 41, then supplied to the address control circuit 34 and supplied therefrom to the memory 35 as the digital address signal representing the magnitude of the head movement including its direction at every constant angle or every predetermined angle with respect to the reference direction. A switcher 44 switcher the output signal from the analog output vibratory gyroscope 30 or the digital output vibratory gyroscope 28.

In FIG. 1, the impulse responses, which are previously digitally recorded in the memory 35, from the virtual sound source positions with respect to the reference direction of the head of the listener 23 to the both ears of the listener 23 are read from corresponding addresses of the table of the memory 35. The impulse responses are subjected together with digitized audio signals in respective channels to convolution integral by the convolution integrators 5, 7, 9 and 11 and the memories 6, 8, 10 and 12 associated respectively therewith. Thus, the digital signals are corrected in a real-time fashion with respect to the direction in which the listener 23 turns the head at present.

In FIG. 7, the control signals, which are previously digitally recorded in the memory 35, representing differences in time, level and so on between sounds obtained at the ears from the virtual sound source positions with respect to the reference direction of the head Of the listener 23 to the both ears of the listener 23 are read from corresponding addresses of the table of the memory 35. In response to the control signals, digitized audio signals in respective channels subjected to convolution integral together with the impulse responses by the convolution integrators 5, 7, 9 and 11 and the memories 6, 8, 10 and 12 associated respectively therewith are corrected by the control apparatus 50, 51, 52 and 53 in a real-time fashion with respect to the direction in which the listener 23 turns the head at present.

In FIG. 8, the control signals, which are previously digitally recorded in the memory 35, representing differences in time, level and so on between sounds obtained at the ears from the virtual sound source positions with respect to the reference direction of the head of the listener 23 to the both ears of the listener 23 are read from corresponding addresses of the table of the memory 35. Digitized audio signals in respective channels subjected to convolution integral together with the impulse responses by the convolution integrators 5, 7, 9 and 11 and the memories 6, 8, 10 and 12 associated respectively therewith are converted by the adders 15, 16 into the two-channel digital signals. In response to the control signals, the two-channel digital signals are corrected by the control apparatus 54, 56 in a real-time fashion with respect to the direction in which the listener 23 turns the head at present. Other arrangements and actions are Similar to those shown in FIG. 1.

Figure 5:
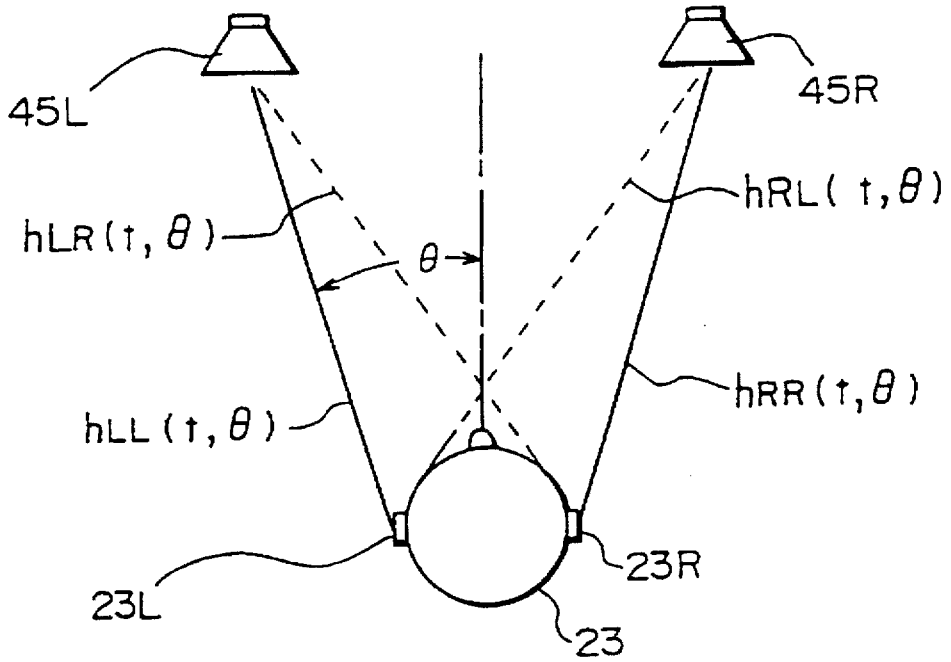
FIG. 5 is a diagram used to explain measurement of the impulse responses of the angle detection apparatus and the audio reproduction apparatus using it according to the embodiment of the present invention.

FIG. 4 shows a table data stored in the memory 35. Specifically, when front left and right loudspeakers 45L, 45R are positioned in front of the listener 23 as shown in FIG. 5, if the impulse responses from positions of the left and right loudspeakers 45L, 45R to the both ears of the listener 23 are represented by Equation 1

$$h_{LL}(t,\theta) = 1/2\pi \int_{-\infty}^{\infty} H_{LL}(\omega,\theta) \cdot \exp(j\omega t)d\omega$$

Equation 2

$$h_{LR}(t,\theta) = 1/2\pi \int_{-\infty}^{\infty} H_{LR}(\omega,\theta) \cdot \exp(j\omega t)d\omega$$

Equation 3

$$h_{RL}(t,\theta) = 1/2\pi \int_{-\infty}^{\infty} H_{RL}(\omega,\theta) \cdot \exp(j\omega t)d\omega$$

Equation 4

$$h_{RR}(t,\theta) = 1/2\pi \int_{-\infty}^{\infty} H_{RR}(\omega,\theta) \cdot \exp(j\omega t)d\omega,$$

then the impulse responses representing the above equations are digitally recorded in the memories 6, 8, 10 and 12.

In the above table, reference symbol $h_{mn}$ (t) depicts impulse response from a speaker position m to an ear n, reference symbol $H_{mn}(\omega)$ depicts transfer function from the speaker position m to the ear n, reference symbol $\omega$ depicts an angular frequency of $2\pi f$, and reference symbol f depicts a frequency.

FIG. 6 shows an example of control data of the control signals stored in the table in the memory 35. The control data are supplied to the control apparatus shown in FIGS. 7 and 8. Specifically, the difference in time between the sounds respectively obtained at the both ears, $\Delta T_{IJ}(\theta)$, and difference in level between the sounds respectively obtained at the both ears, $\Delta L_{IJ}(\theta)$, are recorded in the table of the control signals stored in the memory 35 (where IJ=LL, LR, RL, RR, . . . ). These control signals are supplied to the above-mentioned control apparatus 50 through 54 and 56.

Each of the control apparatus 50 through 54 and 56 may be formed by combining the variable delay apparatus and the variable level controller or the level controller for controlling the level in every frequency band, such as the graphic equalizer having a number of divided bands or the like. Information stored in the memory 35 may be impulse response representing difference in time, level and so on between sounds obtained at the both ears from the virtual sound source positions in the direction in which the listener 23 turns the head with respect to the reference direction of the head to both the ears. Contents stored in the memory 35 have data structure corresponding to the control apparatus 50 through 54 and 56. In this case, each of the above-mentioned control apparatus 50 through 54 and 56 may be formed of an IIR or FIR variable digital filter.

The loudspeakers may be used as the sound sources used for measuring the control signals representing the difference in time between the sounds obtained at the respective ears and the difference in level therebetween. Positions where sound waves are picked up in the respective ears of the listener 23 may be anywhere from the inlets of the external auditory canals thereof to the ear drums thereof.

However, the positions should be equal to positions used to calculate characteristics of correction for canceling the characteristics inherent in the headphones to be used.

On the assumption of the above-mentioned impulse responses, each of the digitally recorded impulse responses obtained when an angle $\theta$ is changed by a unit angle, e.g., 2° is written in an address of the table of the memory 35. The unit angle is set to be every angle through which the listener 23 can perceive with the left and right ears that he turns the head.

The memory 35 includes three sets of such tables, each of sets having different data value depending upon shapes of the head and the auricles of the listener 23, the characteristics of the headphones to be used and so on. One of the three sets of tables is selected by switching the switcher 36 of the address control circuit 34.

FIGS. 1, 7 and 8, reference numeral 37 depicts a center reset switch. When the center reset switch is turned on, values of the analog integrator 32 and the digital integrator 41 are reset to "all 0". At this time, an address $\theta$=0 is selected in the table of the memory 35. Specifically, when the center reset switch 37 is turned on, the direction in which the listener 23 turns the head at present is set to be the forward direction toward the sound sources.

The angle detection apparatus and the audio reproduction apparatus using it according to this embodiment are arranged as described above and operates as follows. Specifically, digital audio signals from the multichannel digital stereophonic signal source 1 or digital audio signals which are converted by the A/D converters 3 from analog signals input to the multichannel analog stereophonic signal source 2 are selected by the switcher 4. In case of the arrangement shown in FIG. 1, the digital signal series, together with the impulse responses read out from the memory 35, are subjected to convolution integral by the convolution integrators 5, 7, 9 and 11 and the memories 6, 8, 10 and 12 in a real-time fashion, and then supplied to the adders 15, 16.

In the arrangement shown in FIG. 7, the digitized audio signals in respective channels previously subjected to convolution integral with the impulse responses by the convolution integrators 5, 7, 9 and 11 and the memories 6, 8, 10 and 12 are corrected and changed by the control apparatus 50, 51, 52 and 53 based on the control signals read from the memory 35, and supplied to the adders 15, 16.

In the arrangement shown in FIG. 8, the two-channel digital signals from the adders 15, 16 are corrected and changed by the control apparatus 54, 56 based on the control signals read from the memory 35. The two-channel digital signals are converted by the D/A converters 19, 20 into the analog signals which are amplified by the power amplifiers 21, 22 and then supplied to the headphones 24.

Turning back to FIG. 1, the listener 23 wearing the headphones 24 can listen to sounds reproduced from the audio signals as described above. The movement of the head of the listener 23 with respect to the reference direction at every constant or predetermined angle is detected by the digital output vibratory gyroscope 28 and the analog output vibratory gyroscope 30 and converted by the address control circuit 34 into the digital address signal representing the magnitude of the movement including its direction.

The digitally recorded impulse responses or control signals from the virtual sound source positions with respect to the reference direction of the head to both the ears are read from the memory 35 in response to the digital address signal. The convolution integrators 5, 7, 9 and 11 and the memories 6, 8, 10 and 12 or the control apparatus 50, 51, 52, 53, 54 and 56 correct and change the audio signals with the impulse responses or the control signals in a real-time fashion.

The signals are converted by the convolution integrators 5, 7, 9 and 11, the memories 6, 8, 10 and 12 or the control apparatus 50, 51, 52, 53, 54 and 56 and the address 15, 16 into the two-channel digital signals which have spatial information representing the sound field and are supplied to both the ears. The two-channel digital signals are corrected by the correcting circuits 17, 18 with respect to the characteristics of the headphones and sound sources that are used. Then, the two-channel digital signals are amplified by the power amplifiers 21, 22 and supplied to the headphones 24. Thus, it is possible to achieve a reproduction effect in which the listener perceives as if he listened to reproduced sounds from the loudspeakers located in the virtual sound source positions.

Figure 9:
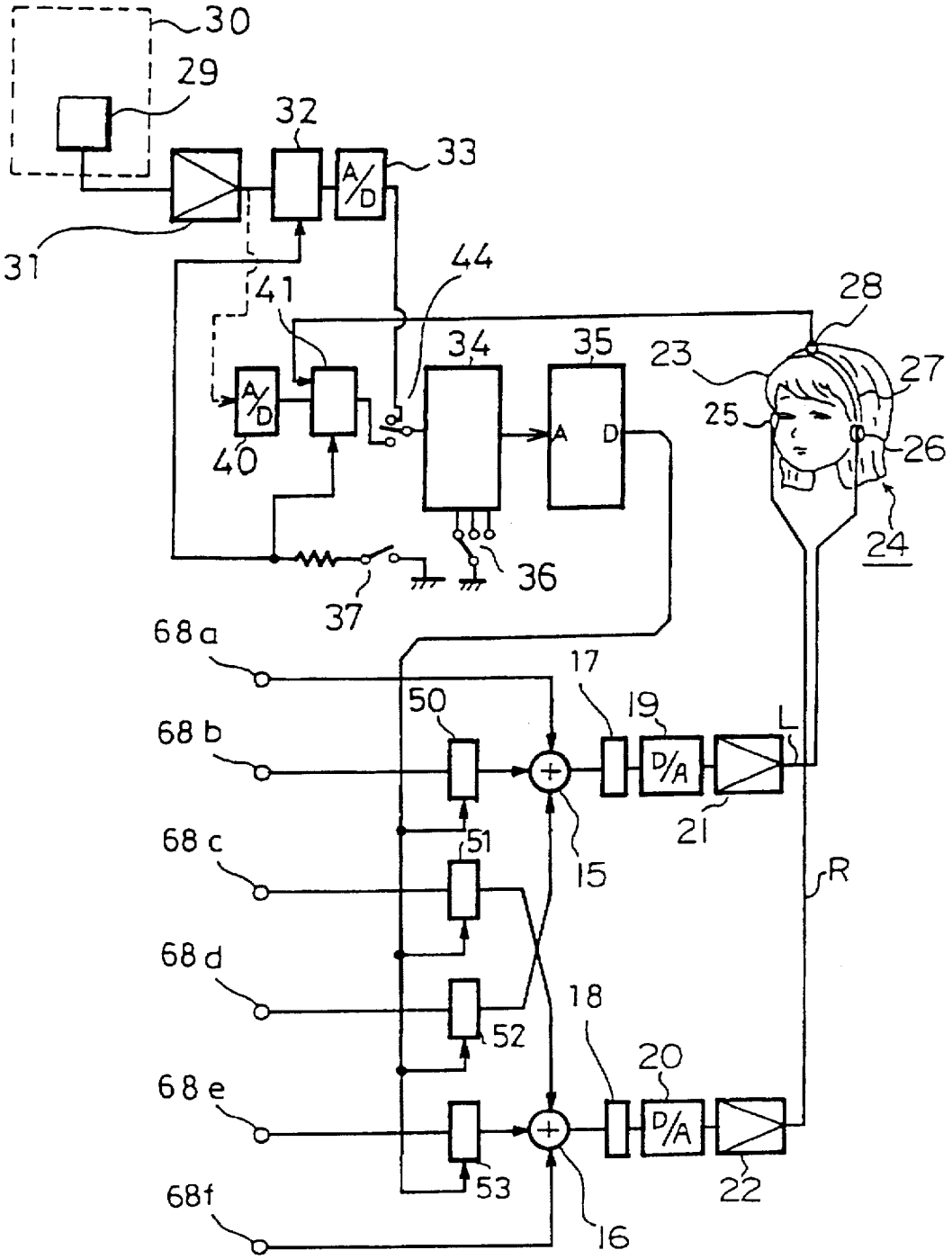
FIG. 9 is a block diagram showing an angle detection apparatus and an audio reproduction apparatus using it according to another embodiment of the present invention.
Figure 10:
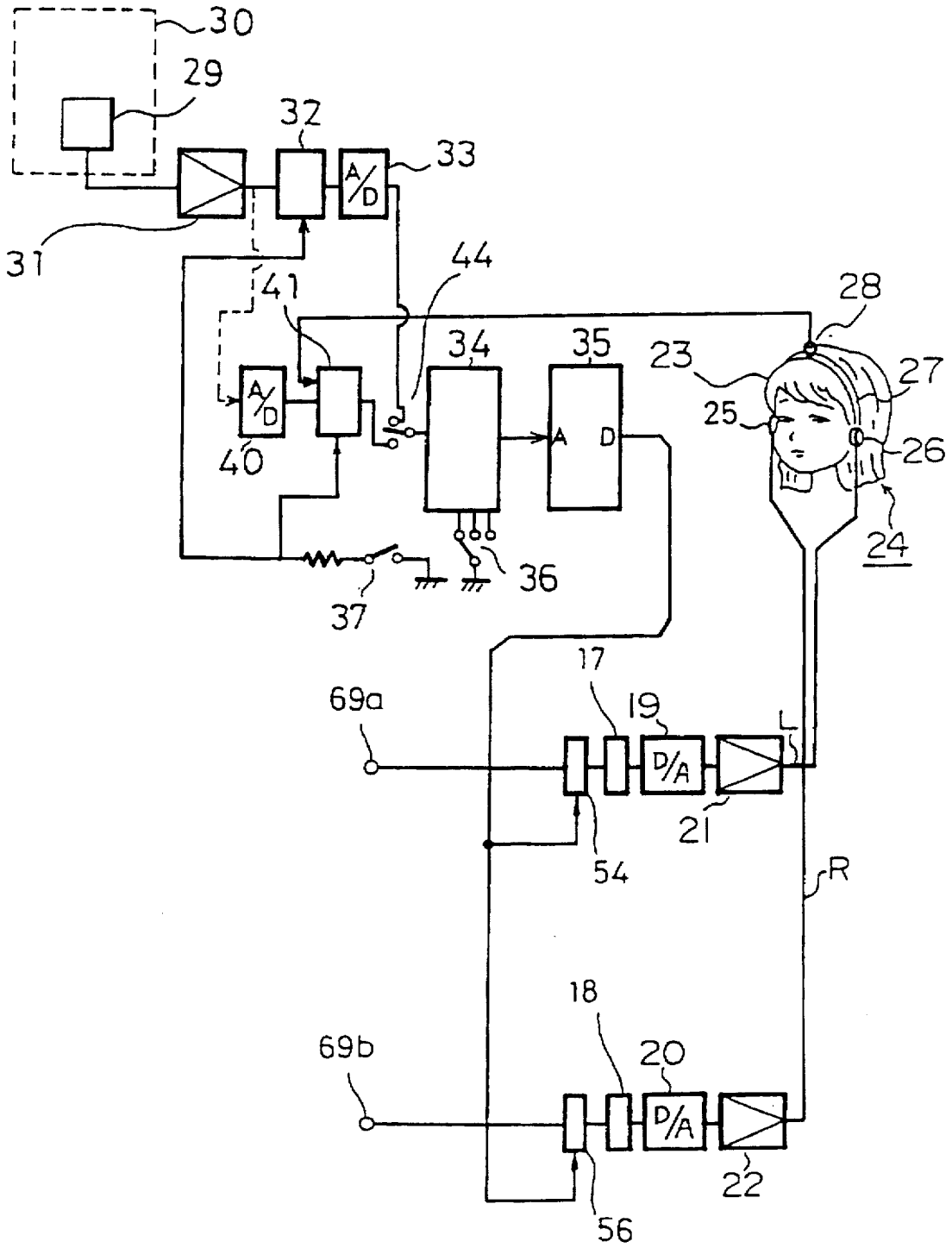
FIG. 10 is a block diagram showing an angle detection apparatus and an audio reproduction apparatus using it according to another embodiment of the present invention.

While FIGS. 1, 7 and 8 show only arrangements used when the single listener 23 listens to the reproduced sounds, arrangements shown in FIG. 9 or FIG. 10 may be employed when the plurality of listeners 23 listen to the reproduced sound. FIG. 9 corresponds to FIG. 7 and shows an arrangement in which stages succeeding the convolution integrators 5, 7, 9 and 11 are branched off by terminals 68*a* to 68*f*. FIG. 10 corresponds to FIG. 8 and shows an arrangement in which stages succeeding the address 15, 16 are branched off by terminals 69*a*, 69*b*.

In these cases, it is sufficient that the signals are processed in response to the gyration of the head of each listener after corrected and converted by the convolution integrators 5, 7, 9 and 11 and the memories 6, 8, 10 and 12 into the digital signals having the spatial information. Therefore, it is unnecessary to prepare the expensive A/D converters 3 and the convolution integrators 5, 7, 9 and 11 which are as many as the number of the listeners.

Thus, it is sufficient to prepare the headphones 24, the digital angle detectors 28, the signal processing circuits 31 to 35 for detecting angles and the control apparatus 50 to 53, 54 and 56 which are as many as the number of the listeners. It is possible to simultaneously supply the audio signal to a plurality of listeners with inexpensive costs.

In this case, when the listener 23 turns the head, the digital output vibratory gyroscope 28 or the analog output vibratory gyroscope 30 generates the digital signal or the analog signal in response to the direction of the movement of the head. Thus, the signal has a value in response to the direction of the head of the listener 23. The value is supplied through the address control circuit 34 as the address signal to the memory 35.

There are read from the memory 35 the digitally recorded impulse responses, corresponding to the direction of the head of the listener 23, from the virtual sound positions with respect to the reference direction of the head to both the ears among the data corresponding to those stored in the table shown in FIG. 4 or the control signals representing the difference in time between the sounds obtained at both the ears and the difference in level therebetween among the data shown in FIG. 6. The read data are supplied to the convolution integrators 5, 7, 9 and 11 and the memories 6, 8, 10 and 12 or the control apparatus 50, 51, 52, 53, 54 and 56.

When the analog output vibratory gyroscope 30 is used, the output therefrom is amplified by the amplifier 31, then integrated by the analog integrator 32, and converted by the A/D converter 33 into the digital signal in response to the direction of the head of the listener 23. The digital signal is supplied as the address signal through the address control circuit 34 to the memory 35. Similarly to the processings of the signal from the digital output vibratory gyroscope 28, there are read from the memory the digitally recorded impulse responses, corresponding to the direction of the head of the listener 23, from the virtual sound positions with respect to the reference direction of the head to both the ears among the data corresponding to those stored in the table or the control signals representing the difference in time between the sounds obtained at the ears and the difference in level therebetween among the data shown in FIG. 6. The read data are supplied to the convolution integrators 5, 7, 9 and 11 and the memories 6, 8, 10 and 12 or the control apparatus 50, 51, 52, 53, 54 and 56. Thus, when the vibratory gyroscope is used to detect the gyration of the head, it is possible that the apparatus becomes small and light, consumes low power and has long lifetime. Moreover, it is possible that the listener uses the apparatus comfortably and the apparatus is arranged inexpensively.

When there is used the bidirectional vibratory gyroscope which can carry out signal processings, such as change of the amplification degree, control on the band of the filter, the linear correction or the like, in response to the external command signal, it is possible for the bidirectional vibratory gyroscope to carry out the optimum operation depending upon the use conditions. Moreover, when a vibratory gyroscope incorporating an integration function is used, an arrangement of the apparatus becomes more simplified.

When the piezoelectric body is used in the drive unit and the vibration detection unit of the vibratory gyroscope, it is possible the apparatus further becomes small and light, consumes low power and has long lifetime. Moreover, it is possible that the listener uses the apparatus comfortably and the apparatus is arranged inexpensively.

The correcting circuits 17, 18 have one or both of the correction characteristics used to correct the characteristics inherent in the sound sources used in measurement of the impulse responses or the control signals and the correction characteristics used to correct the characteristics inherent in the headphones to be used. Accordingly, since the correcting circuits 17, 18 can carry out the digital signal processings including the above Correction at once, they can carry out the signal processing in a real-time fashion.

Since, as described above, the audio signals L, R to be supplied to the headphones 24 are corrected by using the digitally recorded impulse responses from the virtual sound source positions corresponding to the head direction of the listener 23 with respect to the reference direction of the head to both the ears or the control signals representing the difference in time between the sounds obtained at both the ears and the difference in level therebetween, it is possible to obtain the sound field which allows the listener to feel as if a plurality of loudspeakers were located at the virtual sound source positions and the audio signals were reproduced thereby.

The control signals which are digitally recorded in the table of the memory 35 and represent the difference in time between the sounds obtained at both the ears and the difference in level therebetween are read out therefrom. Since the data of the control signals are purely electronically supplied to the control apparatus in order that the control apparatus 50, 51, 52 and 53 correct the digital signals previously convoluted by the convolution integrators 5, 7, 9 and 11 and the memories 6, 8, 10 and 12, the characteristics of the audio signals can be changed without delay after the listener turns the head. Therefore, the listener 23 is prevented from feeling unnatural.

At this time, reverberation signals generated by reverberation circuits 13, 14 are supplied to the headphones 24 so that such a spacial impression as is obtained in a listening room and a concert hall is added. Therefore, it is possible for the listener to perceive an excellent stereophonic sound field.

While the apparatus is directly connected to the headphones 24 through signal lines in the above-mentioned arrangements, the signals may be transmitted thereto in a wireless fashion.

In each of the above-mentioned arrangements, since a plurality of tables are prepared in the memory 35 and the listener 23 can optionally select one of the tables by using the switcher 36, it is possible to obtain the optimum characteristics regardless of the different shapes of the heads and auricles of the listeners 23 or the characteristics of the headphones 24 to be used.

If change amounts of the digitally recorded control signals representing the difference in time between the sounds obtained at both the ears and the difference in level therebetween obtained when the angle 8 is changed are set to be larger or smaller than a standard value by setting a table, then amounts of positional changes of the sound images with respect to the head direction of the listener 23 are different from each other. Therefore, it is possible to change perception of distance from the listener 23 to the sound image.

Since the reverberation signals generated by the reverberation circuits 13, 14 are added to the reproduced sounds and the listener listens to the reproduced sounds added as if the sounds were sounds reflected by a wall of a hall or a reverberation sounds, it is possible to obtain the presence which allows the listener to feel as if he listened to the music in a famous concert hall.

Figure 11:
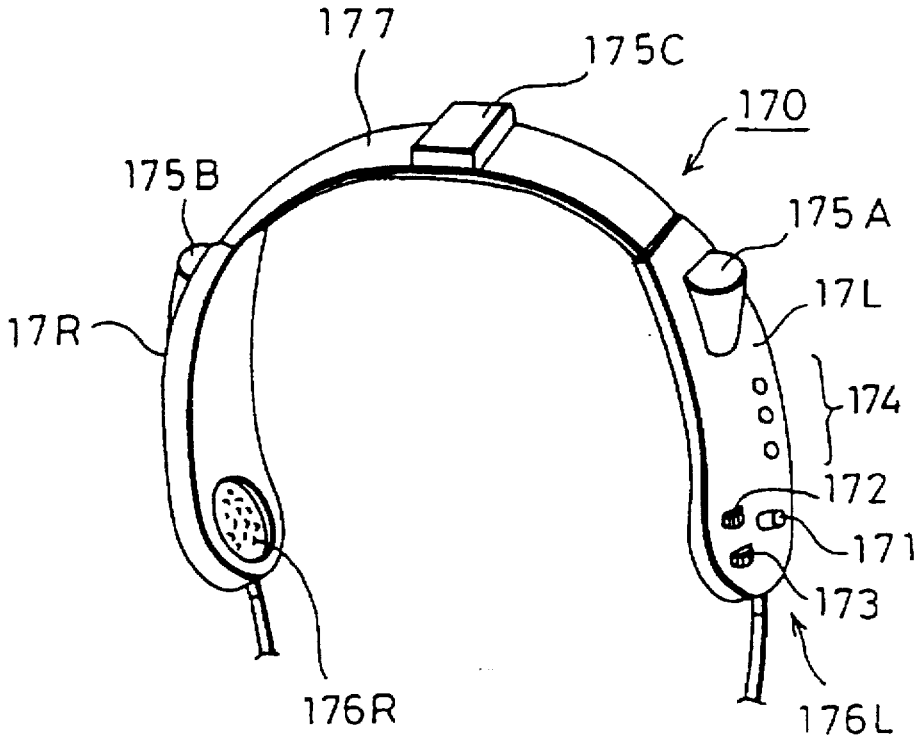
FIG. 11 is a diagram showing headphones of the angle detection apparatus and the audio reproduction apparatus using it according to the embodiment of the present invention.

FIGS. 11 to 14 show headphones of the angle detection apparatus and the audio reproduction apparatus using it according to the embodiment of the present invention, particularly showing specific attachment positions set when the vibratory gyroscope is mounted on the headphones. As shown in FIG. 11, the vibratory gyroscope is attached to an attachment position 175C positioned on an outer side of a head band 177 of headphones 170, to an attachment position 175A positioned on an outer side of a left arm 17L or to an attachment position 175B positioned on an outer side of a right arm 17R. In this arrangement, each of the attachment positions is positioned at the head band 177 provided for mounting the headphones on the head, the left arm 17L or the right arm 17R in a main body of the headphones 170. In this case, the left arm 17L has a reset switch 171, a sound volume adjustment dial 172, a balance adjustment dial 173, selection buttons 174 for a sound field, reverberation and a sound source provided on its outer side.

Figure 12A:
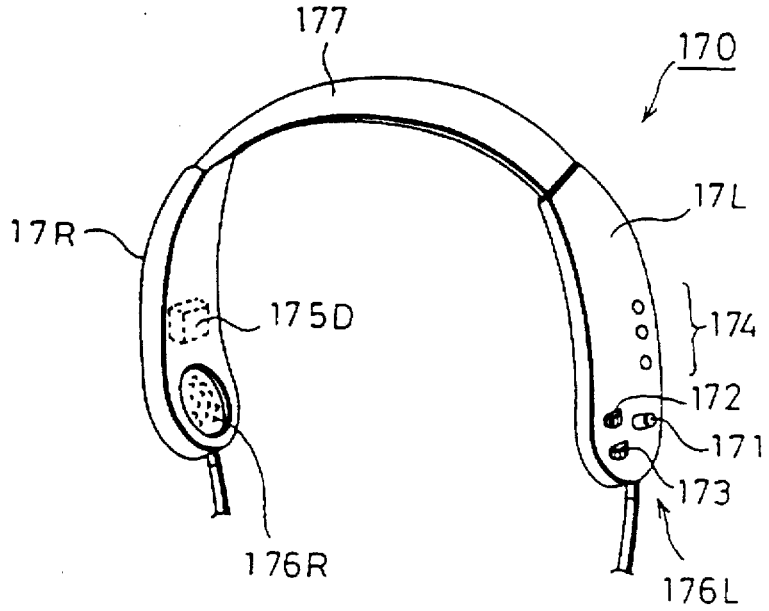
FIG. 12 is a diagram showing headphones of the angle detection apparatus and the audio reproduction apparatus using it according to another embodiment of the present invention, FIG. 12A showing an arrangement with the vibratory gyroscope provided in an arm, and FIG. 12B showing an arrangement with the vibratory gyroscope provided in a sound generator.
Figure 12B:
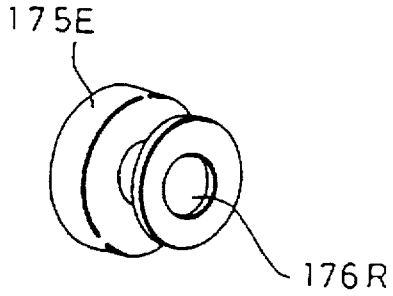

In an arrangement shown in FIG. 12, the vibratory gyroscope is attached to an attachment position 175D positioned on an inner side of the right arm 17R of the headphones 170 or to an attachment position 175E positioned on an inner side of a right sound generator 176R. In this case, the left arm 17L similarly has the reset switch 171, the sound volume adjustment dial 172, the balance adjustment dial. 173, the selection buttons 174 for the sound field, the reverberation and the sound source provided on its outer side. The vibratory gyroscope may be provided on an inner side of the left arm 17L with the right arm 17R having the reset switch 171, the sound volume adjustment dial 172, the balance adjustment dial 173, the selection buttons 174 for the sound field, the reverberation and the sound source provided on its outer side.

Figure 13A:
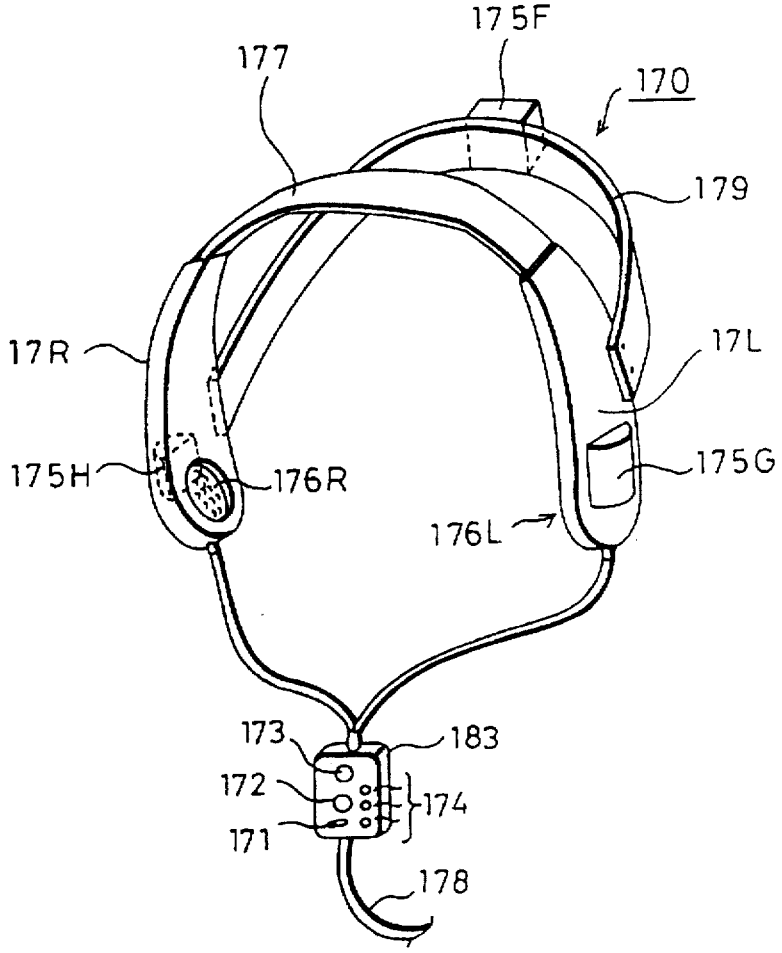
FIG. 13 is a diagram showing headphones of the angle detection apparatus and the audio reproduction apparatus using it according to another embodiment of the present invention, FIG. 13A showing an arrangement with the vibratory gyroscope provided in a sub head band attached to the headphones, and FIG. 13B showing an arrangement with the vibratory gyroscope provided in a sub head band detached from the headphones.

In an arrangement shown in FIG. 13A, the vibratory gyroscope is attached to an attachment position 175F positioned on an outer side of a sub head band 179 which is formed independently of the head band 177 of the main body of the headphones 170 and has both ends respectively fitted to the left arm 17L and the right arm 17R, or to either of attachment positions 175G and 175H respectively positioned on outer sides of the left arm 17L and the right arm 17R.

Figure 13B:
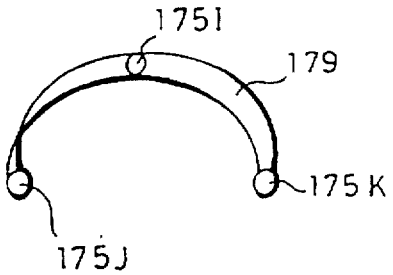

In an arrangement shown in FIG. 13B, the sub head band 179 is detached from the left arm 17L and the right arm 17R and independently mounted on the head of the listener 23. In the above arrangement, the vibratory gyroscope is attached to an attachment position 175I positioned on an outer side of a center portion of the sub head band 179, to an attachment position 175J positioned at a right end position on the outer side of the sub head band 179, and to an attachment position 175K positioned at a left end position on the outer side of the sub head band 179. In the arrangements shown in FIG. 13A and FIG. 13B, a switch box 183 for the reset switch 171, the sound volume adjustment dial 172, the balance adjustment dial 133, the selection buttons 174 for the sound field, the reverberation and the sound source is provided at a cable 178.

Figure 14A:
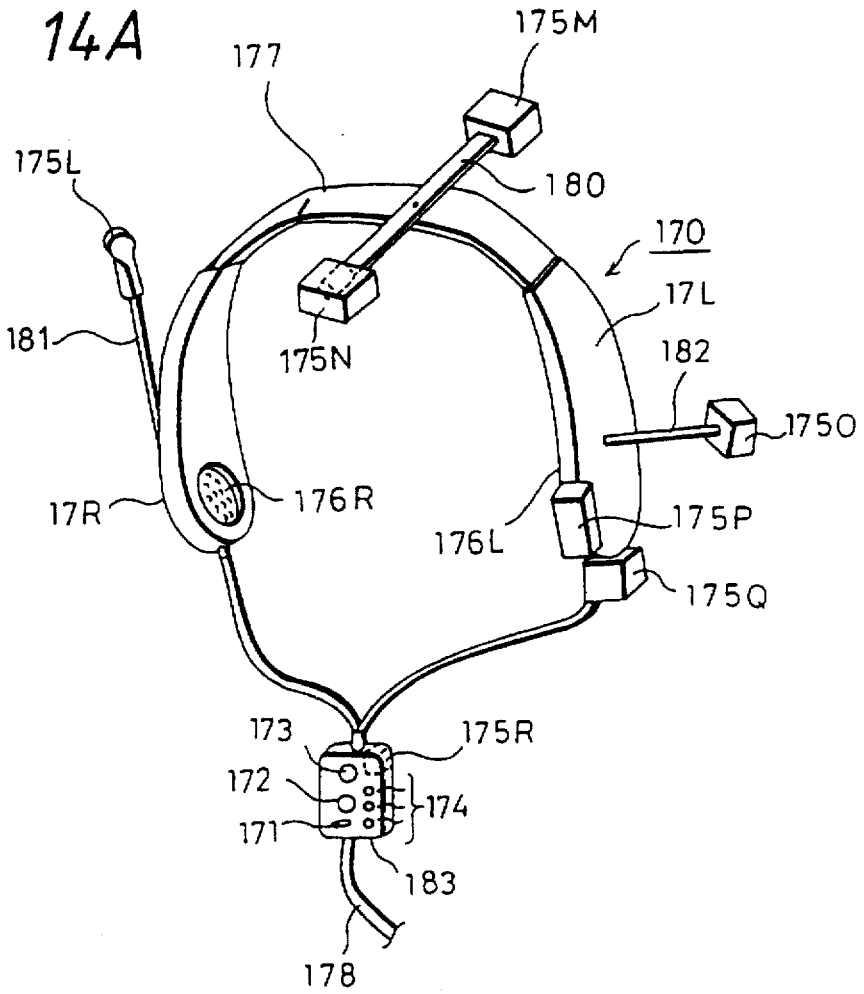
FIG. 14 is a diagram showing headphones of the angle detection apparatus and the audio reproduction apparatus using it according to another embodiment of the present invention, FIG. 14A showing an arrangement with the vibratory gyroscope outwardly projectingly provided in the headphones, FIG. 14B showing an arrangement with the vibratory gyroscope provided in an antenna attached to a head band of wireless headphones, and FIG. 14C showing an arrangement with the vibratory gyroscope provided in an antenna attached to a housing of a sound generator of wireless headphones.

In an arrangement shown in FIG. 14A, the vibratory gyroscope is respectively attached to attachment positions 175M and 175N positioned at both end portions of a bar 180 which is formed independently of the head band 177 of the main body of the headphones 170 so as to cross the head band 177. In this arrangement, the vibratory gyroscope is attached to an attachment position 175L positioned at a tip end portion of a bar 181 projected outward from the left or right arm 17L or 17R, to an attachment position 175O positioned at a tip end portion of a bar 182, to an attachment position 175P positioned at a projected portion on the outer side of the left or right arm 17L or 17R, to an attachment position 175Q positioned at the cable 178, and to an attachment position 175R positioned inside the switch box 183 provided at the middle of the cable 178 for the reset switch 171, the sound volume adjustment dial 172, the balance adjustment dial 173, the selection buttons 174 for the sound field, the reverberation and the sound source.

Figure 14B:
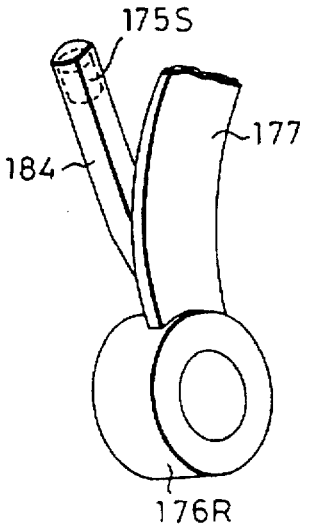

In an arrangement shown in FIG. 14B, an antenna 184 is used to transmit or receive an electromagnetic wave, infrared rays or the like when wireless headphones are used. The vibratory gyroscope is attached to an attachment position 175S positioned inside the antenna 184 which is formed independently of the head band 177 of the main body of the headphones 170 and projected outward from the head band 177.

Figure 14C:
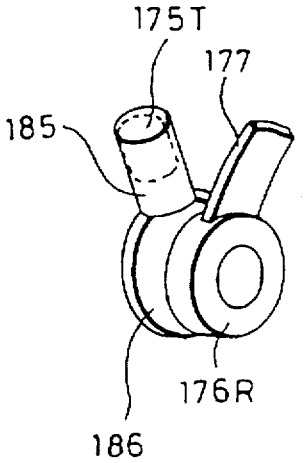

In an arrangement shown in FIG. 14C, an antenna 185 is used to transmit or receive an electromagnetic wave, infrared rays or the like when the wireless headphones are used. The vibratory gyroscope is attached to an attachment position 175T positioned inside the antenna 185 which is formed independently of a housing 186 of the main body of the headphones 170 and projected outward from the housing 186. When the wireless headphones shown in FIGS. 14B and 14C are used, it is needless to say that the bidirectional vibratory gyroscope is used.

Data shown in FIG. 4 can be obtained as follows. Specifically, impulse sound sources and dummy-head microphones of necessary channel number are disposed at predetermined positions in a suitable room such that a preferable reproduced sound field should be obtained when the sound is reproduced by the headphones 24. In this case, the loudspeakers may be used as sound sources used to measure the impulses.

Positions where sound waves are picked up in each of ears of the dummy head may be anywhere from the inlets of the external auditory canal thereof to the eardrum thereof. However, the positions should be equal to positions used to obtain the correction characteristics for canceling the characteristics inherent in the headphones to be used.

The control signals can be measured by radiating impulse sounds from the loudspeakers in the respective channels and picking up the radiated impulse sounds with microphones provided in the ears of the dummy head at every constant angle $\Delta\theta$. Accordingly, since one set of impulse responses is obtained per channel at a certain angle $\theta 1$, if the signal sources has five channels, then five sets of control signals, i.e., ten control signals can be obtained per angle. Accordingly, the control signals representing the difference in time between the sounds obtained at the left and right ears and the difference in level therebetween are obtained from the impulse responses.

The correction characteristics for canceling the characteristics inherent in the headphones which are used are calculated in such a manner that the same dummy-head microphones as those used to obtain impulse responses of a sound field are used, headphones to be used are mounted on the dummy head, and impulse responses having inverted characteristics of impulse responses between the microphones in the respective ears of the dummy head are calculated from inputs from the headphones.

Alternatively, the correction characteristics may be directly calculated by using adaptive processings such as an LMS algorithm or the like. Specific correction of characteristics inherent in the headphones can be realized by either subjecting the digital audio signals to the convolution integral with the impulse responses representing the calculated correction characteristics in view of a processing in a time domain or filtering the analog signal obtained by the D/A conversion by an analog filter having inverted characteristics in view of an analog signal processing at any time from a time when the audio signals are input to a time when the audio signals are supplied to the headphones.

While only the direction of the head of the listener 23 in a horizontal plane is described in the above-mentioned arrangements, the directions thereof in a vertical plane and planes perpendicular to both the vertical and horizontal planes can be processed similarly.

Even if one set of the tables in the memory 35 is prepared and designation of the addresses in the table is changed by the address control circuit 34, the control data can be obtained similarly to a case where the memory has plural sets of tables.

The data stored in the table may be limited to a range of a general direction of the head of the listener 23. The angle $\theta$ may be changed at different intervals depending upon the direction of the head such that the angle $\theta$ is set to be changed at an interval of 0.5° in the vicinity of $\theta=0°$ and to be changed at an interval of 3° in the range of $|\theta \geqq 45°|$. As described above, the angle may be set to be the angle through which the listener can perceive that he turns the head. Moreover, loudspeakers disposed near the respective ears of the listener 23 may be substituted for the headphones 24.

In each of the above-mentioned arrangements, the input audio signals may be digitally recorded signals or signals recorded in an analog fashion both of which are picked up in a multichannel stereophonic mode or the like. The angle detection means for detecting the movement of the head of the listener 23 may output a digital signal or an analog signal.

When the characteristics of audio signals supplied to the headphones 24 are changed in synchronism with the movement of the head of the listener 23, the characteristics are changed not continuously in response to the movement of the head of the listener 23 but by reading data from the tables of the memory 35 at either of every constant unit angle and every predetermined angle which are necessary and sufficient for human beings to recognize in accordance with human auditory characteristics. Therefore, the same effect as that achieved when the characteristics of the audio signals are continuously changed can be achieved only by calculation with resect to necessary and sufficient changes in the movement of the head of the listener 23. Accordingly, the storage capacity of the memory 35 can be saved and high-speed calculations more than required becomes unnecessary in view of a processing speed of calculations.

Since binaural characteristics from fixed sound sources in the fixed-direction are constantly obtained regardless of the gyration of the head of the listener 23, the listener obtains a highly natural localization.

Since the digital signals previously subjected to the convolution integral with the impulse responses by the convolution integrators 5, 7, 9 and 11 and the memories 6, 8, 10 and 12 are controlled by purely electronic correction using the characteristics represented by the digitally recorded control signals representing the difference in time between the sounds obtained at the respective ears and the difference in level therebetween, the characteristics are prevented from being largely deteriorated. Since the characteristics of the audio signals are changed without delay after the listener turns the head, the listener is prevented from feeling such unnaturalness as he feels when using a conventional system.

Since a plurality of tables are prepared in the memory 35 and the listener 23 can optionally select one of them by using the switcher 36, it is possible to obtain the optimum characteristics regardless of the different shapes of the heads and auricles of the listeners 23, the different characteristics of the headphones 24 and so on.

Since the change amounts of the control signals representing the difference in time between the sounds obtained at the respective ears and the difference in level therebetween obtained when the angle $\theta$ is changed are set to be larger or smaller than the standard value depending upon the tables, then amounts of positional changes of the sound images with respect to the head direction of the listener 23 are different from each other. Therefore, it is possible to change perception of distance from the listener 23 to the sound image.

Since the suitable reverberation signals generated by the reverberation circuits 13, 14 are added to the reproduced sounds if necessary, it is possible to obtain the presence which allows the listener to feel as if he listened to the music in a famous concert hall.

According to the embodiment, since the signals are corrected in response to the respective gyrations of the head of a plurality of listeners 23 by using the control signals representing the difference in time between the sounds obtained at the respective ears and the difference in level therebetween, the signals can be reproduced by a plurality of headphones 24 simultaneously and it is unnecessary to prepare the expensive A/D converters 3 and the convolution integrators 5, 7, 9 and 11 which are as many as the number of the listeners 23. Therefore, the apparatus can be arranged with considerably inexpensive costs.

According to the embodiment, since the vibratory gyroscope suitable for detection of the gyration of the head is used, it is possible for a head gyration detection unit to be small and light, to have low consumed power and long lifetime, and further to be easy to handle and inexpensive.

Moreover, since the vibratory gyroscope does not utilize an inertial force but is operated by a Coriolis force, it is unnecessary to dispose the vibratory gyroscope in the vicinity of a center of the gyration of the head of the listener 23 and hence the vibratory gyroscope may be attached to any portion of the gyration detection unit. Therefore, it is possible to simplify its arrangement and fabrication.

According to the embodiment, since the vibratory gyroscope suitable for detection of the gyration of the head is used, the vibratory gyroscope utilizes not an acceleration but the Coriolis force when the gyration is detected. Therefore, it is unnecessary to attach the vibratory gyroscope to the gyration center of the head and hence it is possible to attach the vibratory gyroscope to a head attachment body of the audio reproduction means. Moreover, it is possible to correct, in a real-time fashion, the audio signals in response to the head gyration of the listener based on the analog signal proportional to the angular velocity supplied from the vibratory gyroscope which is small and light, has low consumed power and long lifetime, and is easy to handle and inexpensive.

According to the embodiment, since the vibratory gyroscope suitable for detection of the gyration of the head is used, the vibratory gyroscope utilizes not the acceleration but the Coriolis force when the gyration is detected. Therefore, it is unnecessary to attach the vibratory gyroscope to the gyration center of the head and hence it is possible to attach the vibratory gyroscope to other portions than the head attachment body of the audio reproduction means. Moreover, it is possible to correct, in a real-time fashion, the audio signals in response to the head gyration of the listener based on the analog signal proportional to the angular velocity supplied from the vibratory gyroscope which is small and light, has low consumed power and long lifetime, and is easy to handle and inexpensive.

According to the embodiment, since the vibratory gyroscope suitable for detection of the gyration of the head is used, the vibratory gyroscope utilizes not the acceleration but the Coriolis force when the gyration is detected. Therefore, it is unnecessary to attach the vibratory gyroscope to the gyration center of the head and hence it is possible to attach the vibratory gyroscope to a portion in the vicinity of the sound generators of the audio reproduction means. Moreover, it is possible to correct, in a real-time fashion, the audio signals in response to the head gyration of the listener based on the analog signal proportional to the angular velocity supplied from the vibratory gyroscope which is small and light, has low consumed power and long lifetime, and is easy to handle and inexpensive.

According to the embodiment, since the vibratory gyroscope suitable for detection of the gyration of the head is used, the vibratory gyroscope utilizes not the acceleration but the Coriolis force when the gyration is detected. Therefore, it is unnecessary to attach the vibratory gyroscope to the gyration center of the head and hence it is possible to attach the vibratory gyroscope to the cable of the audio reproduction means. Moreover, it is possible to correct, in a real-time fashion, the audio signals in response to the head gyration of the listener based on the analog signal proportional to the angular velocity supplied from the vibratory gyroscope which is small and light, has low consumed power and long lifetime, and is easy to handle and inexpensive.

According to the embodiment, since the vibratory gyroscope suitable for detection of the gyration of the head is used, the vibratory gyroscope utilizes not the acceleration but the Coriolis force when the gyration is detected. Therefore, it is unnecessary to attach the vibratory gyroscope to the gyration center of the head and hence it is possible to attach the vibratory gyroscope to an optional portion of the audio reproduction means. Moreover, it is possible to correct, in a real-time fashion, the audio signals in response to the head gyration of the listener based on the analog signal proportional to the angular velocity supplied from the vibratory gyroscope which is small and light, has low consumed power and long lifetime, and is easy to handle and inexpensive.

According to the embodiment, since the vibratory gyroscope which is suitable for detection of the gyration of the head and has the vibration drive portion and the vibration detection portion both formed of the piezoelectric body is used, the vibratory gyroscope utilizes not the acceleration but the Coriolis force when the gyration is detected. Therefore, it is unnecessary to attach the vibratory gyroscope to the gyration center of the head and hence it is possible to attach the vibratory gyroscope to the audio reproduction means. Moreover, it is possible to correct, in a real-time fashion, the audio signals in response to the head gyration of the listener based on the analog signal proportional to the angular velocity supplied from the vibratory gyroscope which is small and light, has low consumed power and long lifetime, and is easy to handle and inexpensive.

According to the embodiment, since the vibratory gyroscope suitable for detection of the gyration of the head is used, the vibratory gyroscope utilizes not the acceleration but the Coriolis force when the gyration is detected. Therefore, it is unnecessary to attach the vibratory gyroscope to the gyration center of the head and hence it is possible to attach the vibratory gyroscope to the portion projected toward the outside of the head from the main body portion of the audio reproduction means. Moreover, it is possible to correct, in a real-time fashion, the audio signals in response to the head gyration of the listener based on the analog signal proportional to the angular velocity supplied from the vibratory gyroscope which is small and light, has low consumed power and long lifetime, and is easy to handle and inexpensive.

According to the embodiment, since the vibratory gyroscope suitable for detection of the gyration of the head is used, the vibratory gyroscope utilizes not the acceleration but the Coriolis force when the gyration is detected. Therefore, it is unnecessary to attach the vibratory gyroscope to the gyration center of the head and hence it is possible to attach the vibratory gyroscope to the head attachment body formed independently of the main body portion of the audio reproduction means. Moreover, it is possible to correct, in a real-time fashion, the audio signals in response to the head gyration of the listener based on the analog signal proportional to the angular velocity detected by the vibratory gyroscope which is small and light, has low consumed power and long lifetime, and is easy to handle and inexpensive.

Figure 15:
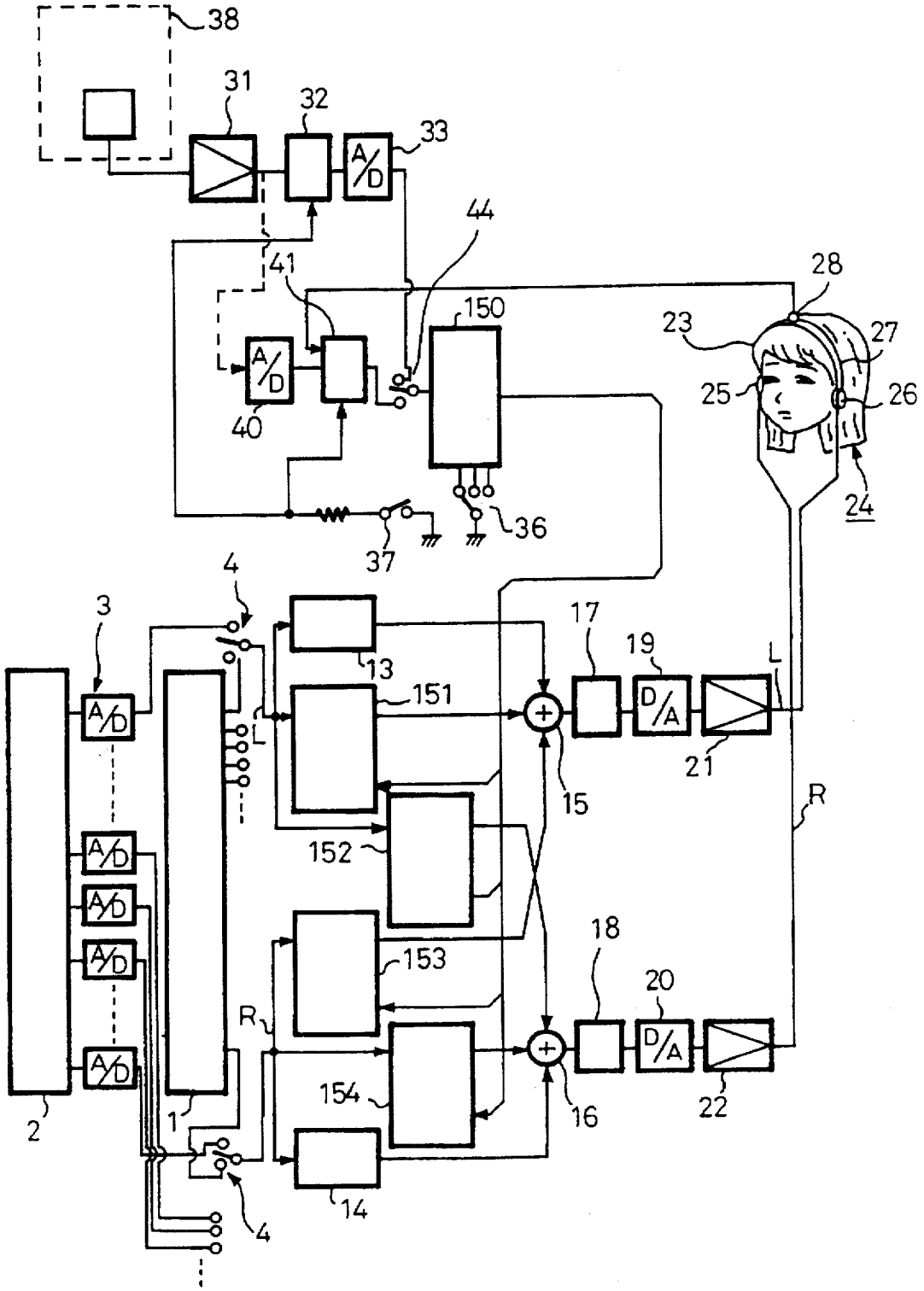
FIG. 15 is a block diagram showing an arrangement of the angle detection apparatus and the audio reproduction apparatus using it according to another embodiment of the present invention, the arrangement being used to calculate transfer characteristics without a memory being provided.

FIG. 15 is a block diagram showing an angle detection apparatus and an audio reproduction apparatus using it according to another embodiment of the present invention. In the embodiment, transfer characteristics are calculated without the memory being provided. According to the angle detection apparatus and the audio reproduction apparatus using it according to the embodiment, when the audio signals are reproduced through the headphones, the same localization, sound field and so on as those obtained when the sounds are reproduced by the loudspeakers located in a predetermined relationship upon reproduction using the loudspeakers are obtained even by reproduction with the headphones. Particularly, the transfer characteristics based on detection signals representing the gyration of the head of the listener are not stored in a memory but are directly calculated in a real-time fashion and added to the reproduced audio signals.

In an arrangement shown in FIG. 15, a transfer-characteristic calculating unit 150 calculates the transfer characteristics including frequency region data based on the detection signal representing the gyration of the head of the listener and supply the calculated transfer characteristics to transfer-characteristic control units 151, 152, 153 and 154. The transfer-characteristic control units 151, 152, 153 and 154 add the transfer characteristics to the reproduced audio signals, thereby correcting the audio signals in a real-time fashion. In this arrangement, the transfer characteristics are referred to as impulse responses and transfer functions, for example.

According to the above embodiment, the reproduced audio signals are corrected in response to the transfer characteristics which are directly calculated based on discrete positions and angles of the listener without being stored in the memory. Therefore, it is possible to correct the signals in a more real-time fashion by detecting the fine gyration of the head of the listener staying at an arbitrary position.

Figure 16:
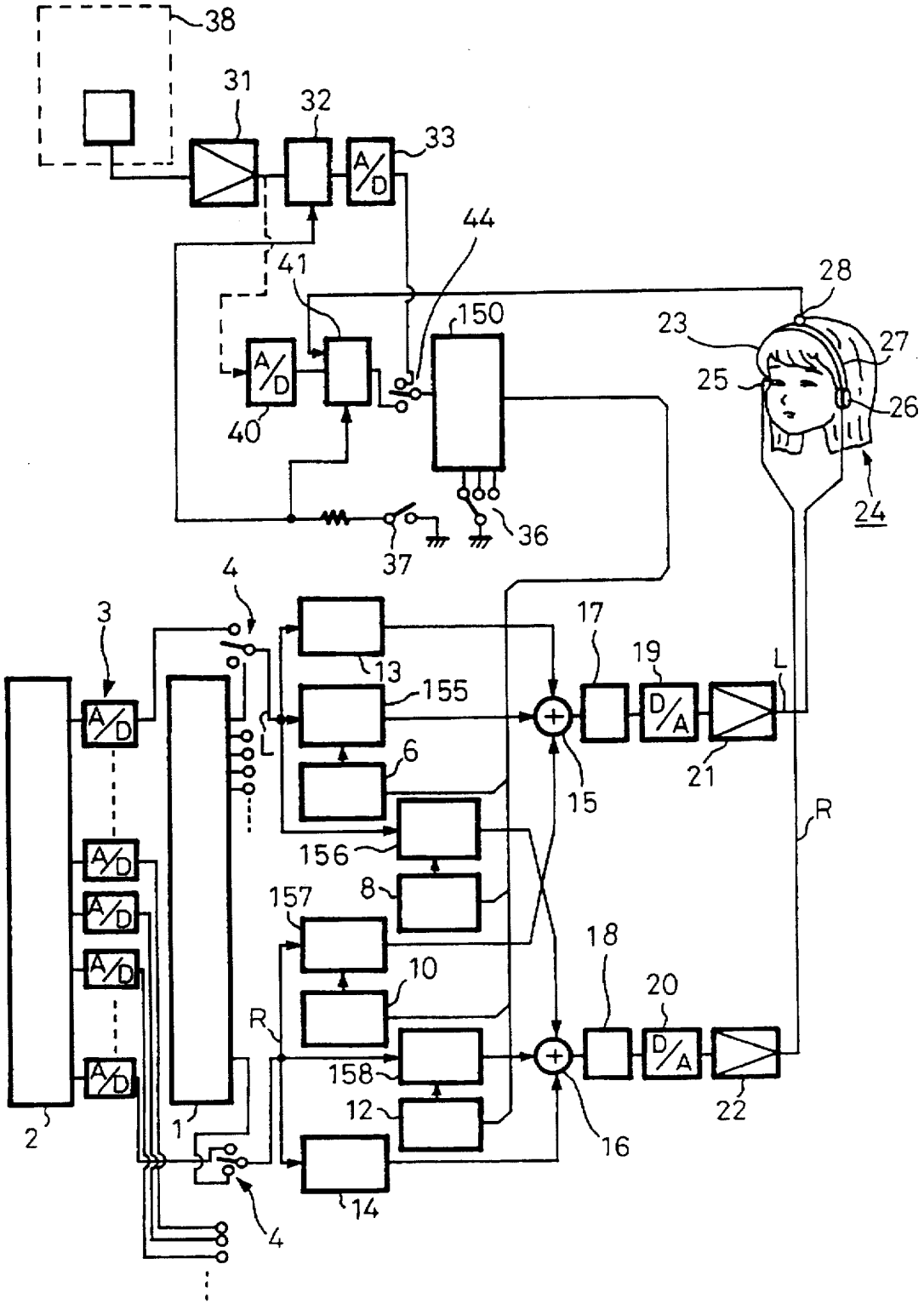
FIG. 16 is a block diagram showing an arrangement of the angle detection apparatus and the audio reproduction apparatus using it according to another embodiment of the present invention, the arrangement being used to calculate transfer characteristics with the memory being provided.

FIG. 16 is a block diagram showing the angle detection apparatus and the audio reproduction apparatus using it according to another embodiment of the present invention. In the embodiment, the transfer characteristics are calculated with the memory being provided. According to the angle detection apparatus and the audio reproduction apparatus using it according to the above embodiment, when the audio signals are reproduced through the headphones, the same localization, sound field and so on as those obtained when the sounds are reproduced by the loudspeakers located in a predetermined relationship upon reproduction using the loudspeakers are obtained even by reproduction with the headphones. Particularly, the transfer characteristics based on detection signals representing the gyration of the head of the listener are directly calculated, stored in the memories 6, 8, 10 and 12 associated with transfer-characteristic control units 155, 156, 157 and 158 and then added to the reproduced audio signals.

In an arrangement shown in FIG. 16, the transfer-characteristic calculating unit 150 calculates the transfer characteristics including frequency region data based on the detection signal representing the gyration of the head of the listener. The transfer characteristics are once stored in the memories 6, 8, 10 and 12 and then supplied to transfer-characteristic control units 155, 156, 157 and 158. The transfer-characteristic control units 155, 156, 157 and 158 read the transfer characteristics from the memories 6, 8, 10 and 12 and add the transfer characteristics to the reproduced audio signals by the transfer-characteristic control units 155, 156, 157 and 158, thereby correcting the audio signals in a real-time fashion. In this arrangement, the transfer characteristics are referred to as impulse responses or transfer functions, for example.

Other arrangements and actions shown in FIGS. 15 and 16 are similar to those shown in FIGS. 1, 7, 8, 9 and 10 and need not to be described in detail.

According to the above embodiment, the reproduced audio signals are corrected in response to the transfer characteristics which are directly calculated based on discrete positions and angles of the listener and stored in the memories 6, 8, 10 and 12 respectively associated with the transfer-characteristic calculating units 155, 156, 157 and 158. Therefore, it is possible to correct the signals in a more real-time fashion by detecting the fine gyration of the head of the listener staying at an arbitrary position.

Figure 17:
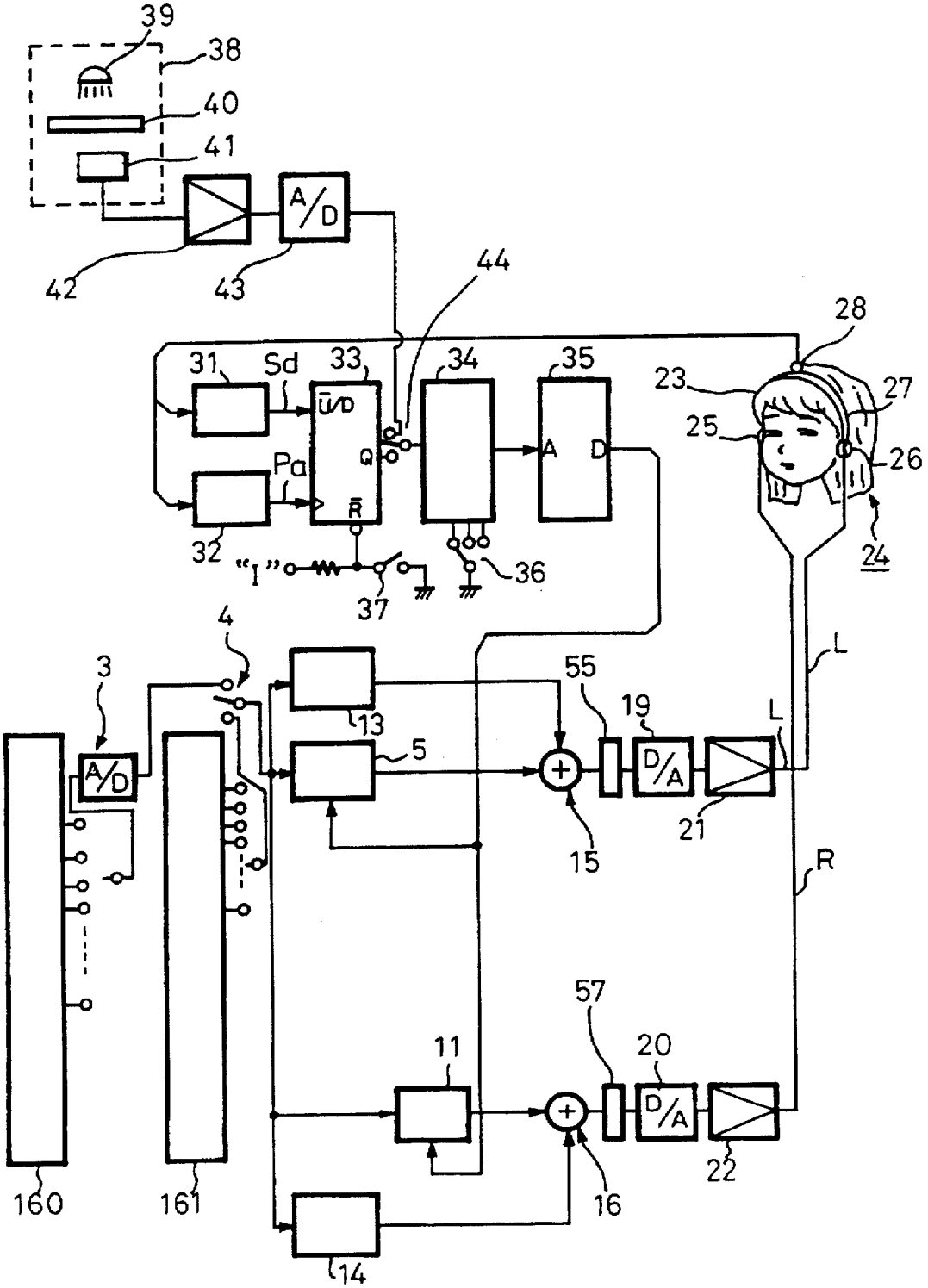
FIG. 17 is a block diagram showing an arrangement of the angle detection apparatus and the audio reproduction apparatus using it according to another embodiment of the present invention, the arrangement being used when a monophonic audio signal in one channel is used without the memory being provided.

FIG. 17 is a block diagram showing an angle detection apparatus and an audio reproduction apparatus using it according to another embodiment of the present invention. In the embodiment, a memory is not provided and a one-channel monophonic audio signal is used. According to the angle detection apparatus and the audio reproduction apparatus using it according to the embodiment, when the audio signals are reproduced through the headphones, the same localization, sound field and so on as those obtained when the sounds are reproduced by the loudspeakers located in a predetermined relationship upon reproduction using the loudspeakers are obtained even by reproduction with the headphones. Particularly, the reproduced one-channel monophonic audio signal is corrected by using the control signals.

In an arrangement shown in FIG. 17, the reproduced monophonic audio signal from a monophonic analog signal source 160 or a monophonic digital signal source 161 is corrected directly by the convolution integrators 5, 11 in a real-time fashion by using the control signals supplied from the memory 35 directly to the convolution integrators 5, 11. The control signals are used only for the monophonic reproduced audio signal.

According to the above embodiment, the monophonic reproduced audio signal is corrected based on the control signals which are stored in the memory in response to discrete positions and angles of the listener. Therefore, it is possible to correct the signals in a more real-time fashion by detecting the fine gyration of the head of the listener staying at an arbitrary position.

Figure 18:
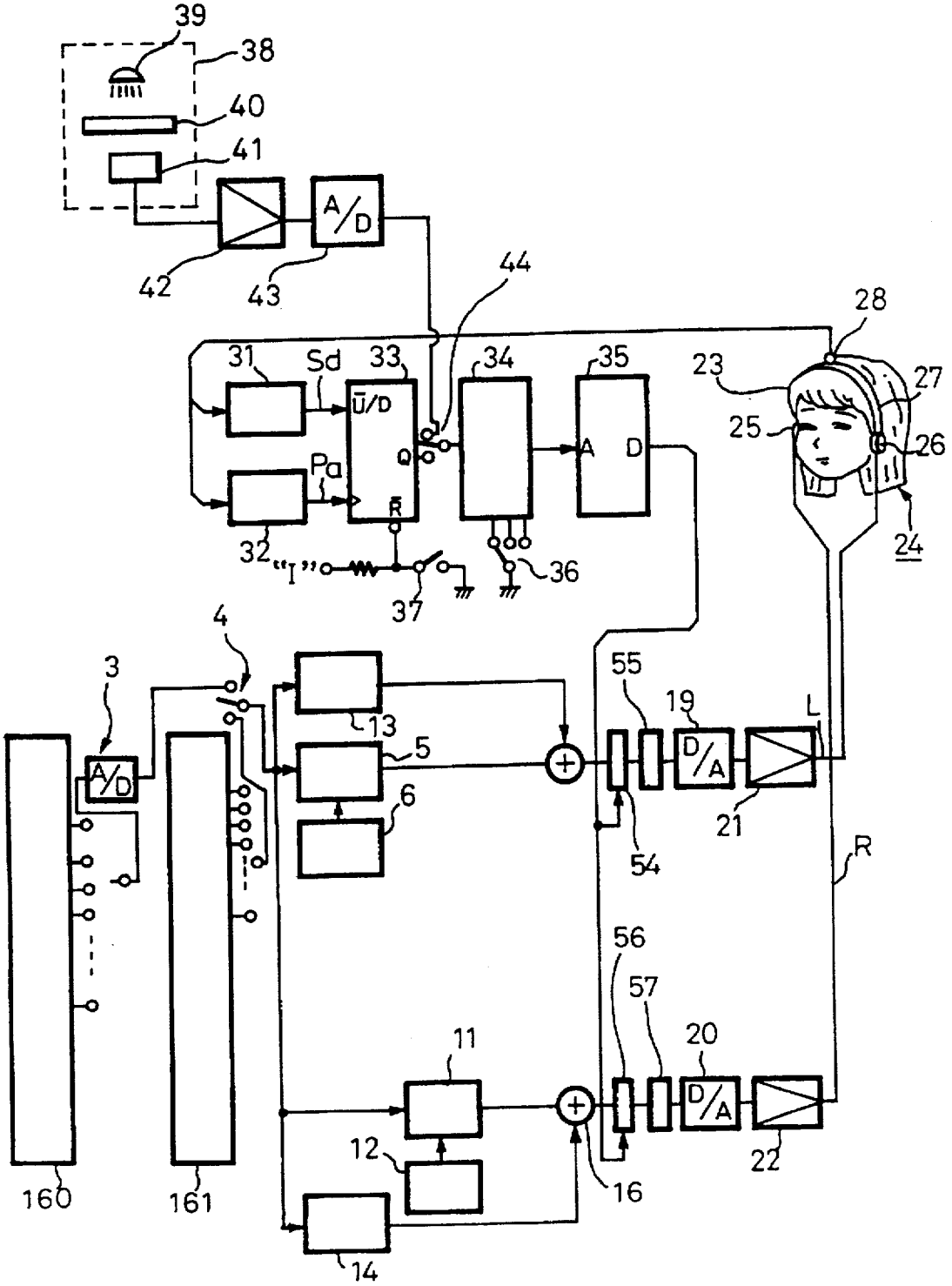
FIG. 18 is a block diagram showing an arrangement of the angle detection apparatus and the audio reproduction apparatus using it according to another embodiment of the present invention, the arrangement being used when the monophonic audio signal in one channel is used with the memory being provided.

FIG. 18 is a block diagram showing the angle detection apparatus and the audio reproduction apparatus using it according to another embodiment of the present invention. In the embodiment, the memory is provided and the one-channel monophonic audio signal is used. According to the angle detection apparatus and the audio reproduction apparatus using it according to the embodiment, when the audio signals are reproduced through the headphones, the same localization, sound field and so on as those obtained when the sounds are reproduced by the loudspeakers located in a predetermined relationship upon reproduction using the loudspeakers are obtained even by reproduction with the headphones. Particularly, the reproduced one-channel monophonic audio signal is once subjected to convolution integral with the impulse responses stored in the memories 6 and 12 associated with the convolution integrators 5 and 11 and then corrected in the control apparatus 54, 55 by using the control signals.

In an arrangement shown in FIG. 18, the reproduced audio signal from the monophonic analog signal source 160 or the monophonic digital signal source 161 is supplied to the convolution integrators 5, 11. The reproduced audio signal is subjected to convolution integral with the impulse responses once stored in the memories 6, 12 associated with the convolution integrators 5, 11. Then, the control signals are read from the memory 35 and supplied to the control apparatus 54, 56. The reproduced monophonic audio signal is corrected by the control apparatus 54, 56 by using the control signals. The control signals and the impulse responses are used only for the monophonic reproduced audio signal. The impulse responses are a pair of digitally recorded impulse responses from the virtual sound source positions to the ears with respect to the head fixed with respect to the reference direction. The control signals used in FIGS. 17 and 18 represent the difference in time and level between the sounds obtained at both the ears from the virtual sound source positions with respect to the reference direction of the head to both the ears.

Other arrangements and actions shown in FIGS. 17 and 18 are similar to those shown in FIGS. 1, 7, 8, 9 and 10 and need not be described in detail.

According to the above embodiment, the monophonic reproduced audio signal is supplied to the convolution integrators 5, 11 and subjected to convolution integral with the impulse responses once stored in the memories 6, 12 associated with the convolution integrators 5, 11. Then, the control signals stored in the memory 35 is read therefrom. The reproduced monophonic audio signal is corrected by the control apparatus by Using the control signals. Therefore, it is possible to correct the signals in a more real-time fashion by detecting the fine gyration of the head of the listener staying at an arbitrary position.

An angle detection apparatus of an angle detection apparatus and an audio reproduction apparatus using it according to another embodiment of the present invention will hereinafter be described in detail with reference to FIGS. 19 to 29.

According to the angel detection apparatus and the audio reproduction apparatus using it, when the audio signals are reproduced through the headphones, the same localization, sound field and so on as those obtained when the sounds are reproduced by the loudspeakers located in a predetermined relationship upon reproduction using the loudspeakers are obtained even by reproduction with the headphones. Particularly, the gyration of the head of the listener is detected by using a galvanomagnetic effect sensor suitable for detection of the gyration of the head.

An arrangement and action of the audio reproduction apparatus thereof are similar to those shown in FIGS. 1, 7, 8, 9 and 10 and need not be described in detail. According to the above embodiment, in the arrangement shown in FIG. 1, for example, the galvanomagnetic effect sensor is substituted for the analog vibratory gyroscope 30 and detects the movement of the head of the listener 23.

Figure 19:
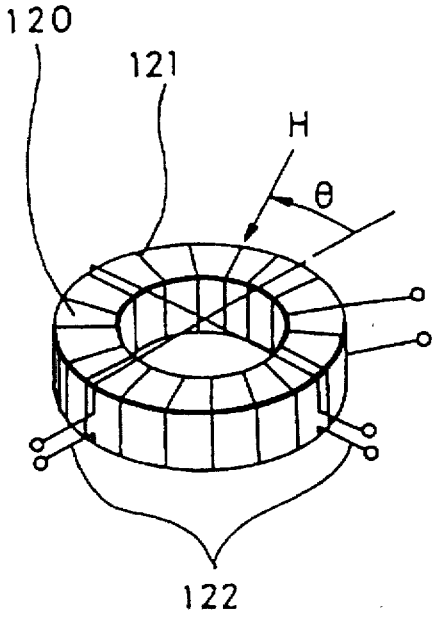
FIG. 19 is a diagrams showing principle and arrangement of a galvanomagnetic effect sensor as an angle detection apparatus of the angle detection apparatus and the audio reproduction apparatus using it according to another embodiment of the present invention.

In FIG. 19, an analog galvanomagnetic effect sensor for outputting an analog signal in response to geomagnetism with respect to the gyration of the head is used in the angle detection apparatus of the angle detection apparatus and the audio reproduction apparatus using it according to the above embodiment of the present invention. When a digital galvanomagnetic effect sensor is substituted for the digital vibratory gyroscope 28 in the arrangement shown in FIG. 1, an arrangement with the digital galvanomagnetic effect sensor is similar to the following arrangement with the analog galvanomagnetic effect sensor except that the digital galvanomagnetic effect sensor outputs a digital signal through an analog-to-digital converter. The analog galvanomagnetic effect sensor is attached to the head band 27 of the headphones 24. The galvanomagnetic effect sensor is based on a so-called geomagnetism measurement method utilizing a magnetic field of the earth. Therefore, when the galvanomagnetic effect sensor is used, it is possible to directly detect an azimuth with a simple arrangement and inexpensive costs.

However, this method is encountered by the following problems. The first problem is that the magnetic variation with respect to the earth is different depending upon the places at different latitudes. The second problem is that when the galvanomagnetic effect sensor is inclined, it cannot detect a horizontal component of the geomagnetism correctly to thereby make an error. The third problem is that the magnetic field is disturbed by a building built by using iron reinforcing rods or the like. To solve the first problem, magnetic-variation correction data are added to correct the magnetic variation. To solve the second problem, inclination of the sensor is corrected.

FIG. 19 shows a principle and arrangement of a galvanomagnetic effect sensor of the angle detection apparatus of the angle detection apparatus and the audio reproducing apparatus using it according to another embodiment of the present invention. An exciting primary coil 121 is wound around the entire periphery of an amorphous core 120 formed of a toroidal core having a circular cross section and a ring shape of single layer. Two pairs of secondary coils 122 are wound in the diameter direction of the amorphous core 120 so as to cross at a right angle each other. Thus, a current in response to an angle θ of declination with respect to the geomagnetism H is output from the secondary coil 122.

Figure 20:
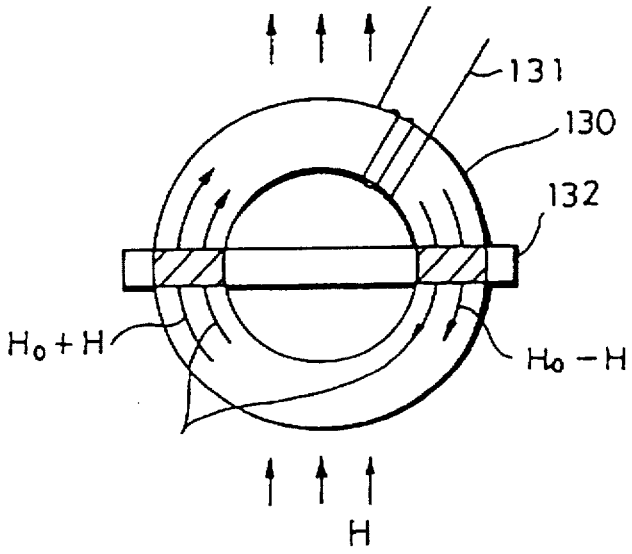
FIG. 20 is a diagram used to explain an operational principle of the galvanomagnetic effect sensor as the angle detection apparatus of the angle detection apparatus and the audio reproduction apparatus using it according to another embodiment of the present invention.

FIG. 20 shows a principle of an operation of the galvanomagnetic effect sensor of the angle detection apparatus of the angle detection apparatus and the audio reproducing apparatus using it according to another embodiment of the present invention. When an exciting primary coil 131 wound around a toroidal core 130 is subjected to AC excitation, an AC magnetic field $H_0$ based on magnetomotive force is generated inside the toroidal coil 130. Flux linkages of an X coil 132 representing a detection winding in the X direction have opposite directions at both of the ends in the toroidal core 130. A sum of the flux linkages at both of the ends are zero. When the geomagnetism H as an external magnetomotive force is applied to the toroidal coil 130 from the direction perpendicular to the X coil 132, the magnetomotive forces of the toroidal core included in the X coil 132 are $H_0+H$ and $H_0-H$ and a difference component between them is 2H.

Also, a voltage of $V=k.dH/dt$ (where k is a proportional constant) is induced in the X coil 132. When the geomagnetism H as the external magnetomotive force in the direction at an optional angle θ is applied thereto, perpendicular component electromotive forces with respect to the X coil 132 and a Y coil perpendicular thereto are respectively $H_X=H \sin\theta$ and $H_Y=H \cos\theta$. Therefore, the voltages $V_X$ and $V_Y$ induced in the X coil 132 and the Y coil perpendicular thereto are calculated. Thus, the angle θ is calculated from $\theta=\tan^{-1}(V_X/V_Y)$.

Figure 21:
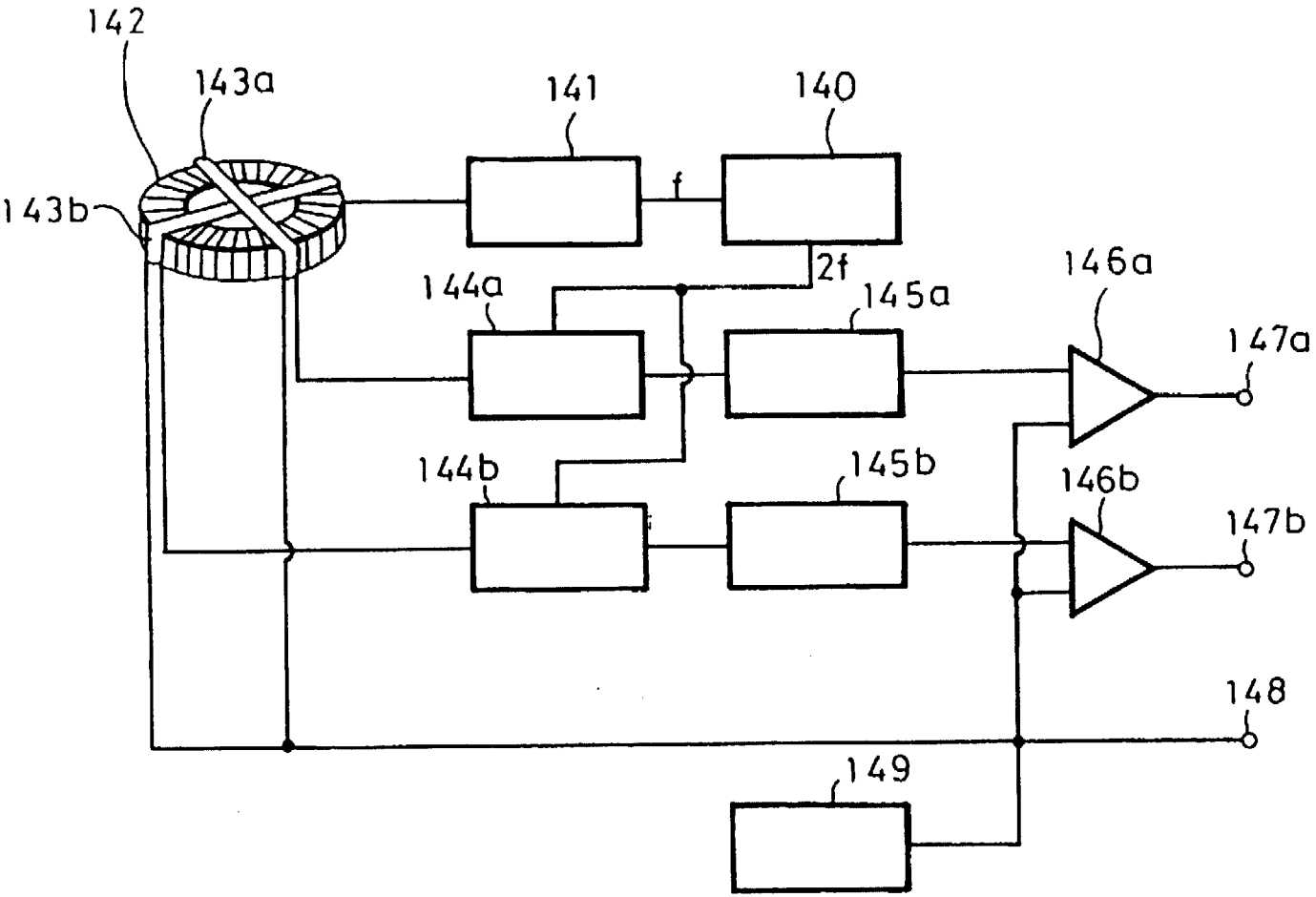
FIG. 21 is a diagram showing a phase detection and conversion circuit of the galvanomagnetic effect sensor as the angle detection apparatus of the angle detection apparatus and the audio reproduction apparatus using it according to another embodiment of the present invention.

FIG. 21 shows an arrangement of a phase detection and conversion circuit of the galvanomagnetic effect sensor of the angle detection apparatus of the angle detection apparatus and the audio reproduction apparatus using it according to another embodiment of the present invention. An excitation current of a frequency f is supplied from an oscillator 140 through a driver 141 to the excitation primary coil of a galvanomagnetic effect sensor 142. Output voltages induced in an X coil 143*a* and a Y coil 143*b* perpendicular thereto of the galvanomagnetic effect sensor 142 are respectively supplied through synchronous detector circuits 144*a* and 144*b*, integration circuits 145*a* and 145*b* and amplifiers 146*a* and 146*b* to an X coil output terminal 147*a* and a Y coil output terminal 147*b*. A reference voltage is supplied from a regulated power supply 149 to the X coil 143*a* and the Y coil 143*b* perpendicular thereto and the amplifiers 146*a* and 146*b*. The reference voltage can be confirmed through a reference voltage terminal 148.

A frequency component of the output voltage includes a harmonic wave of a frequency which is twice as high as the frequency f of the excitation current (because the magnetic fluxes are changed twice per one period). Therefore, as shown in FIG. 21, a component of a frequency 2f is delivered from the oscillator 140 through filters (not shown) to carry out the phase detection. Thus, the output voltage is converted into a DC voltage.

Figure 22:
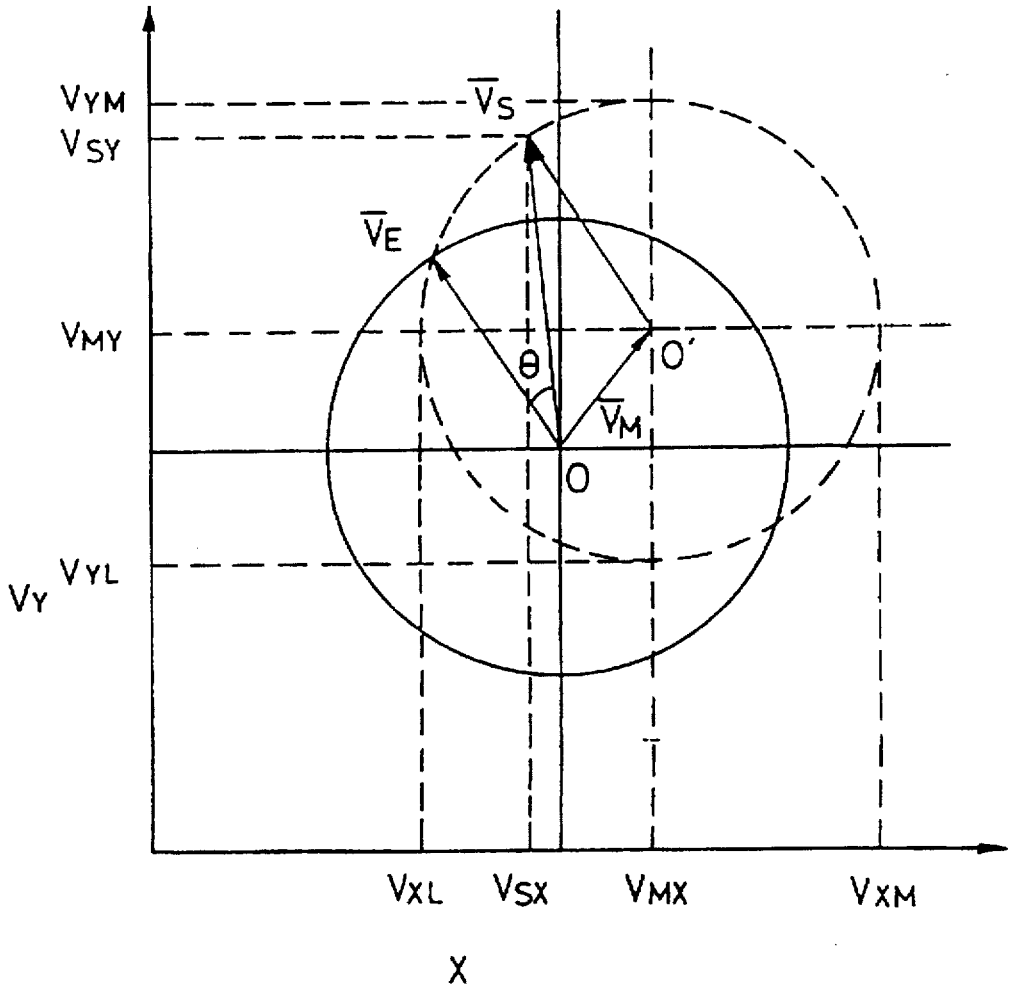

By the way, the horizontal component of the geomagnetism is very small, e.g., $3\times10^{-5}$T (300 mG). It is frequently observed that an artificial and local external magnetism is large as compared with the geomagnetism. Thus, when such magnetism is produced near the galvanomagnetic effect sensor, a large error is produced. In order to cancel the error, it is necessary to carry out some suitable corrections. FIG. 22 is a graph showing a locus of a vector obtained when the geomagnetism is corrected for the external magnetism in the galvanomagnetic effect sensor of the angle detection apparatus of the angle detection apparatus and the audio reproduction apparatus using it according to another embodiment of the present invention. If there is only a vector of the geomagnetism in a graph of FIG. 22, when the listener 23 turns the head, a locus of the vector $V_E$ is represented by a circle whose center is a point O. When there is the external magnetism, a composite vector $V_S$ of a vector $V_M$ of the external magnetism and the vector $V_E$ of the geomagnetism is detected.

In this case, when the listener turns the head, since the vector $V_M$ of the external magnetism is not changed with respect to the galvanomagnetic effect sensor, a locus of the composite vector $V_S$ is changed to a circle whose center is a point O'. If the maximum and minimum voltages of the X coil and the Y coil measured while the listener turns the head are respectively $V_{XM}$, $V_{YM}$, $V_{XL}$ and $V_{YL}$, then X and Y components $V_{MX}$ and $V_{MY}$ of the external magnetism are respectively $V_{MX}=(V_{XM}+V_{XL})/2$ and $V_{MY}=(V_{YM}+V_{YL})/2$. Similarly, if X and Y components of the composite vector $V_S$ are respectively $V_{SX}$ and $V_{SY}$, then the desired azimuth θ of the geomagnetism is $\theta=\tan^{-1}\{(V_{SX}-V_{MX})/(V_{SY}-V_{MY})\}$.

Further, at this time, a geomagnetic azimuth sensor developed by the applicant of the application, which is formed of a magnetoresistive element and a plate coil and has small size and high sensitivity, may be used as the above galvanomagnetic effect sensor. An MR sensor which has a magnetic thin film formed of permalloy with a film thickness of 0.03 μm and converts an intensity of a magnetic field into a change of resistance to pick up an electric signal and the plate coil using a copper wire with a diameter of 40 μm for bias are integrally bonded by an epoxy adhesive to form the geomagnetic azimuth sensor.

Thus, since the geomagnetic azimuth sensor has a size of 10 $mm^2$ (width×depth)×2 mm (thickness), it is realized to make the geomagnetic azimuth sensor small and thin as compared with a general coil sensor. The azimuth is detected by detecting an azimuth with the south-north direction of the geomagnetism being used as a reference. In case of an analog output of 900 mV, a drift of a display angle is 1° or smaller at 25° C. and 1.5° or smaller at 60° C. Thus, a drift of a signal caused by change of an ambient temperature is suppressed to minimum value and the geomagnetic azimuth sensor is arranged such that the sensor does not need to be set for correction. Therefore, it is possible to use the geomagnetic azimuth sensor with small deviation of a detected angle (deviation of the azimuth is ±1.5°) under any severe environmental conditions on earth. An operating power supply is 5V and an MR current is 1 mA or smaller on average.

If a semiconductor Hall element is used in the galvanomagnetic effect sensor, it is possible to arrange the galvanomagnetic effect sensor which is small and light, has low consumed power and long lifetime and is easy to handle and inexpensive.

As long as the galvanomagnetic effect sensor utilizes the galvanomagnetic effect in which, when a current flows in a metal or semiconductor having a uniform composition, a geomagnetic azimuth with respect to the current can be detected, the galvanomagnetic effect sensor may employ any of the following effects. FIG. 23 shows a galvanomagnetic effect sensor utilizing a Hall effect of the angle detection apparatus of the angle detection apparatus and the audio reproduction apparatus Using it according to another embodiment of the present invention.

As shown in FIG. 23, the galvanomagnetic effect sensor utilizes such a Hall effect that when a voltage E is applied across a sample 215 made of a metal piece having thickness d and a current I flows therein and a magnetic flux density B produced by the geomagnetism H in the direction perpendicular to the current is detected, a Hall voltage V is produced in the direction perpendicular both of the current I and the magnetic flux density B. At this time, a relationship of V=R.IB/d is established, where R is a Hall constant which represents a degree in which the Hall effect is produced.

Semiconductor Hall elements, such as an indium antimonide element, a silicon element, a gallium arsenide element or the like, may be substituted for the metal piece. Moreover, a superlattice Hall element of gallium arsenide element may be substituted therefor.

FIG. 24 shows a galvanomagnetic effect sensor utilizing a magnetoresistance effect of the angle detection apparatus of the angle detection apparatus and the audio reproduction apparatus using it according to another embodiment of the present invention. As shown in FIG. 24, the galvanomagnetic effect sensor utilizes such a magnetoresistance effect that when a current I flows in a sample 216 made of a metal piece or semiconductor and a magnetic flux density B produced by the geomagnetism H in the direction in parallel to or perpendicular to the current I is detected, a resistance value of the sample 216 is increased.

FIG. 25 shows a galvanomagnetic effect sensor utilizing a Planer Hall effect of the angle detection apparatus of the angle detection apparatus and the audio reproduction apparatus using it according to another embodiment of the present invention. As shown in FIG. 25, the galvanomagnetic effect sensor utilizes such a Planer Hall effect that when a current I flows in a sample 217 made of a metal piece or semiconductor in the direction shown by an X axis and a magnetic flux density B produced by the geomagnetism H in the direction perpendicular to the direction shown by a Z axis, i.e., in an XY plane is detected, an electromotive force is produced.

FIG. 26 shows a galvanomagnetic effect sensor utilizing d a Suhl effect of the angle detection apparatus of the angle detection apparatus and the audio reproduction apparatus using it according to another embodiment of the present invention. As shown in FIG. 26, when an electric field is applied to a sample 218 by using a voltage E, a collector 221 and an emitter 220 to inject holes 222 in the sample 218, if a magnetic flux density B produced by the geomagnetism H is detected by the sample, then the holes 222 are brought to a side surface of the sample 218 by a Lorentz's force F and conductivity is increased. Thus, it is possible to detect a current value by an ampere meter 219.

FIG. 27 shows a galvanomagnetic effect sensor utilizing an Ettingshausen effect of the angle detection apparatus of the angle detection apparatus and the audio reproduction apparatus using it according to another embodiment of the present invention. As shown in FIG. 27, the galvanomagnetic effect sensor utilizes such an Ettingshausen effect that when a current I flows in a sample 223 made of a metal piece and a geomagnetism H in the direction perpendicular to the current is detected, a temperature gradient M is produced in the direction perpendicular to both of the current I and the geomagnetism H.

When the above-mentioned galvanomagnetic effect sensors are used in an amusement system or the like, they may be used such that an external magnetic field is forcibly applied to thereby once set informations of the gyrations of the heads of a plurality of listeners 23 to the same data.

FIGS. 28 and 29 show headphones of the angle detection apparatus and the audio reproduction apparatus using it according to another embodiment of the present invention. Headphones 200 used to reproduce the audio signals may be arranged such that, as shown in FIG. 28, the headphones 200 have a head band 201, supporting bars 205 and 207 provided on an inner surface of the head band, and supporting bodies 206 and 208 respectively provided at the supporting bars and the supporting bodies are brought in contact with side portions of the head of the listener 23 to dispose headphone units 203 and 204 and the respective ears 23L and 23R of the listener 23 at predetermined distances such that the headphone units and the ears are prevented from being directly in contact with each other. While a galvanomagnetic effect sensor is provided on the head band 201 in this case, the galvanomagnetic effect sensor 202 may be attached to the same attachment positions as those for the vibratory gyroscopes shown in FIGS. 1 through 14.

As shown in FIG. 29, headphones 210 may be used which have the head band, headphone units 223 and 224 provided at both end portions of the head band and ear pads 225 and 226 having cylindrical shapes with a boring and provided inside the headphone units and the headphone units 223 and 224 and the respective ears 23L and 23R of the listener 23 are disposed at predetermined distances such that the headphone units and the ears are prevented from being directly in contact with each other. While a galvanomagnetic effect sensor 212 is similarly provided on the head band 211 in this case, the galvanomagnetic effect sensor may be attached to the same attachment positions as those for the vibratory gyroscopes shown in FIGS. 1 through 14.

According to the above embodiments, since the galvanomagnetic effect sensors 202 and 212 which utilize the galvanomagnetic effect and are suitable for detection of the gyration of the head are used and utilize not the acceleration but the geomagnetism when the gyration of the head is detected, it is unnecessary to attach the galvanomagnetic effect sensor to the center of the gyration of the head and it is possible to attach the sensor to the headphone band 201 or 211 as the head attachment body of the headphones 200 or 210. Moreover, it is possible to correct the audio signals with respect to the gyration of the head of the listener 23 in a real-time fashion based on signals in response to an angle supplied from the galvanomagnetic effect sensor which has a small size, light weight, low consumed power and long lifetime and is easy to handle and inexpensive.

According to the above embodiment, since the galvanomagnetic effect sensor 202 or 212 as the angle detection means utilizing the galvanomagnetic effect is the galvanomagnetic effect sensor which utilizes the geomagnetism and has the detection coils perpendicular to each other, it is possible to prevent a magnetic variation with respect to the earth from differing depending upon the places at different latitudes and to detect the horizontal component of the geomagnetism without error even when the galvanomagnetic effect sensor is inclined. Therefore, it is unnecessary to attach the galvanomagnetic effect sensor to the center of the gyration of the head and it is possible to attach the sensor to the headphone band 201 or 211 of the headphones 200 or 210. Moreover, it is possible to correct the audio signals with respect to the gyration of the head of the listener 23 in a real-time fashion based on signals in response to an angle supplied from the galvanomagnetic effect sensor which has a small size, light weight, low consumed power and long lifetime and is easy to handle and inexpensive.

According to the above embodiment, since the galvanomagnetic effect sensor 202 or 212 as the angle detection means utilizing the galvanomagnetic effect is the galvanomagnetic effect sensor which utilizes the Hall effect, it is possible to detect the angle by detecting the Hall voltage produced by the geomagnetism. Therefore, it is unnecessary to attach the galvanomagnetic effect sensor to the center of the gyration of the head and it is possible to attach the sensor to the headphone band 201 or 211 of the headphones 200 or 210. Moreover, it is possible to correct the audio signals with respect to the gyration of the head of the listener 23 in a real-time fashion based on signals in response to an angle supplied from the galvanomagnetic effect sensor which has a small size, light weight, low consumed power and long lifetime and is easy to handle and inexpensive.

According to the above embodiment, since the galvanomagnetic effect sensor 202 or 212 as the angle detection means utilizing the galvanomagnetic effect is the galvanomagnetic effect sensor which utilizes the magnetoresistance effect, it is possible to detect the angle by detecting the resistance value relative to the geomagnetism. Therefore, it is unnecessary to attach the galvanomagnetic effect sensor to the center of the gyration of the head and it is possible to attach the sensor to the headphone band 201 or 211 of the headphones 200 or 210. Moreover, it is possible to correct the audio signals with respect to the gyration of the head of the listener 23 in a real-time fashion based on signals in response to an angle supplied from the galvanomagnetic effect sensor which has a small size, light weight, low consumed power and long lifetime and is easy to handle and inexpensive.

According to the above embodiment, since the galvanomagnetic effect sensor 202 or 212 as the angle detection means utilizing the galvanomagnetic effect is the galvanomagnetic effect sensor which utilizes the Planer Hall effect, it is possible to detect the angle by detecting the resistance value relative to the geomagnetism. Therefore, it is unnecessary to attach the galvanomagnetic effect sensor to the center of the gyration of the head and it is possible to attach the sensor to the headphone band 201 or 211 of the headphones 200 or 210. Moreover, it is possible to correct the audio signals with respect to the gyration of the head of the listener 23 in a real-time fashion based on signals in response to an angle supplied from the galvanomagnetic effect sensor which has a small size, light weight, low consumed power and long lifetime and is easy to handle and inexpensive.

According to the above embodiment, since the galvanomagnetic effect sensor 202 or 212 as the angle detection means utilizing the galvanomagnetic effect is the galvanomagnetic effect sensor which utilizes the Suhl effect, it is possible to detect the angle by detecting the conductivity in response to a sum of electric fields relative to the geomagnetism. Therefore, it is unnecessary to attach the galvanomagnetic effect sensor to the center of the gyration of the head and it is possible to attach the sensor to the headphone band 201 or 211 of the headphones 200 or 210. Moreover, it is possible to correct the audio signals with respect to the gyration of the head of the listener 23 in a real-time fashion based on signals in response to an angle supplied from the galvanomagnetic effect sensor which has a small size, light weight, low consumed power and long lifetime and is easy to handle and inexpensive.

According to the above embodiment, since the galvanomagnetic effect sensor as the angle detection means utilizing the galvanomagnetic effect is the galvanomagnetic effect sensor which utilizes the Ettingshausen effect, it is possible to detect the angle by detecting the temperature gradient relative to the geomagnetism. Therefore, it is unnecessary to attach the galvanomagnetic effect sensor to the center of the gyration of the head and it is possible to attach the sensor to the headphone band 201 or 211 of the headphones 200 or 210. Moreover, it is possible to correct the audio signals with respect to the gyration of the head of the listener 23 in a real-time fashion based on signals in response to an angle supplied from the galvanomagnetic effect sensor which has a small size, light weight, low consumed power and long lifetime and is easy to handle and inexpensive.

According to the above embodiment, since one or a plurality of galvanomagnetic effect sensors 201 or 210 as the angle detection means utilizing the galvanomagnetic effect output signals representing a predetermined angle by applying a predetermined external magnetic field, it is possible to forcibly set the angle detection signals from one or a plurality of galvanomagnetic effect sensors 202 or 212 utilizing the galvanomagnetic effect to a predetermined value.

FIG. 30 is a block diagram showing an electronic equipment having a rotation angle detection function of the angle detection apparatus of the angle detection apparatus and the audio reproduction apparatus using it according to another embodiment of the present invention. According to the embodiment, a rotational movement of an optional electronic equipment which is not limited to the audio reproduction apparatus is detected by the rotation angle detection function of the angle detection apparatus. In FIG. 30, an angular velocity sensor 301 outputs a detection voltage proportional to an angular velocity obtained from the rotary movement of the electronic equipment. A band pass filter 302 removes unnecessary frequency bands from the detection voltage detected by the angular velocity sensor 301. An amplifier 303 amplifies the detection voltage in accordance with a predetermined gain determined based on resistance values of resistors $R_1$, $R_2$ and $R_3$.

A gain switcher 308 switches a gain of the amplifier 303 which is determined based on the resistance values of resistors $R_1$, $R_2$ and $R_3$. An A/D converter 304 codes the analog detection voltage and converts the same into a digital detection voltage. A microprocessor 305 is an arithmetic means which calculates the rotation angle from the digital detection voltage coded by the A/D converter 304 and supplies a control signal to a controlled unit not shown so as to control the electronic equipment. In this case, particularly, the microprocessor 305 supplies a level control signal 309 to the gain switcher 308 to switch a setting of the resistors $R_1$, $R_2$ and $R_3$, thereby the gain of the amplifier 303 being set. The amplifier 303 and the gain switcher 308 form a level controller.

FIG. 31 is a block diagram used to explain a processing of the microprocessor 305 shown in FIG. 30 of the electronic equipment having the rotation angle detection function of the angle detection apparatus of the angle detection apparatus and the audio reproduction apparatus using it according to another embodiment of the present invention. An output signal 363 input from the A/D convertor 304 to the microprocessor 305 is sampled by a sampling processing unit 366 at a constant interval and then divided into two systems. One system of the divided output signals is supplied to a level comparator 362 which calculates a true value of the output signal supplied from the angular velocity sensor from a present state of a level control signal 364 and a level of the output signal from the A/D converter 304 to compare the level of the output signal with a reference level generated from a reference level generating unit 367.

If the input level of the output signal from the angular velocity sensor exceeds the reference level generated by the reference level generating unit 367, then the level comparator outputs the level control signal 364 to lower the gain of the amplifier 303. Conversely, if the input level thereof becomes smaller than the reference level generated by the reference level generating unit 367, then the level comparator outputs the level control signal 364 to increase the gain.

An output of the other system of the sampled input signal 363 is supplied to an angle calculating unit 361 which integrates an input angular velocity signal and converts the same into angle data. Since the input data are different depending upon the gain of the amplifier 303, it is necessary to correct the input data.

In order to correct the input data, the level comparator 362 supplies a data correction control signal 365 to the angle calculating unit 361. Thus, an accurate rotation angle is calculated. In response to results of calculation, equipments at the succeeding stage are controlled.

According to the above embodiment, since the amplifier 303 is provided with the gain switcher 308 and the gain of the amplifier 303 is switched by the gain switcher 308 in response to the digital signal input to the microprocessor 305, when the output level of the angular velocity sensor 301 exceeds the predetermined reference level, the gain of the amplifier 303 located between the angular velocity sensor and the A/D converter 304 is lowered, thereby preventing the output signal from the amplifier 303 from exceeding a dynamic range of the A/D converter 304.

Conversely, when the output level of the angular velocity sensor 301 is smaller than the reference level, the gain of the amplifier 303 is increased to set the output signal of the amplifier within the range of the dynamic range of the A/D converter 304. Thus, it is possible to have the wide dynamic range even when the A/D converter 304 having small bit number is used.

FIG. 32 is a block diagram showing an electronic equipment having a rotation angle detection function of the angle detection apparatus of the angle detection apparatus and the audio reproduction apparatus using it according to another embodiment of the present invention. In FIG. 32, an angular velocity sensor 301 outputs a detection voltage proportional to the angular velocity obtained from the rotary movement of the electronic equipment. A band pass filter 302 removes unnecessary frequency bands from the detection voltage detected by the angular velocity sensor 301. An amplifier 303 amplifies the detection voltage in accordance with a predetermined gain determined based on resistance values of resistors $R_4$ and $R_5$. An A/D converter 304 codes the analog detection voltage and converts the same into a digital detection voltage.

An amplifier 306 amplifies the detection voltage in accordance with a predetermined gain determined based on resistance values of resistors $R_6$ and $R_7$. An A/D converter 307 codes the analog detection voltage and converts the same into a digital detection voltage. The amplifier 306, the resistors $R_6$ and $R_7$ and the A/D converter 307 are provided in parallel to the amplifier 303, the resistors $R_4$ and $R_5$ and the A/D converter 304, respectively. A microprocessor 305 is an arithmetic means which calculates the rotation angle from the digital detection voltages coded by the A/D converters 304, 307 and supplies a control signal to a controlled unit (not shown) to control the electronic equipment. In this case, particularly, the amplifiers 303 and 306 are previously set by using the resistors $R_4$ and $R_5$ and the resistors $R_6$ and $R_7$ to have different gains.

FIG. 33 is a block diagram used to explain a processing of the microprocessor 305 shown in FIG. 32 of the equipment having the rotation angle detection function of the angle detection apparatus of the angle detection apparatus and the audio reproduction apparatus using it according to another embodiment of the present invention. Respective output signals 353, 354 input from the A/D converters 304, 305 to the microprocessor 305 are sampled at a predetermined interval by sampling processing units 357, 358, respectively. The input signal 354 supplied from the amplifier having a larger gain is divided into two systems. One system of the input signal 354 is supplied to a switcher 350.

The other system is supplied to a level comparator 352 which compares a level of the output signal from the A/D converter with a predetermined reference level generated by a reference level generator 359.

If the input level of the output signal from the angular velocity sensor exceeds the reference level generated by the reference level generator 359, then the switcher 350 is controlled so that the input signal 353 supplied from the amplifier having a smaller gain should be selected. Conversely, if the input level is smaller than the reference level generated by the reference level generator 359, then the switcher 350 is controlled based on a switch control signal 355 from the level comparator 352 so that the input signal supplied from the amplifier having a larger gain should be selected.

An output selected by the switcher 350 is supplied to an angle calculating unit 351 which needs to integrates an input angular velocity signal and converts the same into angle data.

In order to calculate the angle data, the level comparator 352 supplies a data correction control signal 356 used for the calculation to the angle calculating unit 351. Thus, the accurate rotation angle is calculated and the equipments at the succeeding stage are controlled based on results of the calculation.

When the output level of the angular velocity sensor 301 exceeds the predetermined reference level, the output signal from the amplifier having a smaller gain of a plurality of the amplifiers 303, 306 which is A/D converted is supplied to the microprocessor 305. Conversely, when the output level of the angular velocity sensor 301 is smaller than the predetermined reference level, the output signal from the amplifier having a larger gain of the amplifiers 303, 306 which passes through the A/D converter is supplied to the microprocessor 305. The microprocessor carries out a processing for converting the angular velocity into the angle. Thus, it is possible to enlarge the dynamic range. It is possible to have the wide dynamic range even when the A/D converter having the small bit number is used.

FIG. 34 is a block diagram showing an electronic equipment having a rotation angle detection function of an angle detection apparatus of an angel detection apparatus and an audio reproduction apparatus using it according to another embodiment of the present invention. In FIG. 34, an angular velocity sensor 301 outputs a detection voltage proportional to the angular velocity obtained from the rotary movement of the electronic equipment. A band pass filter 302 removes unnecessary frequency bands from the detection voltage detected by the angular velocity sensor 301. An amplifier 303 amplifies the detection voltage in accordance with a predetermined gain determined based on resistance values of diodes $D_1$ and $D_2$ and resistors $R_1$, $R_2$ and $R_3$. An A/D converter 304 codes the analog detection voltage and converts the same into a digital detection voltage.

A microprocessor 305 is an arithmetic means which calculates the rotation angle from the digital detection voltage coded by the A/D converter 304 and supplies a control signal to a controlled unit, not shown, to control the electronic equipment. In this case, particularly, the amplifier 303 is a logarithmic compression amplifier which subjects a signal input thereto to logarithmic compression and amplifies the same.

FIG. 35 is a block diagram used to explain a processing of the microprocessor 305 shown in FIG. 34 of the equipment having the rotation angle detection function of the angle detection apparatus of the angle detection apparatus and the audio reproduction apparatus using it according to another embodiment of the present invention. An output signal 314 input from the A/D converter 304 to the microprocessor 305 is sampled at a predetermined interval by a sampling processing unit 313 and then supplied to an inverse logarithmic transformation unit 312. The inverse logarithmic transformation unit restores the input signal to linear data and supplies its output to an angle calculating unit 311. The angle calculating unit integrates the input angular velocity signal and converts the same into angle data. Thus, an accurate rotation angle is calculated and the equipments at the succeeding stage are controlled based on results of the calculation.

Since an output level of the angular velocity sensor 301 is subjected to logarithmic compression and then subjected to A/D conversion and a compression ratio is properly selected, it is possible to code the output signal from the angular velocity sensor 301 having a wide dynamic range by the A/D converter having the small bit number. Since the inverse logarithmic calculation is carried out in the processing in the microprocessor 305, it is possible to enlarge the dynamic range by calculating the angle from the linear signal. Thus, it is possible to have the wide dynamic rage even when the A/D converter having the small bit number is used.

If a piezoelectric vibratory gyroscope is used as the angular velocity detection sensor 301 in the arrangement of the above embodiment, then it is possible to have the electronic equipment of smaller size and lighter weight and to reduce the power consumed by the angular velocity detection sensor 301.

If at least the angular velocity sensor 301, the amplifier 303 and the A/D converter 304 are integrally formed in the arrangement of the above embodiment, it is possible that the angular velocity sensor, the amplifier and the A/D converter as a single unit detect the angular velocity, convert the same into digital data which is used to control the equipments at the succeeding stage. It is possible to handle the same as the angular velocity sensor element having a digital output, so that positional displacement of parts upon mounting can be reduced to thereby stably detect the angle with satisfactory immunity against noise.

According to the above embodiment, since the amplifier 303 is provided with the gain switcher 308 and the gain of the gain switcher 308 is switched in response to the digital signal input to the microprocessor 305 as the arithmetic means, when the output level of the angular velocity sensor 301 exceeds the predetermined reference level, the gain of the amplifier 303 provided between the angular velocity sensor and the A/D converter 304 is lowered, thereby preventing the output signal from the amplifier 303 from exceeding the dynamic range of the A/D converter 304. Conversely, if the output level of the angular velocity sensor 301 is smaller than the reference level, then the gain of the amplifier is increased to set the output signal of the amplifier 303 within the range of the dynamic range of the A/D converter 304. Thus, it is possible to have the wide dynamic range even when the A/D converter 304 having small bit number is used.

According to the above embodiment, the amplifiers 303, 306 are the amplifiers 303, 306 having at least two different gains or more. The detection signal from the angular velocity sensor 301 is supplied to the amplifiers 303, 306 having at least two different gains or more. The output signals from the amplifiers 303, 306 having at least two different gains or more are respectively coded by the A/D converters 304, 307 and then supplied to the microprocessor 305 as the arithmetic means. Based on the arithmetic results calculated by the microprocessor 305 as the arithmetic means, the signal to be used to calculate the rotation angle is selected from the signals from the A/D converters 304, 307. Therefore, when the output level of the angular velocity sensor 301 exceeds the predetermined reference level, the output signal from the amplifier having a smaller gain of the amplifiers 303, 306 is converted into the digital output data which are supplied to the microprocessor 305 as the arithmetic means. Conversely, when the output level of the angular velocity sensor 301 is smaller than the predetermined reference level, the output signal from the amplifier having a larger gain of the amplifiers is converted by the A/D converter into the digital data which are supplied to the microprocessor 305 as the arithmetic means. The microprocessor carries out the processing for converting the angular velocity into the angle. Thus, it is possible to enlarge the dynamic range. It is possible to have the wide dynamic range even when the A/D converter having the small bit number is used.

According to the above embodiment, since the amplifier 303 is formed of the logarithmic compression amplifier 303 in the electronic equipment having the rotation angle detection function for controlling the equipment based on the calculated results of the microprocessor 305 as the arithmetic means, the output level of the angular velocity sensor 301 is subjected to logarithmic compression and subjected to A/D conversion. Therefore, if the compression ratio is properly selected, it is possible to code the output signal from the angular velocity sensor 301 having a wide dynamic range by the A/D converter having the small bit number. Since the inverse logarithmic calculation is carried out in the processing in the microprocessor 305 as the arithmetic means, it is possible to enlarge the dynamic range by calculating the angle from the linear signal. Moreover, it is possible to have the wide dynamic range even when the A/D converter 304 having the small bit number is used.

According to the above embodiment, since the piezoelectric vibratory gyroscope is used as the angular velocity detection sensor 301 in the above-mentioned arrangements, it is possible to provide the equipment of smaller size and lighter weight and to reduce the power consumed by the angular velocity detection sensor 301.

According to the above embodiment, since at least the angular velocity sensor 301, the amplifier 303 and the A/D converter 304 are integrally formed, it is possible that the angular velocity sensor, the amplifier and the A/D converter as a single unit detect the angular velocity and convert the same into digital data which are used to control the equipments at the succeeding stage. It is possible to handle the same as the angular velocity sensor element having a digital output, so that positional displacement of parts upon mounting can be reduced to thereby stably detect the angle with satisfactory immunity against noise.

INDUSTRIAL APPLICABILITY

The present invention relates to an angle detection apparatus and an audio reproduction apparatus using it suitable for use in reproduction of an audio signal through headphones and is applicable to an audio reproduction apparatus in which a vibratory gyroscope as an angle detection apparatus for detecting a gyration of a head of a listener is attached to an optimum attachment position. According to the present invention, when the audio signal is reproduced through the headphones, the same localization, sound field and so on as those obtained when the sound is reproduced by the loudspeakers located in a predetermined relationship upon reproduction of the sound by the loudspeakers can be obtained even by the reproduction through the headphones. Particularly, the gyration of the head of the listener is detected by using the vibratory gyroscope suitable for detection of the gyration of the head.

What is claimed is:

1. An audio reproduction apparatus comprising:

a signal source for supplying audio signals to a plurality of channels;

storing means for measuring an impulse response from a virtual sound source position with respect to a reference direction of a listener relative to both ears of the listener being fixed and recording said impulse response, or for measuring a difference in time and level between audio signals from said virtual sound source position with respect to said reference direction of said listener at each of a plurality of angles which can be recognized by said listener and storing a control signal representing said difference in time and level between said audio signals from said virtual sound source position;

vibratory gyroscope means for detecting a movement of a head of said listener with respect to said reference direction at each of a plurality of predetermined angles and outputting a digitized angle detection signal;

address signal conversion means for converting an angle detection signal detected by said vibratory gyroscope means into an address signal;

control means for correcting said audio signals supplied to said plurality of channels by said signal source based on said impulse response or said control signal stored in said storing means and producing corrected audio signals; and audio reproduction means for reproducing said corrected audio signals corrected by said control means, wherein an address of said storing means is designated by said address signal from said address signal conversion means based on said angle detection signal from said vibratory gyroscope means, said angle detection signal being proportional to an angular velocity of said vibratory gyroscope means, said impulse response or said control signal stored in said storing means is read out therefrom, said audio signals are corrected by said control means based on said impulse response or said control signal, and said audio signals are corrected in response to movement of said head of said listener in a real-time fashion.

2. An audio reproduction apparatus according to claim 1, wherein said vibratory gyroscope means includes:

a detection unit for detecting said movement of said head of said listener with respect to said reference direction at each of said plurality of predetermined angles and outputting an analog angle detection signal, and an analog-to-digital converting unit for converting said analog angle detection signal from said detection unit into a digital signal.

3. An audio reproduction apparatus according to claim 1, wherein said vibratory gyroscope means is formed of a bidirectional digital output vibratory gyroscope which detects said movement of said head of said listener with respect to said reference direction at each of said plurality of predetermined angles, outputs a digital signal, and performs a predetermined signal processing in accordance with an external command signal.

4. An audio reproduction apparatus according to claim 1, wherein said vibratory gyroscope means is formed of a vibratory gyroscope which has a vibration drive unit and a vibration detection unit, at least the of said vibration drive unit and said vibration detection unit is formed of a piezoelectric body, and said vibratory gyroscope detects said movement of said head of said listener with respect to said reference direction at each of said plurality of predetermined angles to output said angle detection signal.

5. An audio reproduction apparatus according to claim 1, wherein said vibratory gyroscope means includes:

a regular triangular prism vibrator having first and second piezoelectric ceramics provided at respective first and second side surfaces and a feedback piezoelectric ceramic at a third side surface of said prism vibrator, a differential amplifier circuit for calculating a difference between an output signal from said first piezoelectric ceramic and an output signal from said second piezoelectric ceramic, an oscillator circuit supplied with an output signal from said feedback piezoelectric ceramic, a phase correction circuit supplied with an output signal from said oscillator circuit, said phase correction circuit correcting phases of said output signal from said first piezoelectric ceramic and said output signal from said second piezoelectric ceramic, and a synchronous detector circuit supplied with an output signal from said phase correction circuit and an output signal from said differential amplifier circuit and subjecting said output signal from said differential amplifier circuit to synchronous detection.

6. An audio reproduction apparatus according to claim 1, wherein said vibratory gyroscope means is formed of at least one angle detection means utilizing a galvanomagnetic effect for detecting respective movements of heads of at least one listener with respect to said reference direction at each of said plurality of predetermined angles and outputting respective angle detection signals.

7. An audio reproduction apparatus comprising:

a signal source for supplying audio signals to a plurality of channels;

storing means for measuring an impulse response from a virtual sound source position with respect to a reference direction of a listener relative to both ears of the listener being fixed and recording said impulse response, or for measuring a difference in time and level between audio signals from said virtual sound source position with respect to said reference direction of said listener at each of a plurality of angles which can be recognized by said listener and storing a control signal representing said difference in time and level between said audio signals from said virtual sound source position;

vibratory gyroscope means including a vibration drive unit and a vibration detection unit, at least one of said vibration drive unit and said vibration detection unit being formed of a piezoelectric body, said vibratory gyroscope means detecting a movement of a head of said listener with respect to said reference direction at each of a plurality of predetermined angles to output an angle detection signal;

address signal conversion means for converting said angle detection signal detected by said vibratory gyroscope means into an address signal;

control means for correcting said audio signals supplied to said plurality of channels by said signal source based on said impulse response or said control signal stored in said storing means and producing corrected audio signals; and audio reproduction means for reproducing said corrected audio signals corrected by said control means, wherein an address of said storing means is designated by said address signal from said address signal conversion means based on said angle detection signal from said vibratory gyroscope means, said angle detection signal being proportional to an angular velocity of said vibratory gyroscope means, said impulse response or said control signal stored in said storing means is read out therefrom, said audio signals are corrected by said control means based on said impulse response or said control signal, and said audio signals are corrected in response to said movement of said head of said listener in a real-time fashion.

8. An audio reproduction apparatus according to claim 7, wherein said vibratory gyroscope means includes:

a regular triangular prism vibrator having first and second piezoelectric ceramics provided at respective first and second side surfaces and a feedback piezoelectric ceramic at a third side surface of said prism vibrator, a differential amplifier circuit for calculating a difference between an output signal from said first piezoelectric ceramic and an output signal from said second piezoelectric ceramic, an oscillator circuit supplied with an output signal from said feedback piezoelectric ceramic, a phase correction circuit supplied with an output signal from said oscillator circuit, said phase correction circuit correcting phases of said output signal from said first piezoelectric ceramic and said output signal from said second piezoelectric ceramic, and a synchronous detector circuit supplied with an output signal from said phase correction circuit and an output signal from said differential amplifier circuit and subjecting said output signal from said differential amplifier circuit to synchronous detection.

9. An audio reproduction apparatus comprising:

a signal source for supplying audio signals to a plurality of channels;

storing means for measuring an impulse response from a virtual sound source position with respect to a reference direction of a head of a listener relative to both ears of the listener being fixed and storing said impulse response, or for measuring a difference in time and level between audio signals from said virtual sound source position with respect to said reference direction of said listener at each of a plurality of angles which can be recognized by said listener and storing a control signal representing said difference in time and level between said audio signals from said virtual sound source position;

vibratory gyroscope means having at least one vibratory gyroscope, said vibratory gyroscope means detecting a head movement of at least one listener with respect to said reference direction to output a respective angle detection signal for each of said at least one vibratory gyroscope;

address signal conversion means for converting each respective angle detection signal representing an angle detected by a respective one of said at least one vibratory gyroscope into a respective address signal;

control means for correcting said audio signals supplied to said plurality of channels by said signal source based on said impulse response or said control signal stored in said storing means and producing corrected audio signals; and audio reproduction means having at least one head attachment body for attaching to a respective head of said at least one listener, each head attachment body being provided with at least one vibratory gyroscope, said audio reproduction means reproducing said corrected audio signals corrected by said control means, wherein an address of said storing means is designated by said respective address signal from said address signal conversion means based on said respective angle detection signal, each angle detection signal being proportional to an angular velocity of a respective one of said at least one vibratory gyroscope and supplied from said at least one vibratory gyroscope provided on said audio reproduction means, correction is carried out based on said impulse response or said control signal stored in said storing means, and said audio signals are corrected in response to said head movement of said at least one listener in a real-time fashion.

10. An audio reproduction apparatus according to claim 9, wherein each of said at least one vibratory gyroscope is attached to one of said at least one head attachment body.

11. An audio reproduction apparatus according to claim 9, wherein said audio reproduction means further comprises a sound generating body, and said vibratory gyroscope is connected to said sound generating body.

12. An audio reproduction apparatus according to claim 9, wherein each of said at least one vibratory gyroscope is provided at a connection cable of said audio reproduction means.

13. An audio reproduction apparatus according to claim 9, wherein each of said at least one vibratory gyroscope is provided at a respective portion projected from a main body portion of said audio reproduction means.

14. An audio reproduction apparatus according to claim 9, wherein said audio reproduction means further comprises a head attachment portion independent of a main body portion of said audio reproduction means, and one of said at least one vibratory gyroscope is provided in said head attachment portion.

15. An audio reproduction apparatus according to claim 9, wherein each of said at least one vibratory gyroscope includes a vibration drive unit and a vibration detection unit, at least one of said vibration drive unit and said vibration detection unit being formed of a piezoelectric body, each of said at least one vibratory gyroscope detecting said a head movement of one of said at least one listener with respect to said reference direction at each of said plurality of predetermined angles to output said respective angle detection signal.

16. An audio reproduction apparatus according to claim 9, wherein said vibratory gyroscope includes at least one angle detection means utilizing a galvanomagnetic effect for detecting said head movement of at least one listener with respect to said reference direction and outputting signals.

17. An audio reproduction apparatus comprising:

a signal source for supplying audio signals to a plurality of channels;

storing means for measuring an impulse response from a virtual sound source position with respect to a reference direction of a head of a listener relative to both ears of the listener in accordance with a movement of the listener's head and storing the impulse response, or for measuring a difference in time and level between audio signals from the virtual sound source position with respect to the reference direction of the listener at each of a plurality of angles which can be recognized by the listener and storing a control signal representing the difference in time and level between the audio signals from the virtual sound source;

angle detection means utilizing a galvanomagnetic effect for detecting head movements of the at least one listener with respect to the reference direction to output an angle detection signal;

address signal conversion means for converting an angle detected by the angle detection means utilizing the galvanomagnetic effect into an address signal;

control means for correcting the audio signals supplied to the plurality of channels from the signal source based on the impulse response or control signal stored in the storing means; and audio reproduction means having a head attachment body capable of attaching to each of the heads of the at least one listener, the head attachment body being provided with the angle detection means, the audio reproduction means reproducing the audio signals corrected by the control means, wherein an address of the storing means is designated by the address signal from the address signal conversion means based on the angle detection signal in response to an angle supplied from the angle detection means utilizing the galvanomagnetic effect provided on the head attachment body of the audio reproduction means, the impulse response or the control signal stored in the storing means is read out based on the address signal from the address signal conversion means, the audio signals are corrected by the control means based on the impulse response or the control signal, and the audio signals are corrected in response to the movements of the heads of the at least one listener in a real-time fashion.

18. An audio reproduction apparatus according to claim 17, wherein the angle detection means utilizing the galvanomagnetic effect is a galvanomagnetic effect sensor utilizing geomagnetism in which detection coils are perpendicular to each other.

19. An audio reproduction apparatus according to claim 17, wherein the angle detection means utilizing the galvanomagnetic effect is a Hall effect galvanomagnetic effect sensor.

20. An audio reproduction apparatus according to claim 17, wherein the angle detection means utilizing the galvanomagnetic effect is a galvanomagnetic effect sensor utilizing a magnetoresistance effect.

21. An audio reproduction apparatus according to claim 17, wherein the angle detection means utilizing the galvanomagnetic effect is a planar Hall effect galvanomagnetic effect sensor.

22. An audio reproduction apparatus according to claim 17, wherein the angle detection means utilizing the galvanomagnetic effect is a Suhl effect galvanomagnetic effect sensor.

23. An audio reproduction apparatus according to claim 17, wherein the angle detection means utilizing the galvanomagnetic effect is a galvanomagnetic effect sensor utilizing a Ettingshausen effect.

24. An audio reproduction apparatus according to claim 17, wherein the angle detection means utilizing the galvanomagnetic effect produces an output signal representing a predetermined angle when a predetermined external magnetic field is applied.

25. An audio reproduction apparatus comprising:

a signal source for supplying audio signals to at least one channel;

storing means or calculating means for measuring or calculating transfer characteristics from a virtual sound source position with respect to a reference direction of a head of a listener relative to both ears of the listener at each of a plurality of angles which the listener can recognize and storing the transfer characteristics or outputting the same in a real-time fashion, and/or for storing or calculating an arrival time and a sound pressure level of an audio signal from the virtual sound source position with respect to the reference direction of the listener relative to both ears of the listener at each of the plurality of angles which can be recognized by the listener or a control signal representing the arrival time and the sound pressure level of the audio signal from the virtual sound source position;

vibratory gyroscope means for detecting movements of heads of at least one listener with respect to the reference direction at each of the plurality of angles to output an angle detection signal;

control means for correcting the audio signals supplied to the at least one channel from the signal source based on the transfer characteristics or the control signal from the storing means or the calculating means; and audio reproduction means having a head attachment body for attaching to each each head of the at least one listener, the audio reproduction means being provided with the vibratory gyroscope means and reproducing the audio signals corrected by the control means, wherein based on a signal in response to an angle supplied from the vibratory gyroscope means provided on the audio reproduction means, correction is carried out in response to the impulse response or the control signal from the storing means or the calculating means, and the audio signals are corrected in response to the movements of the heads of the at least one listener in a real-time fashion.

* * * * *